US010895004B2

(12) United States Patent
Na et al.

(10) Patent No.: US 10,895,004 B2
(45) Date of Patent: Jan. 19, 2021

(54) GOLD-BASED METALLIC GLASS MATRIX COMPOSITES

(71) Applicant: Glassimetal Technology, Inc., Pasadena, CA (US)

(72) Inventors: Jong Hyun Na, Pasadena, CA (US); William L. Johnson, San Marino, CA (US); Marios D. Demetriou, West Hollywood, CA (US); Glenn Garrett, Pasadena, CA (US); Kyung-Hee Han, Pasadena, CA (US); Maximilien E. Launey, Pasadena, CA (US)

(73) Assignee: Glassimetal Technology, Inc., Pasadena, CA (US)

( * ) Notice: Subject to any disclaimer, the term of this patent is extended or adjusted under 35 U.S.C. 154(b) by 906 days.

(21) Appl. No.: 15/438,649

(22) Filed: Feb. 21, 2017

(65) Prior Publication Data

US 2017/0241003 A1 Aug. 24, 2017

Related U.S. Application Data

(60) Provisional application No. 62/298,670, filed on Feb. 23, 2016.

(51) Int. Cl.
*C22C 45/00* (2006.01)
*C22C 5/02* (2006.01)

(52) U.S. Cl.
CPC ..... *C22C 45/003* (2013.01); *C22C 5/02* (2013.01)

(58) Field of Classification Search
CPC ..... C22C 45/003; C22C 5/02
See application file for complete search history.

(56) References Cited

U.S. PATENT DOCUMENTS

| | | | |
|---|---|---|---|
| 4,175,950 | A | 11/1979 | Linares et al. |
| 4,696,731 | A | 9/1987 | Tenhover |
| 4,765,834 | A | 8/1988 | Ananthapadmanabhan et al. |
| 4,781,803 | A | 11/1988 | Harris et al. |
| 5,350,468 | A | 9/1994 | Masumoto et al. |
| 5,593,514 | A | 1/1997 | Giessen |
| 5,919,320 | A | 7/1999 | Agarwal |

(Continued)

FOREIGN PATENT DOCUMENTS

| | | | |
|---|---|---|---|
| CN | 101191184 | A | 6/2008 |
| EP | 3149215 | A2 | 4/2017 |

(Continued)

OTHER PUBLICATIONS

International Preliminary Report on Patentability for International Application No. PCT/US2015/022254, Report dated Sep. 27, 2016, dated Oct. 6, 2016, 11 Pgs.

(Continued)

*Primary Examiner* — George Wyszomierski
(74) *Attorney, Agent, or Firm* — KPPB LLP

(57) ABSTRACT

The present disclosure provides Au-based alloys comprising Si capable of forming metallic glass matrix composites, and metallic glass matrix composites formed thereof. The Au-based metallic glass matrix composites according to the present disclosure comprise a primary-Au crystalline phase and a metallic glass phase and are free of any other phase. In certain embodiments, the metallic glass matrix composites according to the present disclosure satisfy the 18-Karat Gold Alloy Hallmark.

18 Claims, 22 Drawing Sheets

(56) References Cited

U.S. PATENT DOCUMENTS

| | | | | |
|---|---|---|---|---|
| 6,695,936 | B2 | 2/2004 | Johnson | |
| 6,709,536 | B1 | 3/2004 | Kim et al. | |
| 6,730,415 | B2 * | 5/2004 | Shibuya | A44C 27/006 204/192.16 |
| 6,749,698 | B2 | 6/2004 | Shimizu et al. | |
| 7,540,929 | B2 | 6/2009 | Demetriou et al. | |
| 7,582,172 | B2 | 9/2009 | Schroers et al. | |
| 8,066,827 | B2 | 11/2011 | Demetriou et al. | |
| 8,361,250 | B2 | 1/2013 | Demetriou et al. | |
| 8,501,087 | B2 | 8/2013 | Peker et al. | |
| 9,119,447 | B2 | 9/2015 | Demetriou et al. | |
| 9,790,580 | B1 | 10/2017 | Yurko et al. | |
| 2006/0157164 | A1 | 7/2006 | Johnson et al. | |
| 2009/0236494 | A1 | 9/2009 | Hata et al. | |
| 2010/0322818 | A1 | 12/2010 | Bridgeman et al. | |
| 2011/0162795 | A1 * | 7/2011 | Pham | C22C 45/00 156/309.9 |
| 2013/0139931 | A1 | 6/2013 | Demetriou et al. | |
| 2013/0306196 | A1 | 11/2013 | Prest et al. | |
| 2014/0009872 | A1 | 1/2014 | Prest et al. | |
| 2014/0096874 | A1 | 4/2014 | Weber | |
| 2014/0202596 | A1 * | 7/2014 | Na | B22D 27/04 148/538 |
| 2014/0331915 | A1 | 11/2014 | Chaudhari | |
| 2015/0267286 | A1 | 9/2015 | Na et al. | |
| 2015/0344999 | A1 | 12/2015 | Na et al. | |
| 2016/0340758 | A1 | 11/2016 | Na et al. | |
| 2018/0223404 | A1 | 8/2018 | Na et al. | |

FOREIGN PATENT DOCUMENTS

| | | | |
|---|---|---|---|
| EP | 3149215 | B1 | 12/2018 |
| HK | 1230251 | A | 12/2017 |
| JP | 3808354 | B2 | 8/2006 |
| WO | 2015148510 | A2 | 10/2015 |
| WO | 2017147088 | A1 | 8/2017 |

OTHER PUBLICATIONS

International Preliminary Report on Patentability for International Application No. PCT/US2017/018754, Report dated Aug. 28, 2018, dated Sep. 7, 2018, 09 Pgs.

International Preliminary Report on Patentability for International Application No. PCT/US2015/022254, Search completed Jul. 21, 2015, dated Nov. 10, 2015, 17 Pgs.

International Search Report and Written Opinion for International Application No. PCT/US2017/018754, Search completed Apr. 5, 2017. Action dated May 5, 2017. pp. 11.

"ASTM E1820-06", Standard Test Method for Measurement of Fracture Toughness, ASTM International, West Conshohocken, PA, USA, May 2007.

Basketter et al., "Nickel, Cobalt and Chromium in Consumer Products: a Role in Allergic Contact Dermatitis?", Contact Dermatitis, May 13, 1992, vol. 28, pp. 15-25.

Biggs et al., "The Hardening of Platinum Alloys for Potential Jewellery Application", Platinium Metals Review, Jan. 1, 2005, vol. 49, No. 1, XP009055328, ISSN: 0032-1400, DOI: 10.1595/147106705X24409, pp. 2-15.

Chabot et al., "Effect of silicon on trace element partitioning in iron-bearing metallic melts", Meteoritics & Planetary Science, May 27, 2010, vol. 45, No. 8, pp. 1243-1257.

Conner et al., "Shear bands and cracking of metallic glass plates in bending", Journal of Applied Physics, Jul. 15, 2003, vol. 94, No. 2, pp. 904-911.

Eisenbart, M. et al., "On the Abnormal Room Temperature Tarnishing of an 18 Carat Gold Bulk Metallic Glass Alloy", Journal of Alloys and Compounds, 2014, vol. 615, pp. S118-S122.

German, R. M. et al., "The colour of Gold-Silver-Copper alloys; Quantitative Mapping on the Ternary Diagram", Gold Bulletin, 1980, vol. 13, pp. 113-116.

Ho, C. Y. et al., "Thermal Conductivity of Ten Selected Binary Alloy System", CINDAS-TPRC Report 30, May 1975.

Hofmann, D. C. et al., "Designing metallic glass matrix composites with high toughness and tensile ductility", Nature, Feb. 28, 2008, vol. 451, pp. 1085-1089, DOI: 10.1038/nature06598.

Hunter, "Photoelectric Color Difference Meter", Journal of the Optical Society of America, Dec. 1958, vol. 48, No. 12, pp. 985-995.

Inoue et al., "Developments and applications of bulk metallic glasses", Reviews on Advanced Materials Science, Feb. 28, 2008, vol. 18, pp. 1-9.

Inoue et al., "Preparation and Thermal Stability of Bulk Amorphous Pd40Cu30Ni10P20 Alloy Cylinder of 72 mm in Diameter", Materials Transactions, JIM, 1997, vol. 38, pp. 179-183.

Lee et al., "Effect of a controlled volume fraction of dendritic phases on tensile and compressive ductility in La-based metallic glass matrix composites", Acta Materialia, vol. 52, Issue 14, Jun. 17, 2004, pp. 4121-4131.

Lewandowski, J. J. et al., "Intrinsic and extrinsic toughening of metallic glasses", Scripta Materialia, 2006, vol. 54, pp. 337-341.

Mozgovoy, S. et al., "Investigation of Mechanical, Corrosion, and Optical Properties of an 18 Carat Au—Cu—Si—Ag—Pd Metallic Glass", Intermetallics, Sep. 22, 2010, vol. 18, pp. 2289-2291.

Nishiyama et al., "New Pd-Based Glassy Alloys with High Glass Forming Ability", Journal of Alloys and Compounds, 2007, vol. 434-435, pp. 138-140.

Ritchie, R. O. et al., "On the Relationship between Critical Tensile Stress and Fracture Toughness in Mild Steel", Journal of the Mechanics and Physics of Solids, 1973, vol. 21, pp. 395-410.

Saotome et al., "Characteristic behavior of Pt-based metallic glass under rapid heating and its application to microforming", Materials Science and Engineering A, 2004, vols. 375-377, pp. 389-393.

Schroers, J. et al., "Gold Based Bulk Metallic Glass", Applied Physics Letters, Aug. 3, 2005, vol. 87, 061912, 3 pgs.

Shiraishi et al., "An estimation of the reflectivity of gold-and platinum-group metals alloyed with copper", Journal of Materials Science, Feb. 4, 2014, vol. 49, No. 9, pp. 3462-3463.

Skriver et al., "Surface Energy and Work Function of Elemental Metals", Physical Review B, Sep. 15, 1992, vol. 46, No. 11, pp. 7157-7168.

Wu et al., "Bulk Metallic Glass Composites with Transformation-Mediated Work-Hardening and Ductility", Advanced Materials, Apr. 26, 2010, vol. 22, p. 2270-2773.

Zachrisson et al., "Effect of Processing on Charpy impact toughness of metallic glass matrix composites", Journal of Materials Research, May 28, 2011, vol. 26, No. 10, pp. 1260-1268.

Zhang et al., "Formation of Bulk Pt—Pd—Ni—P Glassy Alloys", Journal of Non-Crystalline Solids, Jun. 21, 2006, vol. 352, pp. 3103-3108.

Liu et al., "Formation and Thermal Stability of Pd-based Bulk Metallic Glasses", Journal of Non-Crystalline Solids. Dec. 15, 2006, vol. 352, No. 52-54, pp. 5487-5491.

Shen et al., "Bulk amorphous Pd—Ni—Fe—P alloys: Preparation and characterization", Journal of Materials Research, 1999, vol. 14, No. 5, pp. 2107-2115.

* cited by examiner

GOLD-BASED METALLIC GLASS MATRIX COMPOSITES

CROSS-REFERENCE TO RELATED APPLICATIONS

The current application claims priority to U.S. Provisional Application No. 62/298,670, filed Feb. 23, 2016, the disclosure of which is incorporated herein by reference.

TECHNICAL FIELD

The present disclosure is directed to Au-based alloys comprising Si capable of forming metallic glass matrix composites.

BACKGROUND

U.S. Pat. No. 8,501,087 entitled "Au-Base Bulk-Solidifying Amorphous Alloys", the disclosure of which is incorporated herein by reference in its entirety, discloses Au-based metallic glass-forming alloys that comprise Si, where the atomic concentration of Au ranges from as low as 25 to as high as 75 percent and the atomic concentration of Si ranges from as low as 12 to as high as 30 percent. The patent also discloses that the alloys have at least 50% amorphous content by volume, thus implying that crystalline phases may be present at a content of less than 50% by volume. The patent does not disclose compositional ranges where a gold-based metallic glass matrix composite can be formed comprising a primary-Au phase and a metallic glass phase and being free of any other phase.

U.S. Pat. No. 6,709,536 entitled "in Situ Ductile Metal/Bulk Metallic Glass Matrix Composites Formed by Chemical Partitioning", the disclosure of which is incorporated herein by reference in its entirety, discloses a composite amorphous metal object comprising an amorphous metal alloy forming a substantially continuous matrix, and a second phase embedded in the matrix, the second phase comprising ductile metal particles having a spacing between adjacent particles in the range of from 1 to 20 micrometers. The patent does not disclose compositional ranges where a gold-based metallic glass matrix composite can be formed comprising a primary-Au phase and a metallic glass phase and being free of any other phase.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

BRIEF SUMMARY

Figure 1:
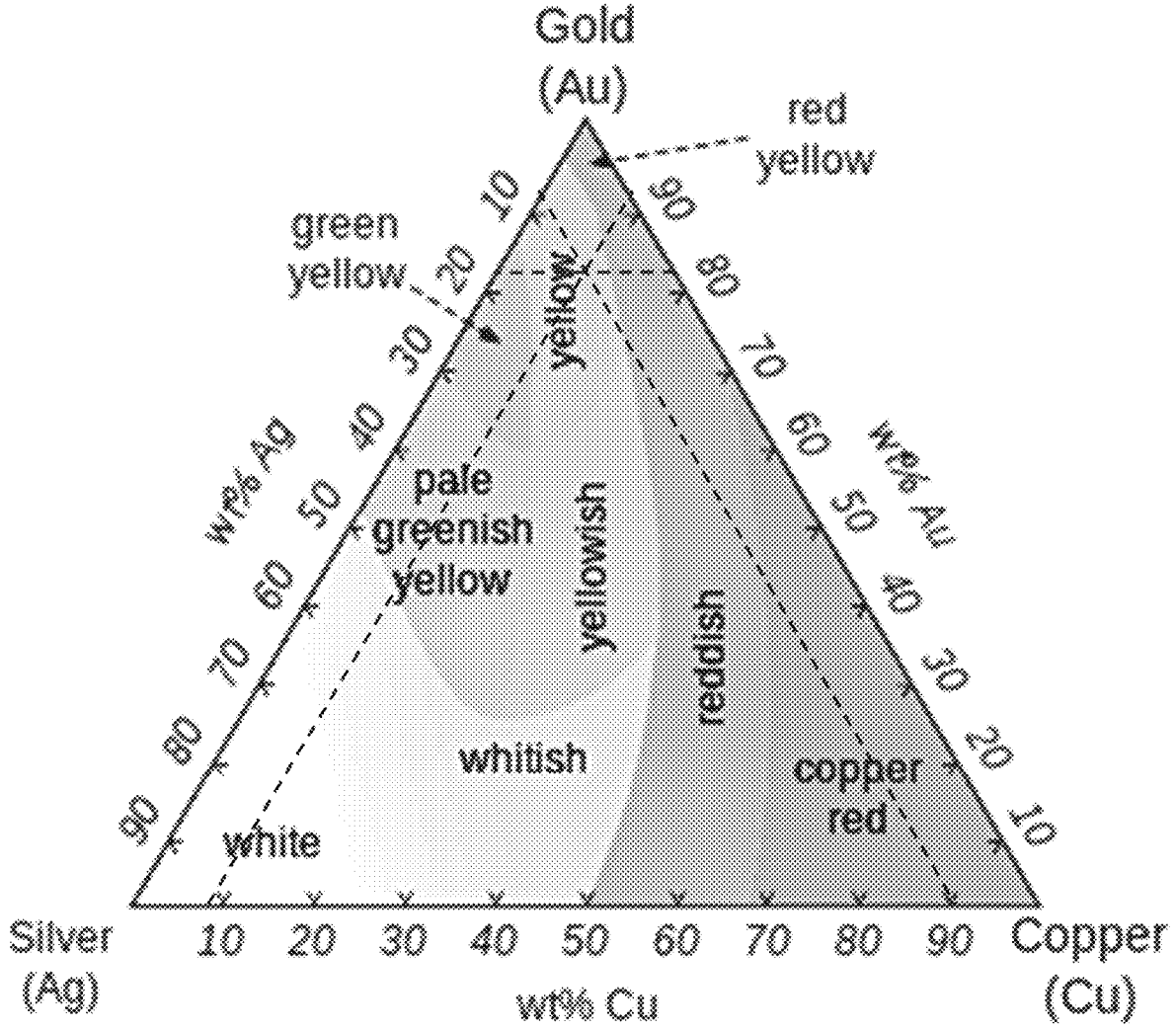
FIG. 1 provides a color-map of the ternary Au—Ag—Cu system that divides the alloy composition space into regions according to the optical appearance of the alloys.

The disclosure provides Au-based alloys capable of forming metallic glass-matrix composites, and metallic glass matrix composites formed thereof.

In one embodiment, the disclosure is directed to a Au-based alloy comprising Si capable of forming a Au-based metallic glass matrix composite;

where the atomic fraction of Si is in the range of 1 to 16; and where the Au-based metallic glass matrix composite consists essentially of a primary-Au crystalline phase and a metallic glass phase.

In another embodiment, the disclosure is directed to a Au-based metallic glass matrix composite comprising Si is in the range of 1 to 16, and consisting essentially of a primary-Au crystalline phase and a metallic glass phase.

In another embodiment, the Au-based metallic glass matrix composite is free of any crystalline phase other than the primary-Au crystalline phase.

In another embodiment, the Au-based metallic glass matrix composite is free of an intermetallic phase.

In another embodiment, the Au-based metallic glass matrix composite is free of a pure-Si phase.

In another embodiment, the Au-based metallic glass matrix composite is free of a eutectic structure.

In another embodiment, the atomic concentration of Au in the primary-Au crystalline phase is higher than the nominal atomic concentration of Au in the alloy, while the atomic concentration of Au in the metallic glass phase is lower than the nominal atomic concentration of Au in the alloy.

In another embodiment, the atomic concentration of Si in the primary-Au crystalline phase is lower than the nominal atomic concentration of Si in the alloy, while the atomic concentration of Si in the metallic glass phase is higher than the nominal atomic concentration of Si in the alloy.

In another embodiment, the molar fraction of the metallic glass phase in the composite, x, is given by $x=(e-e_c)/e_g$, where e is the nominal atomic concentration of Si in the Au-based alloy, $e_c$ is the atomic concentration of Si in the primary-Au phase, and $e_g$ is the atomic concentration of Si in the metallic glass phase.

In another embodiment, the molar fraction of the metallic glass phase in the composite, x, is given by $x=e/e_g$, where e is the nominal atomic concentration of Si in the Au-based alloy and $e_g$ is the atomic concentration of Si in the metallic glass phase.

In another embodiment, the molar fraction of the metallic glass phase in the composite, x, is given by as x=e/18.5%, where e is the nominal atomic concentration of Si in the Au-based alloy.

In another embodiment, the primary-Au crystalline phase is free of Si.

In another embodiment, the Au-based metallic glass matrix composite is free of any phase in which the atomic concentration of Au is lower than the atomic concentration of Au in the metallic glass phase.

In another embodiment, the Au-based metallic glass matrix composite is free of any phase in which the atomic concentration of Si is higher than the atomic concentration of Si in the metallic glass phase.

In another embodiment, the Au-based metallic glass matrix composite is an "equilibrium composite".

In another embodiment, the Au-based metallic glass matrix composite has a yellow color.

In another embodiment, the Au-based metallic glass matrix composite has a visually unresolved microstructure.

In another embodiment, the Au-based metallic glass matrix composite has a uniform overall color.

In another embodiment, the Au-based metallic glass matrix composite has a visually unresolved microstructure.

In another embodiment, the Au-based metallic glass matrix composite has a uniform overall color.

In another embodiment, the Au-based metallic glass matrix composite has a color characterized by a CIELAB coordinate L* in the range of 65 to 100, a CIELAB coordinate a* in the range of −5 to 15, and a CIELAB coordinate b* in the range of 0 to 40.

In another embodiment, the Au-based metallic glass matrix composite has a color characterized by CIELAB coordinate L* in the range of 70 to 100.

In another embodiment, the Au-based metallic glass matrix composite has a color characterized by CIELAB coordinate L* in the range of 72.5 to 97.5.

In another embodiment, the Au-based metallic glass matrix composite has a color characterized by CIELAB coordinate L* in the range of 75 to 95.

In another embodiment, the Au-based metallic glass matrix composite has a color characterized by CIELAB coordinate L* in the range of 77.5 to 92.5.

In yet another embodiment, the Au-based metallic glass matrix composite has a color characterized by CIELAB coordinate L* in the range of 80 to 90.

In another embodiment, the Au-based metallic glass matrix composite has a color characterized by CIELAB coordinate a* in the range of −4 to 12.

In another embodiment, the Au-based metallic glass matrix composite has a color characterized by CIELAB coordinate a* in the range of −3 to 11.

In another embodiment, the Au-based metallic glass matrix composite has a color characterized by CIELAB coordinate a* in the range of −2 to 10.

In another embodiment, the Au-based metallic glass matrix composite has a color characterized by CIELAB coordinate a* in the range of −1 to 9.

In yet another embodiment, the Au-based metallic glass matrix composite has a color characterized by CIELAB coordinate a* in the range of 0 to 8.

In another embodiment, the Au-based metallic glass matrix composite has a color characterized by CIELAB coordinate b* in the range of 0 to 35.

In another embodiment, the Au-based metallic glass matrix composite has a color characterized by CIELAB coordinate b* in the range of 0 to 30.

In another embodiment, the Au-based metallic glass matrix composite has a color characterized by CIELAB coordinate b* in the range of 2.5 to 40.

In another embodiment, the Au-based metallic glass matrix composite has a color characterized by CIELAB coordinate b* in the range of 2.5 to 35.

In another embodiment, the Au-based metallic glass matrix composite has a color characterized by CIELAB coordinate b* in the range of 2.5 to 30.

In another embodiment, the Au-based metallic glass matrix composite has a color characterized by CIELAB coordinate b* in the range of 5 to 40.

In another embodiment, the Au-based metallic glass matrix composite has a color characterized by CIELAB coordinate b* in the range of 5 to 35.

In yet another embodiment, the Au-based metallic glass matrix composite has a color characterized by CIELAB coordinate b* in the range of 5 to 30.

In another embodiment, the Au-based metallic glass matrix composite has a color characterized by CIELAB coordinates a*, b*, and L* where:

$$0.75\cdot(xa_g^*+(1-x)a_c^*)<a^*<1.25\cdot(xa_g^*+(1-x)a_c^*),$$

$$0.75\cdot(xb_g^*+(1-x)b_c^*)<b^*<1.25\cdot(xb_g^*+(1-x)b_c^*),$$

$$0.75\cdot(xL^*_g+(1-x)L^*_c)<L^*<1.25\cdot(xL^*_g+(1-x)L^*_c);$$

where $x=(e-e_c)/e_g$, where e is the nominal atomic concentration of Si in the Au-based alloy, $e_c$ is the atomic concentration of Si in the primary-Au phase, and $e_g$ is the atomic concentration of Si in the metallic glass phase;

where $a_c^*$, $b_c^*$, and $L_c^*$ are the CIELAB coordinates characterizing the color of the primary-Au crystalline phase;

and where $a_g^*$, $b_g^*$, and $L_g^*$ are the CIELAB coordinates characterizing the color of the metallic glass phase.

In another embodiment, $x=e/e_g$.

In another embodiment, x=e/18.5%.

In another embodiment, the weight fraction of Au in the Au-based alloy is at least 75 percent.

In another embodiment, the weight fraction of Au in the Au-based alloy is at least 58.3 percent.

In another embodiment, the critical casting thickness of a Au-based metallic glass matrix composite is within 50% of the critical casting thickness of a monolithic Au-based metallic glass having a composition substantially similar to the metallic glass phase of the Au-based metallic glass matrix composite.

In another embodiment, the critical casting thickness of a Au-based metallic glass matrix composite is within 25% of the critical casting thickness of a monolithic Au-based metallic glass having a composition substantially similar to the metallic glass phase of the Au-based metallic glass matrix composite.

In another embodiment, the critical casting thickness of a Au-based metallic glass matrix composite is within 10% of the critical casting thickness of a monolithic Au-based metallic glass having a composition substantially similar to the metallic glass phase of the Au-based metallic glass matrix composite.

In another embodiment, the critical casting thickness of a Au-based metallic glass matrix composite is at least as large as the critical casting thickness of a monolithic Au-based metallic glass having a composition substantially similar to the metallic glass phase of the Au-based metallic glass matrix composite.

In another embodiment, the critical casting thickness of a Au-based metallic glass matrix composite is at least 10% larger than the critical casting thickness of a monolithic Au-based metallic glass having a composition substantially similar to the metallic glass phase of the Au-based metallic glass matrix composite.

In another embodiment, the critical casting thickness of a Au-based metallic glass matrix composite is at least 25% larger than the critical casting thickness of a monolithic Au-based metallic glass having a composition substantially similar to the metallic glass phase of the Au-based metallic glass matrix composite.

In another embodiment, the critical casting thickness of a Au-based metallic glass matrix composite is at least 50% larger than the "critical casting thickness" of a monolithic Au-based metallic glass having a composition substantially similar to the metallic glass phase of the Au-based metallic glass matrix composite.

In another embodiment, the critical rod diameter of the Au-based metallic glass matrix composite is at least 1 mm.

In another embodiment, the critical rod diameter of the Au-based metallic glass matrix composite is at least 2 mm.

In another embodiment, the critical rod diameter of the Au-based metallic glass matrix composite is at least 3 mm.

In another embodiment, the critical rod diameter of the Au-based metallic glass matrix composite is at least 4 mm.

In another embodiment, the critical rod diameter of the Au-based metallic glass matrix composite is at least 5 mm.

In another embodiment, the critical rod diameter of the metallic glass phase is at least 1 mm.

In another embodiment, the critical rod diameter of the metallic glass phase is at least 2 mm.

In another embodiment, the critical rod diameter of the metallic glass phase is at least 3 mm.

In another embodiment, the critical rod diameter of the metallic glass phase is at least 4 mm.

In another embodiment, the critical rod diameter of the metallic glass phase is at least 5 mm.

In another embodiment, the molar fraction of the primary-Au crystalline phase in the Au-based metallic glass matrix composite is in the range of 1 to 99 percent.

In another embodiment, the molar fraction of the primary-Au crystalline phase in the Au-based metallic glass matrix composite is in the range of 10 to 90 percent.

In another embodiment, the molar fraction of the primary-Au crystalline phase in the Au-based metallic glass matrix composite is in the range of 20 to 80 percent.

In another embodiment, the molar fraction of the primary-Au crystalline phase in the Au-based metallic glass matrix composite is in the range of 30 to 70 percent.

In another embodiment, the molar fraction of the primary-Au crystalline phase in the Au-based metallic glass matrix composite is greater than 50 percent.

In another embodiment, the molar fraction of the primary-Au crystalline phase in the Au-based metallic glass matrix composite is greater than 50 percent and up to 80 percent.

In another embodiment, the molar fraction of the primary-Au crystalline phase in the Au-based metallic glass matrix composite is in the range of 60 to 75 percent.

In another embodiment, the atomic fraction of Si is in the range of 5 to 13 percent.

In another embodiment, the atomic fraction of Si is in the range of 6 to 12 percent.

In another embodiment, the atomic fraction of Si is in the range of 7 to 11 percent.

In another embodiment, the atomic fraction of Si is not more than 10 percent.

In another embodiment, the atomic fraction of Si is in the range of 5 to 13 percent, and wherein the molar fraction of the primary-Au crystalline phase in the Au-based metallic glass matrix composite is in the range of 10 to 90 percent.

In another embodiment, the atomic fraction of Si is in the range of 6 to 12 percent, and wherein the molar fraction of the primary-Au crystalline phase in the Au-based metallic glass matrix composite is in the range of 20 to 80 percent.

In another embodiment, the atomic fraction of Si is in the range of 7 to 11 percent, and wherein the molar fraction of the primary-Au crystalline phase in the Au-based metallic glass matrix composite is in the range of 30 to 70 percent.

In another embodiment, the atomic fraction of Si is not more than 10 percent, and wherein the molar fraction of the primary-Au crystalline phase in the Au-based metallic glass matrix composite is greater than 50 percent.

In another embodiment, the partitioning coefficient for Si in the primary-Au phase of a gold metallic glass matrix composite is less than 0.2

In another embodiment, the partitioning coefficient for Si in the primary-Au phase of a gold metallic glass matrix composite is less than 0.1.

In yet another embodiment, the partitioning coefficient for Si in the primary-Au phase of a gold metallic glass matrix composite is less than 0.05.

In another embodiment, the alloy also comprises one or more of Cu, Ag, Pd, and Zn.

In another embodiment, the alloy also comprises Cu in atomic fraction of up to 40 percent.

In another embodiment, the alloy also comprises Cu in an atomic concentration ranging from 15 to 35 percent.

In another embodiment, the alloy also comprises Cu in an atomic fraction ranging from 20 to 30 percent.

In another embodiment, the partitioning coefficient for Cu in the primary-Au phase of a gold metallic glass matrix composite is less than 1.

In another embodiment, the partitioning coefficient for Cu in the primary-Au phase of a gold metallic glass matrix composite is in the range of 0.6 to 1.1.

In yet another embodiment, the partitioning coefficient for Cu in the primary-Au phase of a gold metallic glass matrix composite is in the range of 0.8 to 1.

In another embodiment, the alloy also comprises Ag in an atomic fraction of up to 30 percent.

In another embodiment, the alloy also comprises Ag in an atomic fraction ranging from 3 to 27 percent.

In another embodiment, the alloy also comprises Ag in an atomic fraction ranging from 5 to 25 percent.

In another embodiment, the alloy also comprises Ag in an atomic fraction of up to 15 percent.

In another embodiment, the alloy also comprises Ag in an atomic fraction ranging from 1 to 14 percent.

In another embodiment, the alloy also comprises Ag in an atomic fraction ranging from 2 to 12 percent.

In another embodiment, the alloy also comprises Ag in an atomic fraction ranging from 4 to 10 percent.

In another embodiment where the alloy also comprises Ag, the atomic concentration of Ag in the primary-Au particulate phase is higher than the nominal atomic concentration of Ag in the composite, while the atomic concentration of Ag in the metallic glass matrix phase is lower than nominal atomic concentration of Ag in the composite.

In another embodiment, the partitioning coefficient for Ag in the primary-Au phase of a gold metallic glass matrix composite is greater than 1.

In another embodiment, the partitioning coefficient for Ag in the primary-Au phase of a gold metallic glass matrix composite is in the range of 2 to 5.

In yet another embodiment, the partitioning coefficient for Ag in the primary-Au phase of a gold metallic glass matrix composite is in the range of 3 to 4.

In another embodiment, the alloy also comprises Pd in an atomic fraction of up to 7.5 percent.

In another embodiment, the alloy also comprises Pd in an atomic fraction of up to 5 percent.

In another embodiment, the alloy also comprises Pd in an atomic fraction ranging from 1 to 4 percent.

In another embodiment where the alloy also comprises Pd, the primary-Au particulate phase is free of Pd.

In another embodiment, the partitioning coefficient for Pd in the primary-Au phase of a gold metallic glass matrix composite is less than 0.2

In another embodiment, the partitioning coefficient for Pd in the primary-Au phase of a gold metallic glass matrix composite is less than 0.1.

In yet another embodiment, the partitioning coefficient for Pd in the primary-Au phase of a gold metallic glass matrix composite is less than 0.05.

In another embodiment, the alloy also comprises Zn in an atomic fraction of up to 7.5 percent.

In another embodiment, the alloy also comprises Zn in an atomic fraction of up to 5 percent.

In another embodiment, the alloy also comprises Zn in an atomic fraction ranging from 0.5 to 4 percent.

In another embodiment, the alloy also comprises Zn in an atomic fraction ranging from 1 to 3 percent.

In another embodiment where the alloy also comprises Zn, the atomic concentration of Zn in the primary-Au particulate phase is lower than the nominal atomic concentration of Zn in the composite, while the atomic concentration of Zn in the metallic glass matrix phase is higher than the nominal atomic concentration of Zn in the composite.

In another embodiment, the partitioning coefficient for Zn in the primary-Au phase of a gold metallic glass matrix composite is greater than 1.

In another embodiment, the partitioning coefficient for Zn in the primary-Au phase of a gold metallic glass matrix composite is in the range of 0.95 to 3.

In yet another embodiment, the partitioning coefficient for Zn in the primary-Au phase of a gold metallic glass matrix composite is in the range of 1 to 2.

In another embodiment, the alloy also comprises Ge in an atomic fraction of up to 7.5 percent.

In another embodiment, the alloy also comprises Pt in an atomic fraction of up to 7.5 percent.

In another embodiment, the alloy also comprises one or more of Ni, Co, Fe Al, Be, Y, La, Sn, Sb, Pb, P.

In another embodiment, the alloy also comprises one or more of Ni, Co, Fe Al, Be, Y, La, Sn, Sb, Pb, P, each in an atomic fraction of up to 5 percent.

In another embodiment, the partitioning coefficient for Au in the primary-Au phase of a gold metallic glass matrix composite is greater than 1.

In another embodiment, the partitioning coefficient for Au in the primary-Au phase of a gold metallic glass matrix composite is in the range of 0.9 to 1.5.

In yet another embodiment, the partitioning coefficient for Au in the primary-Au phase of a gold metallic glass matrix composite is in the range of 1 to 1.3.

In another embodiment, the disclosure is directed to a Au-based alloy capable of forming a Au-based metallic glass matrix composite having a composition represented by the following formula (subscripts denote atomic percentages):

$$Au_{(100-a-b-c-d-e)}Cu_aAg_bPd_cZn_dSi_e \quad \text{EQ. (1)}$$

where:

a ranges from 5 to 35;

b ranges from 1 to 30;

c is up to 7.5;

d is up to 7.5;

e ranges from 1 to 16; and wherein the Au-based metallic glass matrix composite consists essentially of a primary-Au crystalline phase and a metallic glass phase.

In another embodiment, the disclosure is directed to a Au-based metallic glass matrix composite having a composition represented by the following formula (subscripts denote atomic percentages):

$$Au_{(100-a-b-c-d-e)}Cu_aAg_bPd_cZn_dSi_e \quad \text{EQ. (1)}$$

where:

a ranges from 5 to 35;

b ranges from 1 to 30;

c is up to 7.5;

d is up to 7.5;

e ranges from 1 to 16; and wherein the Au-based metallic glass matrix composite consists essentially of a primary-Au crystalline phase and a metallic glass phase.

In another embodiment, the weight fraction of Au is at least 75 percent.

In another embodiment, a ranges from 10 to 30.

In another embodiment, a ranges from 15 to 25.

In another embodiment, a ranges from 15 to 35.

In another embodiment, a ranges from 20 to 30.

In another embodiment, a ranges from 21 to 27.

In another embodiment, b ranges from 3 to 27.

In another embodiment, b ranges from 5 to 25.

In another embodiment, b ranges from 10 to 30.

In another embodiment, b ranges from 13 to 27.

In another embodiment, b ranges from 1 to 12.

In another embodiment, b ranges from 3 to 11.

In another embodiment, b ranges from 4 to 10.

In another embodiment, c ranges from 0.5 to 5.

In another embodiment, c ranges from 1 to 4.

In another embodiment, d ranges from 0.5 to 4.

In another embodiment, e ranges from 2 to 15.

In another embodiment, e ranges from 3 to 14.

In another embodiment, e ranges from 5 to 13.

In another embodiment, e ranges from 6 to 12.

In another embodiment, e ranges from 7 to 11.

In another embodiment, e is less than 12.

In another embodiment, e is less than 10.

In another embodiment, e ranges from 5 to 13, and wherein the molar fraction of the primary-Au crystalline phase in the Au-based metallic glass matrix composite is in the range of 10 to 90 percent.

In another embodiment, e ranges from 6 to 12, and wherein the molar fraction of the primary-Au crystalline phase in the Au-based metallic glass matrix composite is in the range of 20 to 80 percent.

In another embodiment, e ranges from 7 to 11, and wherein the molar fraction of the primary-Au crystalline phase in the Au-based metallic glass matrix composite is in the range of 30 to 70 percent.

In another embodiment, e is not more than 10 percent, and wherein the molar fraction of the primary-Au crystalline phase in the Au-based metallic glass matrix composite is greater than 50 percent.

In some embodiments, the disclosure is directed to a Au-based alloy capable of forming a Au-based metallic glass matrix composite comprising Au, Cu, Ag, Pd, and Si;

where the atomic concentrations of Au, Cu, Ag, Pd, and Si depend on a parameter x, where x is selected from the range of $0<x<1$;

where the concentration of Au in atomic percent is defined by equation $a_1+a_2 \cdot x$, where $60<a_1<70$ and $-16<a_2<-14$;

where the concentration of Cu in atomic percent is defined by equation $b_1+b_2 \cdot x$, where $20<b_1<25$ and $2.9<b_2<3.3$;

where the concentration of Ag in atomic percent is defined by equation $c_1+c_2 \cdot x$, where $11<c_1<14$ and $-10<c_2<-9$;

where the concentration of Pd in atomic percent is defined by equation $d \cdot x$, where $2<d<4$;

where the concentration of Si in atomic percent is defined by equation $e \cdot x$, where $17<e<20$; and wherein the Au-based metallic glass matrix composite consists essentially of a primary-Au crystalline phase and a metallic glass phase.

In some embodiments, the disclosure is directed to a Au-based metallic glass matrix composite comprising Au, Cu, Ag, Pd, and Si;

where the atomic concentrations of Au, Cu, Ag, Pd, and Si depend on a parameter x, where x is selected from the range of $0<x<1$;

where the concentration of Au in atomic percent is defined by equation $a_1+a_2 \cdot x$, where $60<a_1<70$ and $-16<a_2<-14$;

where the concentration of Cu in atomic percent is defined by equation $b_1+b_2 \cdot x$, where $20<b_1<25$ and $2.9<b_2<3.3$;

where the concentration of Ag in atomic percent is defined by equation $c_1+c_2 \cdot x$, where $11<c_1<14$ and $-10<c_2<-9$;

where the concentration of Pd in atomic percent is defined by equation $d \cdot x$, where $2<d<4$;

where the concentration of Si in atomic percent is defined by equation $e \cdot x$, where $17<e<20$; and wherein the Au-based metallic glass matrix composite consists essentially of a primary-Au crystalline phase and a metallic glass phase.

In one embodiment, $62.5<a_1<67.5$.

In another embodiment, $-15.5<a_2<-15$.

In another embodiment, $21<b_1<23$.

In another embodiment, $3.0<b_2<3.2$;

In another embodiment, $12<c_1<13$.

In another embodiment, $-9.6<c_2<-9.2$.

In another embodiment, $2.5<d<3.5$.

In another embodiment, $18<e<19$.

The disclosure is also directed to a gold metallic glass matrix composite having composition selected from a group consisting of: $Au_{59.04}Cu_{24}Ag_{7.63}Pd_{1.33}Si_8$, $Au_{60}Cu_{23.5}Ag_9Pd_{1.1}Si_{6.4}$, $Au_{58}Cu_{24}Ag_{7.5}Pd_{1.5}Si_9$, $Au_{55.5}Cu_{24.4}Ag_{6.2}Pd_2Si_{11.9}$, $Au_{56.96}Cu_{24}Ag_{7.37}Pd_{1.67}Si_{10}$, $Au_{55.5}Cu_{26}Ag_7Pd_{1.5}Si_{10}$, $Au_{59.5}Cu_{24}Ag_7Pd_{1.5}Si_8$, $Au_{55.5}Cu_{28}Ag_7Pd_{1.55}Si_8$, $Au_{59.5}Cu_{24}Ag_{7.5}Pd_1Si_8$, $Au_{59.5}Cu_{24}Ag_7Pd_{1.5}Si_8$, $Au_{56}Cu_{24}Ag_{7.5}Zn_2Pd_{1.5}Si_9$, $Au_{57}Cu_{24}Ag_{7.5}Zn_1Pd_{1.5}Si_9$, $Au_{55}Cu_{24}Ag_{7.5}Zn_3Pd_{1.5}Si_9$, $Au_{56.25}Cu_{24}Ag_7Zn_{2.25}Pd_{1.5}Si_9$, $Au_{50.9}Cu_{22.6}Ag_{12.5}Pd_2Si_{12}$, $Au_{51.7}Cu_{19.3}Ag_{15}Pd_2Si_{12}$, $Au_{52.1}Cu_{17.9}Ag_{16}Pd_2Si_{12}$, $Au_{53.4}Cu_{18.1}Ag_{18}Pd_{1.5}Si_9$, $Au_{54.8}Cu_{18.2}Ag_{20}Pd_1Si_6$, $Au_{50.1}Cu_{20.9}Ag_{10}Zn_5Pd_2Si_{12}$, and $Au_{51.7}Cu_{22.8}Ag_{12.5}Zn_2Pd_2Si_9$.

The disclosure is also directed to various methods of forming a gold metallic glass matrix composite. In one embodiment, the disclosure is directed to a method of forming a gold metallic glass matrix composite comprising:

heating an alloy capable of forming a Au-based metallic glass matrix composite to a temperature above the liquidus temperature of the alloy to form a molten alloy; and cooling the molten alloy at a sufficiently high cooling rate to form a Au-based metallic glass matrix composite.

In another embodiment, the alloy is heated to a temperature that is at least 100° C. above the liquidus temperature of the alloy.

In another embodiment, the alloy is heated to a temperature that is at least 200° C. above the liquidus temperature of the alloy.

In another embodiment, the alloy is heated to a temperature of at least 800° C.

In another embodiment, the alloy is heated to a temperature of at least 900° C.

In another embodiment, the molten alloy is cooled at a cooling rate that is at least as high as the critical cooling rate of the metallic glass matrix composite.

In another embodiment, the molten alloy is cooled at a cooling rate that is at least as high as the critical cooling rate of the metallic glass phase.

In another embodiment, the average microstructural feature size is less than 30 μm.

In another embodiment, the average microstructural feature size is less than 20 μm.

In another embodiment, the average microstructural feature size is less than 10 μm.

In another embodiment, the disclosure is directed to a method of forming a gold metallic glass matrix composite comprising:

heating an alloy capable of forming a Au-based metallic glass matrix composite to a temperature above the liquidus temperature of the alloy to form a molten alloy;

cooling the molten alloy to at least one annealing temperature in the semi-solid region to form a semi-solid; and cooling the semi-solid at a sufficiently high cooling rate to form a Au-based metallic glass matrix composite.

In another embodiment, the semi-solid is cooled at a cooling rate that is at least as high as the critical cooling rate of the metallic glass matrix composite.

In another embodiment, the semi-solid is cooled at a cooling rate that is at least as high as the critical cooling rate of the metallic glass phase.

In another embodiment, the at least one annealing temperature is at least 600° C.

In another embodiment, the at least one annealing temperature is at least 650° C.

In another embodiment, the at least one annealing temperature is at least 700° C.

In another embodiment, the semi-solid is held at the at least one annealing temperature for a duration of at least 60 s.

In another embodiment, the semi-solid is held at the at least one annealing temperature for a duration of at least 300 s.

In another embodiment, the semi-solid is held at the at least one annealing temperature for a duration of at least 900 s.

In another embodiment, the semi-solid is held at the at least one annealing temperature for a duration of at least 1800 s.

In another embodiment, the semi-solid is held at the at least one annealing temperature for a duration of at least 3600 s.

In another embodiment, the average microstructural feature size is less than 100 μm.

In another embodiment, the average microstructural feature size is greater than 10 μm.

In another embodiment, the average microstructural feature size is between 10 and 50 μm.

In another embodiment, the average microstructural feature size is between 20 and 40 μm.

In another embodiment, the hardness of gold metallic glass matrix composites is in the range of 125 to 350 HV.

In another embodiment, the hardness of gold metallic glass matrix composites is in the range of 150 to 350 HV.

In another embodiment, the hardness of gold metallic glass matrix composites is in the range of 175 to 350 HV.

In another embodiment, the hardness of gold metallic glass matrix composites is in the range of 200 to 325 HV.

In another embodiment, the hardness of the gold metallic glass matrix composite is at least as high as that predicted by a linear rule of mixture between the primary-Au and metallic glass phases.

In another embodiment, the hardness of the gold metallic glass matrix composite is higher than that predicted by a linear rule of mixture between the primary-Au and metallic glass phases.

In another embodiment, the hardness of the gold metallic glass matrix composite is higher than that predicted by a linear rule of mixture between the primary-Au and metallic glass phases by at least 5%.

In another embodiment, the hardness of the gold metallic glass matrix composite is higher than that predicted by a linear rule of mixture between the primary-Au and metallic glass phases by at least 10%.

In yet another embodiment, the hardness of the gold metallic glass matrix composite is higher than that predicted by a linear rule of mixture between the primary-Au and metallic glass phases by at least 15%.

In another embodiment, the gold metallic glass matrix composite comprises Si at an atomic concentration of at least 4 percent, and where the hardness of the gold metallic glass matrix composites is at least 200 HV.

In another embodiment, the gold metallic glass matrix composite comprises Si at an atomic concentration of at least 6 percent, and where the hardness of the gold metallic glass matrix composites is at least 220 HV.

In another embodiment, the gold metallic glass matrix composite comprises Si at an atomic concentration of at least 8 percent, and where the hardness of the gold metallic glass matrix composites is at least 240 HV.

In another embodiment, the gold metallic glass matrix composite comprises Si at an atomic concentration of at least 10 percent, and where the hardness of the gold metallic glass matrix composites is at least 260 HV.

In another embodiment, the gold metallic glass matrix composite comprises Si at an atomic concentration of at least 12 percent, and where the hardness of the gold metallic glass matrix composites is at least 280 HV.

In another embodiment, the molar fraction of the gold metallic glass matrix composite is at least 20%, and where the hardness of the gold metallic glass matrix composites is at least 140 HV.

In another embodiment, the molar fraction of the gold metallic glass matrix composite is at least 35%, and where the hardness of the gold metallic glass matrix composites is at least 180 HV.

In another embodiment, the molar fraction of the gold metallic glass matrix composite is at least 50%, and where the hardness of the gold metallic glass matrix composites is at least 220 HV.

In another embodiment, the molar fraction of the gold metallic glass matrix composite is at least 65%, and where the hardness of the gold metallic glass matrix composites is at least 260 HV.

In yet another embodiment, the molar fraction of the gold metallic glass matrix composite is at least 80%, and where the hardness of the gold metallic glass matrix composites is at least 300 HV.

In another embodiment, the gold metallic glass matrix composite comprises Si at an atomic concentration of at least 4 percent and Zn at an atomic concentration of at least 0.5 percent, and where the hardness of the gold metallic glass matrix composites is at least 220 HV.

In another embodiment, the gold metallic glass matrix composite comprises Si at an atomic concentration of at least 6 percent and Zn at an atomic concentration of at least 0.5 percent, and where the hardness of the gold metallic glass matrix composites is at least 240 HV.

In another embodiment, the gold metallic glass matrix composite comprises Si at an atomic concentration of at least 8 percent and Zn at an atomic concentration of at least 0.5 percent, and where the hardness of the gold metallic glass matrix composites is at least 260 HV.

In another embodiment, the gold metallic glass matrix composite comprises Si at an atomic concentration of at least 10 percent and Zn at an atomic concentration of at least 0.5 percent, and where the hardness of the gold metallic glass matrix composites is at least 280 HV.

In another embodiment, the gold metallic glass matrix composite comprises Si at an atomic concentration of at least 12 percent and Zn at an atomic concentration of at least 0.5 percent, and where the hardness of the gold metallic glass matrix composites is at least 300 HV.

In another embodiment, the gold metallic glass matrix composite comprises Zn at an atomic concentration of at least 0.5 percent, the molar fraction of the gold metallic glass matrix composite is at least 20%, and where the hardness of the gold metallic glass matrix composites is at least 160 HV.

In another embodiment, the gold metallic glass matrix composite comprises Zn at an atomic concentration of at least 0.5 percent, the molar fraction of the gold metallic glass matrix composite is at least 35%, and where the hardness of the gold metallic glass matrix composites is at least 200 HV.

In another embodiment, the gold metallic glass matrix composite comprises Zn at an atomic concentration of at least 0.5 percent, the molar fraction of the gold metallic glass matrix composite is at least 50%, and where the hardness of the gold metallic glass matrix composites is at least 240 HV.

In another embodiment, the gold metallic glass matrix composite comprises Zn at an atomic concentration of at least 0.5 percent, the molar fraction of the gold metallic glass matrix composite is at least 65%, and where the hardness of the gold metallic glass matrix composites is at least 280 HV.

In yet another embodiment, the gold metallic glass matrix composite comprises Zn at an atomic concentration of at least 0.5 percent, the molar fraction of the gold metallic glass matrix composite is at least 80%, and where the hardness of the gold metallic glass matrix composites is at least 320 HV.

In another embodiment, the average interdendritic spacing in the composite microstructure is equal to or less than the plastic zone radius of the metallic glass phase.

In another embodiment, the average interdendritic spacing in the composite microstructure is equal to or less than 20 μm.

In another embodiment, the average interdendritic spacing in the composite microstructure is equal to or less than 3 times the plastic zone radius of the metallic glass phase.

In another embodiment, the average interdendritic spacing in the composite microstructure is equal to or less than 60 μm.

In another embodiment, the gold metallic glass matrix composite subjected to a bending test demonstrates a yield load that is higher than the yield load of the monolithic primary-Au phase alloy subjected to a bending test.

In another embodiment, the gold metallic glass matrix composite subjected to a bending test demonstrates an ultimate load that is higher than the ultimate load of the monolithic primary-Au phase alloy subjected to a bending test.

In another embodiment, the gold metallic glass matrix composite subjected to a bending test demonstrates an ultimate load that is higher than the ultimate load of the monolithic metallic glass phase alloy subjected to a bending test.

In another embodiment, the average microstructural feature size in the gold metallic glass matrix composite is less than 20 micrometers, and the composite subjected to a bending test demonstrates a yield load that is higher than that predicted by a linear rule of mixture between the yield loads of the monolithic primary-Au and metallic glass phase alloys subjected to a bending test.

In another embodiment, the average microstructural feature size in the gold metallic glass matrix composite is less than 20 micrometers, and the composite subjected to a bending test demonstrates a yield load that is higher than that predicted by a linear rule of mixture between the yield loads of the monolithic primary-Au and metallic glass phase alloys subjected to a bending test by at least 5%.

In another embodiment, the average microstructural feature size in the gold metallic glass matrix composite is less than 20 micrometers, and the composite subjected to a bending test demonstrates a yield load that is higher than that predicted by a linear rule of mixture between the yield loads of the monolithic primary-Au and metallic glass phase alloys subjected to a bending test by at least 10%.

In another embodiment of the disclosure, the gold metallic glass matrix composite subjected to a bending test demonstrates a displacement to facture (i.e. $\Delta/_f$) that is larger than the displacement to facture of the monolithic metallic glass phase alloy subjected to a bending test.

In another embodiment, the average interdendritic spacing in the gold metallic glass matrix composite is less than the plastic zone size of the metallic glass phase, and the composite subjected to a bending test demonstrates a displacement to fracture that is larger than the displacement to fracture of the monolithic metallic glass phase alloy subjected to a bending test.

In another embodiment, the average interdendritic spacing in the gold metallic glass matrix composite is less than the plastic zone size of the metallic glass phase, and the composite subjected to a bending test demonstrates a displacement to fracture that is larger than the displacement to fracture of the monolithic metallic glass phase alloy subjected to a bending test by at least a factor of 2.

In another embodiment, the average interdendritic spacing in the gold metallic glass matrix composite is less than the plastic zone size of the metallic glass phase, and the composite subjected to a bending test demonstrates a displacement to fracture that is larger than the displacement to fracture of the monolithic metallic glass phase alloy subjected to a bending test by at least a factor of 3.

In another embodiment, the average interdendritic spacing in the gold metallic glass matrix composite is less than the plastic zone size of the metallic glass phase, and the composite subjected to a bending test demonstrates a displacement to fracture that is larger than the displacement to fracture of the monolithic metallic glass phase alloy subjected to a bending test by at least a factor of 4.

In another embodiment, the average interdendritic spacing in the gold metallic glass matrix composite is less than the plastic zone size of the metallic glass phase, and the composite subjected to a bending test demonstrates a displacement to fracture that is larger than the displacement to fracture of the monolithic metallic glass phase alloy subjected to a bending test by at least a factor of 5.

In another embodiment, the gold metallic glass matrix composite demonstrates a Young's modulus that is lower than the Young's modulus of the monolithic primary-Au phase alloy.

In another embodiment, the gold metallic glass matrix composite demonstrates a Young's modulus that is lower than 150 GPa.

In another embodiment, the gold metallic glass matrix composite demonstrates a Young's modulus that is between 60 and 150 GPa.

In another embodiment, the gold metallic glass matrix composite demonstrates a Young's modulus that is between 65 and 120 GPa.

In yet another embodiment, the gold metallic glass matrix composite demonstrates a Young's modulus that is between 70 and 100 GPa.

In another embodiment, the gold metallic glass matrix composite demonstrates a yield strength that is higher than the yield strength of the monolithic primary-Au phase alloy.

In another embodiment, the gold metallic glass matrix composite demonstrates a yield strength that is higher than 200 MPa.

In another embodiment, the gold metallic glass matrix composite demonstrates a yield strength that is between 200 and 1000 MPa.

In another embodiment, the gold metallic glass matrix composite demonstrates a yield strength that is between 250 and 800 MPa.

In yet another embodiment, the gold metallic glass matrix composite demonstrates a yield strength that is between 300 and 600 MPa.

In another embodiment, the gold metallic glass matrix composite demonstrates an elongation at yield that is higher than the elongation at yield of the monolithic primary-Au phase alloy.

In another embodiment, the gold metallic glass matrix composite demonstrates an elongation at yield that is higher than 0.15%.

In another embodiment, the gold metallic glass matrix composite demonstrates an elongation at yield that is between 0.15 and 1.5%.

In another embodiment, the gold metallic glass matrix composite demonstrates an elongation at yield that is between 0.2 and 1%.

In yet another embodiment, the gold metallic glass matrix composite demonstrates an elongation at yield that is between 0.25 and 0.75%.

In another embodiment, the gold metallic glass matrix composite demonstrates an ultimate strength that is higher than the ultimate strength of the monolithic primary-Au phase alloy.

In another embodiment, the average interdendritic spacing in the gold metallic glass matrix composite is less than the plastic zone size of the metallic glass phase, and the composite demonstrates an ultimate strength that is higher than the ultimate strength of the monolithic primary-Au phase alloy.

In another embodiment, the average microstructural feature size in the gold metallic glass matrix composite is less than 20 micrometers, and the composite demonstrates an ultimate strength that is higher than the ultimate strength of the monolithic primary-Au phase alloy.

In another embodiment, the gold metallic glass matrix composite demonstrates an ultimate strength that is higher than 550 MPa.

In another embodiment, the gold metallic glass matrix composite demonstrates an ultimate strength that is between 550 and 1150 MPa.

In another embodiment, the gold metallic glass matrix composite demonstrates an ultimate strength that is between 600 and 1000 MPa.

In yet another embodiment, the gold metallic glass matrix composite demonstrates an ultimate strength that is between 650 and 900 MPa.

In another embodiment, the gold metallic glass matrix composite demonstrates an elongation at break that is higher than the elongation at break of the monolithic metallic glass phase alloy.

In another embodiment, the average interdendritic spacing in the gold metallic glass matrix composite is less than the plastic zone size of the metallic glass phase, and the composite demonstrates an elongation at break that is higher than the elongation at break of the monolithic metallic glass phase alloy.

In another embodiment, the average microstructural feature size in the gold metallic glass matrix composite is less than 20 micrometers, and the composite demonstrates an elongation at break that is higher than the elongation at break of the monolithic metallic glass phase alloy.

In another embodiment, the gold metallic glass matrix composite demonstrates an elongation at break that is higher than 1.5%.

In another embodiment, the gold metallic glass matrix composite demonstrates an elongation at break that is higher than 1.75%.

In another embodiment, the gold metallic glass matrix composite demonstrates an elongation at break that is higher than 2.0%.

In yet another embodiment, the gold metallic glass matrix composite demonstrates an elongation at break that is higher than 2.25%.

In another embodiment, the gold metallic glass matrix composite demonstrates a tensile ductility that is higher than the tensile ductility of the monolithic metallic glass phase alloy.

In another embodiment, the average interdendritic spacing in the gold metallic glass matrix composite is less than the plastic zone size of the metallic glass phase, and the composite demonstrates a tensile ductility that is higher than the tensile ductility of the monolithic metallic glass phase alloy.

In another embodiment, the average microstructural feature size in the gold metallic glass matrix composite is less than 20 micrometers, and the composite demonstrates a tensile ductility that is higher than the tensile ductility of the monolithic metallic glass phase alloy.

In another embodiment, the gold metallic glass matrix composite demonstrates a tensile ductility that is higher than 0%.

In another embodiment, the gold metallic glass matrix composite demonstrates a tensile ductility that is higher than 0.5%.

In another embodiment, the gold metallic glass matrix composite demonstrates a tensile ductility that is higher than 1.0%.

In yet another embodiment, the gold metallic glass matrix composite demonstrates a tensile ductility that is higher than 1.5%.

In another embodiment, the gold metallic glass matrix composite demonstrates a strain hardening exponent that is higher than the strain hardening exponent of the monolithic primary-Au phase alloy.

In another embodiment, the average interdendritic spacing in the gold metallic glass matrix composite is less than the plastic zone size of the metallic glass phase, and the composite demonstrates a strain hardening exponent that is higher than the strain hardening exponent of the monolithic primary-Au phase alloy.

In another embodiment, the average microstructural feature size in the gold metallic glass matrix composite is less than 20 micrometers, and the composite demonstrates a strain hardening exponent that is higher than the strain hardening exponent of the monolithic primary-Au phase alloy.

In another embodiment, the gold metallic glass matrix composite demonstrates a strain hardening exponent that is higher than 0.15.

In another embodiment, the gold metallic glass matrix composite demonstrates a strain hardening exponent that is between 0.15 and 0.8.

In another embodiment, the gold metallic glass matrix composite demonstrates a strain hardening exponent that is between 0.25 and 0.75.

In yet another embodiment, the gold metallic glass matrix composite demonstrates a strain hardening exponent that is between 0.3 and 0.6.

In another embodiment, the electrical resistivity of the gold metallic glass matrix composites is between 5 and 100 μΩ-cm.

In another embodiment, the electrical resistivity of the gold metallic glass matrix composites is between 10 and 50 μΩ-cm.

In yet another embodiment, the electrical resistivity of the gold metallic glass matrix composites is between 15 and 40 μΩ-cm.

In other embodiments, the disclosure is also directed to articles made of a gold metallic glass matrix composite, and methods of preparing the same.

In one embodiments, the disclosure is directed to method of forming a gold metallic glass matrix composite article including:

heating an alloy ingot to a temperature above the liquidus temperature of the alloy to create a molten alloy;

shaping the molten alloy into a desired shape; and simultaneously or subsequently quenching the molten alloy fast enough to avoid crystallization of the metallic glass matrix phase.

In other embodiments, the disclosure is directed to a method of forming a gold metallic glass matrix composite article including:

heating an alloy ingot to a semi-solid temperature that is above the solidus temperature but below the liquidus temperature of the alloy to create a semi-solid alloy;

holding the semi-solid alloy at the semi-solid temperature for at least 10 seconds;

shaping the semi-solid alloy into a desired shape; and simultaneously or subsequently quenching the molten alloy fast enough to avoid crystallization of the metallic glass matrix phase.

In yet other embodiments, the disclosure is directed to a method of forming a gold metallic glass matrix composite article including:

heating a sample of a gold metallic glass matrix composite to a softening temperature $T_O$ above the glass transition temperature $T_g$ conducive for thermoplastic forming;

shaping the softened sample into a desired shape; and simultaneously or subsequently quenching the molten alloy fast enough to avoid crystallization of the metallic glass matrix phase.

DETAILED DESCRIPTION

The present disclosure may be understood by reference to the following detailed description, taken in conjunction with the drawings as described below. It is noted that, for purposes of illustrative clarity, certain elements in various drawings may not be drawn to scale.

Definitions

In the present disclosure, a Au-based alloy, metallic glass, or metallic glass matrix composite refers to an alloy or metallic glass matrix composite comprising Au at atomic concentrations of at least 50%. Au-based jewelry alloys typically contain Au at weight fractions of less than 100%. Hallmarks are used by the jewelry industry to indicate the Au metal content. Au weight fractions of about 75.0% (18 Karat), 58.3% (14 Karat), 50.0% (12 Karat), and 41.7% (10 Karat) are commonly used hallmarks in gold jewelry. In certain embodiments, the disclosure is directed to Au-based alloys or metallic glass matrix composite that satisfy the 18 Karat hallmark. Hence, in such embodiments the overall Au weight fraction in the composite is at least 75.0 percent.

In the present disclosure, Au-based metallic glass matrix composite (also referred to as "gold metallic glass matrix composite" or "composite") refers to a composite material consisting essentially of a primary-Au crystalline phase (also referred to as "primary-Au particulate phase" or "primary-Au phase") and a metallic glass phase (also referred to as "metallic glass matrix phase" or "metallic glass phase"). In some embodiments, Au-based metallic glass matrix composite refers to a two-phase material consisting of a primary-Au crystalline phase and a metallic glass phase. In other embodiments, Au-based metallic glass matrix composite refers to a composite material that comprises a primary-Au crystalline phase and a metallic glass phase and is free of any other phases. In some embodiments, the atomic concentration of Au in the Au-based metallic glass matrix composite is higher than the atomic concentration of Au at the eutectic composition. In some embodiments, the atomic concentration of Si in the Au-based metallic glass matrix composite is lower than the atomic concentration of Si at the eutectic composition. In some embodiments, the Au-based metallic glass matrix composite is free of a eutectic structure. In some embodiments, the Au-based metallic glass matrix composite is free of an intermetallic phase. In some embodiments, the Au-based metallic glass matrix composite is free of a pure-Si phase. In some embodiments, the Au-based metallic glass matrix composite is free of any phase in which the atomic concentration of Si is higher than the atomic concentration of Si in the metallic glass phase. In some embodiments, the Au-based metallic glass matrix composite is free of any phase in which the atomic concentration of Au is lower than the atomic concentration of Au in the metallic glass phase.

In the present disclosure, a primary-Au crystalline phase refers to a Au-based crystalline solid-solution that has the face-centered cubic structure of pure metallic Au. In some embodiments, the primary-Au crystalline phase comprises a single crystal. In some embodiments, the primary-Au crystalline phase is in the form of isolated particulates. In some embodiments, the primary-Au crystalline phase has a dendritic morphology. In some embodiments, the primary-Au crystalline phase is a hypoeutectic phase. In some embodiments, the atomic concentration of Au in the primary-Au crystalline phase is higher than the nominal atomic concentration of Au in the composite. In some embodiments, the atomic concentration of Si in the primary-Au crystalline phase is lower than the nominal atomic concentration of Si in the composite. In some embodiments, the primary-Au crystalline phase is free of Si.

In the present disclosure, a metallic glass phase refers to a phase that has an amorphous structure. In some embodiments, the metallic glass phase is a continuous matrix. In some embodiments, the atomic concentration of Au in the metallic glass phase is lower than the nominal atomic concentration of Au in the composite. In some embodiments, the atomic concentration of Si in the metallic glass phase is higher than the nominal atomic concentration of Si in the composite. In some embodiments, the concentration of each element in the metallic glass phase is within 3% of the respective concentration at the eutectic composition, and in some embodiments within 2% of the respective concentration at the eutectic composition, while in other embodiments within 1% of the respective concentration at the eutectic composition. In some embodiments, the metallic glass phase is supersaturated in Si (i.e. the fraction of Si in the metallic glass phase is higher than the fraction of Si in the equilibrium liquid phase at the eutectic composition).

In the present disclosure, an intermetallic phase refers to a crystalline compound phase that has a crystal structure that is not the face-centered cubic structure of pure Au. In some embodiments, an intermetallic phase is a silicide phase. In some embodiments, an intermetallic phase is a hypereutectic phase. In some embodiments, the atomic concentration of Au in the intermetallic phase is lower than the atomic concentration of Au in the metallic glass phase. In some embodiments, the atomic concentration of Au in the intermetallic phase is lower than the atomic concentration of Au at the eutectic composition. In some embodiments, the atomic concentration of Si in the intermetallic phase is higher than the atomic concentration of Si in the metallic glass phase. In some embodiments, the atomic concentration of Si in the intermetallic phase is higher than the atomic concentration of Si at the eutectic composition.

In the present disclosure, a pure-Si phase refers to a crystalline phase that comprises at least 95 atomic percent Si. In other embodiments, a pure-Si phase refers to a crystalline phase that comprises at least 97 atomic percent Si. In yet other embodiments, a pure-Si phase refers to a crystalline phase that comprises at least 99 atomic percent Si. In yet other embodiments, a pure-Si phase refers to a crystalline phase that has the diamond cubic structure of Si.

In the present disclosure, a hypoeutectic phase refers to a phase that has an atomic concentration of Au that is higher than the atomic concentration of Au at the eutectic composition, and an atomic concentration of Si that is lower than the atomic concentration of Si at the eutectic composition.

In the present disclosure, a hypereutectic phase refers to a phase that has an atomic concentration of Au that is lower than the atomic concentration of Au at the eutectic composition, and an atomic concentration of Si that is higher than the atomic concentration of Si at the eutectic composition.

In the present disclosure, a eutectic structure refers to a microstructure comprising at least two crystalline phases whose average composition is the eutectic composition. In some embodiments, the at least two crystalline phases in a eutectic structure grow simultaneously during solidification. In some embodiments, the at least two crystalline phases in a eutectic structure have a regular pattern. In some embodiments, the at least two crystalline phases in a eutectic structure have a spatially alternating pattern.

In the present disclosure, the Au-based metallic glass matrix composite being "free" of a particular phase (or phases) means that the molar fraction of the particular phase (or the combined molar fraction of the particular phases) is less than 5%, while in some embodiments less than 3%, while in other embodiments less than 2%, while yet in other embodiments less than 1%.

In the present disclosure, a certain phase being "free" of a particular element (or elements) means that the atomic concentration of the particular element (or the combined atomic concentrations of the particular elements) in said phase is less than 1%, while in some embodiments less than 0.5%, while in other embodiments less than 0.1%, while yet in other embodiments less than 0.05%.

In the present disclosure, the Au-based metallic glass matrix composite consisting essentially of a primary-Au crystalline phase and a metallic glass phase means that the composite does not contain any third phase (or phases) having a molar fraction (or a combined molar fraction of third phases) exceeding 5%, while in some embodiments exceeding 3%, while in other embodiments exceeding 2%, while yet in other embodiments exceeding 1%.

In the present disclosure, an "equilibrium" gold metallic glass matrix composite refers to a metallic glass matrix composite in which the respective compositions and molar fractions of the primary-Au crystalline phase and metallic glass phase are consistent with the equilibrium phase diagram (stable or metastable) at the temperature where the composite is formed. In some embodiments, the "lever rule" can be applied at the temperature where the composite is formed to determine the mole fractions of the primary-Au crystalline phase and metallic glass phase. In some embodiments, the composite is formed at a temperature between the glass-transition temperature of the metallic glass phase and 100° C. above the glass-transition temperature of the metallic glass phase. In other embodiments, the composite is formed at a temperature between the glass-transition temperature of the metallic glass phase and 50° C. above the glass-transition temperature of the metallic glass phase.

In the present disclosure, a semi-solid refers to a two-phase material that comprises a liquid phase and a crystalline phase. In some embodiments, the liquid phase and the crystalline phase in the semi-solid are in equilibrium. In other embodiments, the liquid phase and the crystalline phase in the semi-solid are in metastable equilibrium. In some embodiments, the crystalline phase is a primary-Au crystalline phase. In some embodiments, the liquid phase is capable of forming a metallic glass.

In the present disclosure, monolithic metallic glass sample refers to a sample (e.g. rod, plate, etc.) that comprises the metallic glass phase that is continuously and homogeneously distributed throughout its volume.

In the present disclosure, the "critical cooling rate" of a metallic glass phase is a property of the metallic glass phase and is defined as the minimum cooling rate required to quench a liquid of the same composition to form the metallic glass phase.

In the present disclosure, the "critical cooling rate" of a metallic glass matrix composite is a property of the metallic glass matrix composite and is defined as the minimum cooling rate required to form the metallic glass matrix composite.

In the present disclosure, the "critical rod diameter" of a metallic glass phase is a property of the metallic glass phase and is defined as the largest diameter of a monolithic metallic glass rod that can be formed when processed by a method of water quenching a quartz tube having 0.5 mm thick walls containing the molten alloy.

In the present disclosure, the "critical rod diameter" of a metallic glass matrix composite is a property of the metallic glass matrix composite and is defined as the largest rod diameter in which the metallic glass matrix composite can be formed when processed by a method of water quenching a quartz tube having 0.5 mm thick walls containing a molten alloy.

In the present disclosure, a material having "yellow color" refers to material whose visual appearance can be characterized by a CIELAB coordinate b* of at least 14, or in some embodiments at least 16, or in other embodiments at least 18, or in other embodiments at least 20, or in other embodiments at least 22, or in yet other embodiments at least 24.

In the present disclosure, alloy compositions being "substantially similar" means that the compositions comprise the same elements, and the concentration of each element is within 5 atomic percent between the alloys, while in other embodiments within 2.5 atomic percent, while in yet other embodiments within 1 atomic percent.

Formation of Gold Metallic Glass Matrix Composites

The disclosure provides Au-based alloys capable of forming metallic glass-matrix composites, and metallic glass matrix composites formed thereof.

In various embodiments, the disclosure is directed to a Au-based alloy comprising Si capable of forming a Au-based metallic glass matrix composite;

where the atomic fraction of Si is in the range of 1 to 16; and where the Au-based metallic glass matrix composite consists essentially of a primary-Au crystalline phase and a metallic glass phase.

U.S. Pat. No. 6,709,536 disclosed a metallic glass matrix composite that is an "equilibrium" composite. Generally, "equilibrium" metallic glass matrix composite means a metallic glass matrix composite in which the respective compositions and molar fractions of the primary phase and metallic glass phase are consistent with the equilibrium (stable or metastable) phase diagram at the temperature where the composite is formed. In some embodiments, the respective compositions and molar fractions of the primary phase and metallic glass phase obey the "lever rule" applied at the temperature where the composite is formed. In some embodiments, the composite is formed at the glass-transition temperature of the metallic glass phase. According to U.S. Pat. No. 6,709,536, an "equilibrium" metallic glass matrix composite is achieved in a eutectic alloy system when a single primary crystalline phase coexists with a liquid phased and formation of any third phase is avoided. That is, when the primary crystalline phase nucleates from the liquid as the liquid is undercooled, the primary phase does not induce nucleation of any other crystalline phases such that the liquid phase vitrifies on cooling to form the metallic glass phase. U.S. Pat. No. 6,709,536 identified a single eutectic system to which this principle can be applied to: the (Zr,Ti)—Be eutectic system, in which alloying additions of Nb, Cu and Ni can be incorporated.

A metallic glass matrix composite may be produced by undercooling a hypoeutectic liquid below the liquidus temperature to produce a semi-solid that comprises a eutectic liquid in equilibrium (stable or metastable) with the primary crystalline phase while avoiding the formation of the other crystalline phases that make up the fully-crystalline structure. The primary phase is formed during cooling of the melt, but the remaining liquid should not crystallize during further cooling and solidification. In some embodiments, the primary phase evolves in the form of inclusions within a continuous liquid matrix. In one embodiment, primary phase inclusions are dendritic in shape. Generally, evolving primary phase inclusions while avoiding crystallization of the remaining liquid is difficult to achieve, since such crystalline inclusions in a semi-solid mixture tend to catalyze nucleation and growth of other crystalline phases (e.g. intermetallic phases) thereby leading to crystallization of the remaining liquid (i.e. complete crystallization of the quenched alloy) and the absence of a glassy matrix phase in the final product. Crystallization of the remaining liquid phase is observed in most glass forming alloy systems. Typically, the crystallization of any single crystalline phase tends to induce crystallization of other crystalline phases. This leads to complete crystallization to a complete crystalline structure comprising multiple crystalline phases and substantially no metallic glass phase (or a small mole fraction of a metallic glass phase). Sequential crystallization of multiple phases is a general phenomenon in metal alloy systems. Successful processing of metallic glass matrix composites comprising only one crystalline phase and a metallic glass phase is the exception to the general rule and is limited to only a few known cases. Aside from the (Zr,Ti)—Be eutectic system disclosed in U.S. Pat. No. 6,709,536, another alloy system discovered to form "equilibrium" metallic glass matrix composites is the La—(Cu, Ni) eutectic system comprising Al (Lee, M. L. et al. "Effect of a controlled volume fraction of dendritic phases on the tensile and compressive ductility in La-based metallic glass matrix composites," Acta Mater. 52, 4121-4131 (2004), the disclosure of which is incorporated herein by reference in its entirety). The ability of an alloy system to form metallic glass matrix composites is both unusual and largely unpredictable.

In the context of the present disclosure it was discovered that the Au—Si eutectic system is capable of forming metallic glass matrix composites comprising a primary Au-based particulate phase and a metallic glass phase and being free of any other phase. In some embodiments the primary Au crystalline phase particulates are embedded in a continuous metallic glass matrix. The primary Au crystalline phase has the face-centered cubic structure of pure Au, and in some embodiments may comprise varying amounts of other elements, including for example Ag, Cu, Pd, and Zn, in solid solution. The metallic glass phase comprises Si at a concentration that is sufficient to for glass formation, and may also comprise varying amounts of other elements, including for example Ag, Cu, and Pd.

In some embodiments, the solid solubility of Si in the primary-Au phase is lower than the Si concentration in the metallic glass phase. In such embodiments, Si is rejected from the primary-Au phase as it forms and grows during cooling of a partially molten semi-solid mixture. More specifically, in such embodiments Si partitions to the liquid matrix during the growth of the primary-Au phase. Owing to this partitioning, the primary Au phase may contain lower concentrations of Si than the metallic glass phase. In some embodiments, the primary-Au phase is free of Si.

In some embodiments, the solid solubility of Pd in the primary-Au phase is lower than the Pd concentration in the metallic glass phase. In such embodiments, Pd is rejected from the primary-Au phase as it forms and grows during cooling of a partially molten semi-solid mixture. More specifically, in such embodiments Pd partitions to the liquid matrix during the growth of the primary-Au phase. Owing to this partitioning, the primary Au phase may contain lower concentrations of Pd than the metallic glass phase. In some embodiments, the primary-Au phase is free of Pd.

In some embodiments, the solid solubility of Ag in the primary-Au phase is higher than the Ag concentration in the metallic glass phase. In such embodiments, Ag is enriched in the primary-Au phase as it forms and grows during cooling of a partially molten semi-solid mixture. More specifically, in such embodiments Ag partitions to the primary-Au phase during the growth of the primary-Au phase. Owing to this partitioning, the primary Au phase may contain higher concentrations of Ag than the metallic glass phase.

In one embodiment, a metallic glass matrix composite in accordance with the current disclosure is designed by (1) choosing and overall composition (primarily Si content) to control the molar fraction and properties (e.g. optical properties, electrical properties, mechanical properties, etc.) of the primary Au crystalline phase in the overall composite, and (2) adjusting the solidification conditions (cooling history) to control the characteristic features of the primary-Au phase particulates (e.g. in the case where the primary-Au crystalline phase particulates are in the form of dendrites, the dendrite trunk diameter, dendrite arm diameter, interdendritic spacing may be controlled) within the continuous metallic glass matrix phase. To implement such embodiments knowledge of certain features of the relevant alloy phase diagrams, partitioning coefficients for various solutes between the liquid and dendritic phase, and control of temperature and process parameters during cooling and solidification may be helpful.

To produce a metallic glass matrix composite, the metallic glass phase should have a large critical rod diameter. In practice, the larger the critical rod diameter of the metallic glass phase, the larger the critical rod diameter of the metallic glass matrix composite will be.

Microstructure of Gold Metallic Glass Matrix Composites

The microstructure of metallic glass matrix composites is to a large extent dependent on the route used to process the composite, and more specifically on the cooling history of the composite. For a given alloy composition of a gold metallic glass matrix composite, the molar fraction of the primary-Au crystalline phase (and hence the molar fraction of the metallic glass phase, provided that the composite is substantially free of any third phase) is unique. This unique molar fraction is dictated by the "lever rule", and as discussed above and below, the molar fraction is primarily controlled by the Au/Si relative fractions in the overall alloy. While this molar fraction is roughly fixed by the overall alloy composition and is to a large extent independent of the processing, the average size of the features that make up the composite microstructure (i.e. dendrite trunk diameter, dendrite arm diameter, dendrite arm spacing, interdendritic spacing, etc.) is not unique to the composition and is strongly dependent on the processing.

In principle, the sizes of the various microstructural features are inversely related to the cooling rate used to process the composite by cooling from the high-temperature equilibrium melt state (i.e. cool the alloy from above the liquidus temperature). Specifically, the higher the cooling rate during processing, the finer the microstructural features tend to be in the final composite. Conversely, the lower the cooling rate during processing, the coarser the microstructural features tend to be in the final composite. This is because the nucleation of the primary phase is dominant at deep undercoolings (i.e. at temperatures far below the liquidus temperature) while the growth of the primary is dominant at shallow undercoolings (i.e. at temperatures slightly below the liquidus temperature). Thus at high cooling rates where deep undercoolings are attained one has a large density of crystalline nuclei that fail to grow substantially, while at low cooling rates where shallow undercoolings are attained one has a small density of crystalline nuclei that grow substantially; in both cases the molar fraction of the primary-Au crystalline phase is substantially the same (provided that the overall alloy composition is unchanged).

Therefore, one can control the sizes of the various microstructural features of a gold metallic glass matrix composite solely by controlling its cooling history during processing. If one desires a microstructure having the features as small as possible, then a cooling rate as high as possible may be used. Conversely, if one desires a microstructure having features as large as possible, then a cooling rate as low as possible may be used.

There may be a limit on how large the microstructural features of a composite one can achieve by direct cooling of the equilibrium melt. This is because there is a lower limit on the cooling rate required to produce the metallic glass phase. This limiting cooling rate and limiting thickness are properties of the metallic glass phase and are respectively referred to as the "critical cooling rate" and "critical casting thickness" (or "critical rod diameter" in the case of a rod geometry) of the metallic glass phase. Hence, if a cooling rate that is lower than the "critical cooling rate" is applied, large microstructural features may be achieved but the metallic glass phase may fail to form in the region separating the primary phase particulates. This is because the liquid being in equilibrium with the primary phase above the eutectic temperature may crystallize when subsequently cooled below the eutectic temperature, thereby forming a eutectic structure instead of the metallic glass phase. Such material containing a crystalline phase other than the primary-Au crystalline phase would therefore not be a metallic glass matrix composite as defined herein.

To overcome the limitation where an upper bound on the microstructural feature sizes is imposed by the critical cooling rate of the metallic glass phase, one may process the composite by performing at least one intermediate isothermal step in the "semi-solid region". The "semi-solid region"

is the temperature range between the eutectic temperature and the liquidus temperature where the primary-Au crystalline phase co-exists in two-phase equilibrium with the liquid phase, where the liquid phase is capable of forming the metallic glass phase on cooling to form the metallic glass matrix composite. Within the "semi-solid" region of an alloy capable of forming a gold metallic glass matrix composite, no phase other than the Au-primary phase and the glass-forming liquid phase may co-exist in equilibrium. This means that one may hold the "semi-solid" isothermally at a temperature within the "semi-solid region" for long time scales without promoting formation of a third phase (e.g. a crystalline phase other than the primary-Au crystalline phase, such as an intermetallic phase or pure-Si phase). As such, cooling the annealed "semi-solid" from an intermediate temperature in the "semi-solid region" to a temperature below the glass-transition temperature of the metallic glass phase at a sufficiently high cooling rate may result in a metallic glass matrix composite. Long isothermal annealing of a "semi-solid" may allow for solute diffusion in the liquid phase to take place such that the primary-Au crystalline phase can coarsen and grow in size, thereby producing microstructural features with relatively large sizes. Subsequent cooling of a "semi-solid" annealed for sufficiently long time at a sufficiently high cooling rate may result in a metallic glass matrix composite having microstructural features that are larger than the features obtained by direct cooling of the equilibrium melt to a temperature below the glass-transition temperature of the metallic glass phase.

In various embodiments, instead of directly cooling the equilibrium melt from above the liquidus temperature to below the glass-transition temperature of the metallic glass phase to form the metallic glass matrix composite, the equilibrium melt may be cooled from above the liquidus temperature to a temperature in the "semi-solid" region (i.e. above the eutectic temperature) to form a "semi-solid", held isothermally at that temperature for a specified time, and subsequently cooled sufficiently rapidly to a temperature below the glass-transition temperature of the metallic glass phase to form the metallic glass matrix composite. In some embodiments, the melt may be cooled and isothermally held sequentially at more than one temperature in the semi-solid region prior to being quenched to below the glass-transition temperature of the metallic glass phase to form the metallic glass matrix composite. In some embodiments, the annealing temperature in the "semi-solid" region is at least 600° C. In other embodiments, the annealing temperature in the "semi-solid" region is at least 650° C. In other embodiments, the annealing temperature in the "semi-solid" region is at least 700° C. In some embodiments, the annealing time in the "semi-solid" region is at least 60 s. In some embodiments, the annealing time in the "semi-solid" region is at least 300 s. In some embodiments, the annealing time in the "semi-solid" region is at least 900 s. In some embodiments, the annealing time in the "semi-solid" region is at least 1800 s.

In various embodiments, the cooling rate may be controlled by adjusting the size of the lateral dimension of the sample to be processed. This is because the lateral dimension is the limiting dimension controlling heat conduction from the boundaries of the sample to its centerline. For example, if a sample has a rod shape, the lateral dimension is the rod diameter. If the sample has a plate shape, the lateral dimension is the thickness of the plate. In general, the cooling rate R (in K/s) can be approximately related to the thickness of the lateral dimension d (in mm) as $R=C/d^2$, where C is a factor that is directly proportional to the thermal conductivity of the sample being quenched, while also depending on other properties and variables (e.g. density, heat capacity, and temperature drop during quenching). Therefore, if one decreases the thickness of the lateral dimension by a factor of 2, the cooling rate through the centerline of the sample would increase by a factor of 4, which contribute to a composite having smaller microstructural features. On the other hand, if one increases the thickness of the lateral dimension by a factor of 2, the cooling rate through the centerline of the ample would decrease by a factor of 4, which contribute to a composite having larger microstructural features.

The primary-Au crystalline phase in the metallic glass matrix composite generally has relatively high thermal conductivity, substantially greater than that of the metallic glass phase. The thermal conductivity of monolithic metallic glasses is generally in the range of 2-5 W/m-K at ambient temperature and increases to 10-20 W/m-K in the liquid state above the glass transition. Primary-Au solid solutions and specifically Au-rich solid solutions bearing Cu or Ag are reported to have thermal conductivity that increases from 50-70 W/m-K at ambient temperature up to 100-130 W/m-K near the melting point of the alloys (C. Y. Ho, W. M. Ackerman, K. Y. Wu, S. G. Oh, T. N. Havill. Thermal Conductivity of Ten Selected Binary Alloy System, CINDAS-TPRC Report 30, May 1975, the disclosure of which is incorporated herein by reference in its entirety). Essentially, the thermal conductivity of the primary-Au crystalline phase is roughly an order of magnitude greater than that of the metallic glass phase. Furthermore, the morphology of the primary gold phase, which is generally in the form of high aspect ratio dendrites, contribute to an even higher thermal conductivity as the elongated tree-like structures act as natural short-circuit low resistance pathways for thermal conduction in the metallic glass matrix composite. Therefore, owing to the thermal conductivity of the primary-Au crystalline phase being about an order of magnitude greater than the thermal conductivity of the metallic glass phase, and to an enhanced thermal conduction offered by the dendritic morphology of the metallic glass matrix composite, the overall thermal conductivity of a Au-based metallic glass matrix composite may be expected to be considerably higher than the thermal conductivity of a monolithic Au-based metallic glass having a composition substantially similar to the metallic glass phase of the Au-based metallic glass matrix composite.

The substantial enhancement of thermal conductivity in the gold metallic glass matrix composites is of particular importance to their processability. As explained above, the factor C in EQ. (2) relating the cooling rate R to the inverse of the square of the casting thickness d is directly proportional to the thermal conductivity of the sample. Since the thermal conductivity of a Au-based metallic glass matrix composite may be considerably higher than the thermal conductivity of a monolithic Au-based metallic glass having a composition substantially similar to the metallic glass phase of the Au-based metallic glass matrix composite, the factor C in EQ. (2) may be substantially greater for the metallic glass matrix composite than the monolithic metallic glass. As such, the cooling rate R along the centerline of a sample of such metallic glass matrix composite having a lateral dimension thickness d may be substantially higher than the cooling rate R along the centerline of a sample of such monolithic metallic glass of having substantially the same lateral dimension d. The implication of this is that the "critical casting thickness" of a Au-based metallic glass matrix composite may be substantially larger than the "critical casting thickness" of a monolithic Au-based metallic glass having a composition substantially similar to the metallic glass phase of the Au-based metallic glass matrix composite.

Therefore, in some embodiments of the disclosure, the "critical casting thickness" of a Au-based metallic glass matrix composite may be at least as large as the "critical casting thickness" of a monolithic Au-based metallic glass having a composition substantially similar to the metallic glass phase of the Au-based metallic glass matrix composite. In other embodiments of the disclosure, the "critical casting thickness" of a Au-based metallic glass matrix composite may be within 50% of the "critical casting thickness" of a monolithic Au-based metallic glass having a composition substantially similar to the metallic glass phase of the Au-based metallic glass matrix composite. In other embodiments of the disclosure, the "critical casting thickness" of a Au-based metallic glass matrix composite may be within 25% of the "critical casting thickness" of a monolithic Au-based metallic glass having a composition substantially similar to the metallic glass phase of the Au-based metallic glass matrix composite. In other embodiments of the disclosure, the "critical casting thickness" of a Au-based metallic glass matrix composite may be within 10% of the "critical casting thickness" of a monolithic Au-based metallic glass having a composition substantially similar to the metallic glass phase of the Au-based metallic glass matrix composite. In other embodiments of the disclosure, the "critical casting thickness" of a Au-based metallic glass matrix composite may be at least 10% larger than the "critical casting thickness" of a monolithic Au-based metallic glass having a composition substantially similar to the metallic glass phase of the Au-based metallic glass matrix composite. In other embodiments of the disclosure, the "critical casting thickness" of a Au-based metallic glass matrix composite may be at least 25% larger than the "critical casting thickness" of a monolithic Au-based metallic glass having a composition substantially similar to the metallic glass phase of the Au-based metallic glass matrix composite. In yet other embodiments of the disclosure, the "critical casting thickness" of a Au-based metallic glass matrix composite may be at least 50% larger than the "critical casting thickness" of a monolithic Au-based metallic glass having a composition substantially similar to the metallic glass phase of the Au-based metallic glass matrix composite.

In another embodiment, the critical rod diameter of the Au-based metallic glass matrix composite is at least 1 mm. In another embodiment, the critical rod diameter of the Au-based metallic glass matrix composite is at least 2 mm. In another embodiment, the critical rod diameter of the Au-based metallic glass matrix composite is at least 3 mm. In another embodiment, the critical rod diameter of the Au-based metallic glass matrix composite is at least 4 mm. In another embodiment, the critical rod diameter of the Au-based metallic glass matrix composite is at least 5 mm.

In another embodiment, the critical rod diameter of the metallic glass phase composite is at least 1 mm. In another embodiment, the critical rod diameter of the metallic glass phase is at least 2 mm. In another embodiment, the critical rod diameter of the metallic glass phase is at least 3 mm. In another embodiment, the critical rod diameter of the metallic glass phase is at least 4 mm. In another embodiment, the critical rod diameter of the metallic glass phase is at least 5 mm.

The disclosure is also directed to various methods of forming a gold metallic glass matrix composite. In one embodiment, the disclosure is directed to a method of forming a gold metallic glass matrix composite comprising:

heating an alloy capable of forming a Au-based metallic glass matrix composite to a temperature above the liquidus temperature of the alloy to form a molten alloy; and cooling the molten alloy at a sufficiently high cooling rate to form a Au-based metallic glass matrix composite.

In another embodiment, the alloy is heated to a temperature that is at least 100° C. above the liquidus temperature of the alloy. In another embodiment, the alloy is heated to a temperature that is at least 200° C. above the liquidus temperature of the alloy. In another embodiment, the alloy is heated to a temperature of at least 800° C. In another embodiment, the alloy is heated to a temperature of at least 900° C. In another embodiment, the molten alloy is cooled at a cooling rate that is at least as high as the critical cooling rate of the metallic glass matrix composite. In another embodiment, the molten alloy is cooled at a cooling rate that is at least as high as the critical cooling rate of the metallic glass phase.

In another embodiment, the disclosure is directed to a method of forming a gold metallic glass matrix composite comprising:

heating an alloy capable of forming a Au-based metallic glass matrix composite to a temperature above the liquidus temperature of the alloy to form a molten alloy;

cooling the molten alloy to at least one annealing temperature in the semi-solid region to form a semi-solid; and cooling the semi-solid at a sufficiently high cooling rate to form a Au-based metallic glass matrix composite.

In another embodiment, the semi-solid is cooled at a cooling rate that is at least as high as the critical cooling rate of the metallic glass matrix composite. In another embodiment, the semi-solid is cooled at a cooling rate that is at least as high as the critical cooling rate of the metallic glass phase. In another embodiment, the at least one annealing temperature is at least 600° C. In another embodiment, the at least one annealing temperature is at least 650° C. In another embodiment, the at least one annealing temperature is at least 700° C. In another embodiment, the semi-solid is held at the at least one annealing temperature for a duration of at least 60 s. In another embodiment, the semi-solid is held at the at least one annealing temperature for a duration of at least 300 s. In another embodiment, the semi-solid is held at the at least one annealing temperature for a duration of at least 900 s. In another embodiment, the semi-solid is held at the at least one annealing temperature for a duration of at least 1800 s.

Color of Gold Metallic Glass Matrix Composites

Gold and its alloys are widely used in luxury products such as jewelry, watches, casings, and ornamental articles. Pure gold metal is relatively soft, ductile, and is easily scratched and worn away. As such, gold is most widely used in an alloyed form. Gold alloys have been developed over centuries to exhibit combinations of optical properties (color and appearance), strength, hardness, toughness, corrosion resistance, wear resistance to meet the requirements and needs of these applications. Commonly used gold alloys are classified by hallmarking criteria that characterizes the weight fraction of gold contained. Typical hallmarks, e.g. 18 Karat, 14 Karat, etc. are used to indicate the weight fraction of gold contained where 24 Karat gold refers to the pure metal. For luxury products, meeting a specified hallmark is a basic requirement.

Commercial gold alloys are further distinguished by their optical properties, more specifically their color. Gold alloys are classified broadly as "yellow gold", "white gold", "rose gold", "green gold", etc. The alloy color is determined by the composition of alloying elements combined with pure Au to form the alloy. For instance, "rose gold" alloys are achieved by including specified amounts of Cu along with restricted amounts of other elements such as Ag, Pd, Zn etc. Adding certain atomic fractions of both Ag and Cu to pure Au gives ternary alloys with "yellow gold", "rose-gold", or "green-gold" color depending on the proportions of Cu, Ag, Pd, and Zn.

To characterize, specify, and quantify the color of gold alloys, the modern CIELAB coordinate system is used, originating from the 1948 3D color space of Hunter (Hunter, Richard Sewall (July 1948). "Photoelectric Color-Difference Meter". *JOSA* 38 (7): 661. (Proceedings of the Winter Meeting of the Optical Society of America), the disclosure of which is incorporated herein by reference in its entirety). In Hunter's color space, the color of a gold alloy is characterized by three optically measurable coordinates a*, b*, and L* that respectively map color onto a red-green, blue-yellow, and color intensity (i.e. luminance) scales. The color of any particular gold alloy is determined using a common optical spectrometer to measure its a*, b*, and L* coordinates in color space. The ability to produce alloys with specified ranges of color coordinates is key to the design and use of gold alloys in commercial products.

Metallic glasses are a relatively new class of engineering metal alloys which are known to broadly exhibit high strength, hardness, wear resistance, and corrosion resistance that often exceeds the corresponding properties achievable in conventional crystalline metals and alloys. Metallic glasses based on gold for potential use in luxury products have been explored over the last decade. The development of these gold-based metallic glasses is motivated by a desire to combine the inherent desirability of the precious gold metal with the unique mechanical properties, hardness, wear and corrosion resistance, and processability of a metallic glass.

Formation of "bulk" monolithic metallic glasses (i.e. monolithic metallic glasses exhibiting section thicknesses of ~1 mm or greater) is generally restricted to suitable low melting alloys (near eutectic compositions) that exhibit high resistance to crystallization. In the case of gold-based alloys, metallic glass formation has been limited to a relatively narrow range of alloy compositions containing between 15 and 20 atomic percent of the metalloid element Si combined with specified additions of other noble, or near noble metals such as Cu, Ag, Ni, Pd and Pt. To obtain useful gold-based metallic glasses, the total weight content of alloy additions is further constrained by the need to satisfy the hallmarking criteria (e.g. 18 Karat or 14 Karat). The combined requirements severely restrict the field of candidate alloys.

Au-based monolithic metallic glasses discovered to date demonstrate critical rod diameters that are limited to 5-6 mm. The alloys that demonstrate the highest glass forming ability generally comprise large fractions of Si (typically greater than 16 atomic percent), and they also generally exhibit an essentially white-gold appearance. For example, monolithic metallic glass $Au_{49}Ag_{5.5}Pd_{2.3}Cu_{26.9}Si_{16.3}$ having a critical rod diameter of 5 mm exhibits color coordinates a*=1.14, b*=12.8, and L*=80.5, which are close to 18 k palladium white gold (S. Mozgovoy, J. Heinrich, U. E. Klotz, R. Busch, "Investigation of Mechanical, Corrosion, and Optical Properties of an 18 Carat Au—Cu—Si—Ag—Pd Metallic Glass", Intermetallics 18, 2289 (2010), the disclosure of which is incorporated herein by reference in its entirety). The white color is likely the result of the "bleaching" effect of Si in gold alloys. This metallic glass is also observed to tarnish and change surface appearance following exposure to air at ambient temperature (M. Eisenbart, U. E. Klotz, R. Busch, I. Gallino, "On the Abnormal Room Temperature Tarnishing of an 18 Carat Gold Bulk Metallic Glass Alloy", Journal of Alloys and Compounds 615, 5118 (2014), the disclosure of which is incorporated herein by reference in its entirety).

The restriction to white-gold color and tendency to tarnish in air, and limited maximum casting thicknesses of these prior art Au-based monolithic metallic glasses are limiting the commercial potential of these materials. As such, there is a need to develop new gold-based alloys that exploit the superior properties of the metallic glass while simultaneously satisfying the traditional hallmarking and color of traditional gold alloys.

In the present disclosure, alloys capable of forming gold metallic glass matrix composites are disclosed where the alloys comprise at least Au and Si and optionally other elements such as Cu, Ag, Pd, and Zn, among others. The composites comprise a primary-Au crystalline phase having the face-centered cubic structure of pure gold. The primary-Au crystals are embedded in a metallic glass matrix, which in some embodiments may be continuous. The metallic glass phase contains a certain concentration of Si and optionally other elements (e.g. Cu, Ag, Pd) that may enable glass formation during cooling and processing. It is determined here (see Examples below) that the solubility of Si in the primary-Au crystalline phase is very low as well (much lower than 1 atomic percent), and its concentration in the metallic glass matrix phase to be very high (in the range of 16-20 atomic percent). Hence, Si appears to strongly partition to the liquid matrix during the growth of the primary-Au phase as the alloy solidifies. Owing to this strong partitioning, the crystalline dendrites of the primary-Au phase would be essentially free of Si and would display mechanical properties, optical properties, and color determined by the concentration of solute metals Cu, Ag, Pd, or Zn dissolved in the primary-Au dendritic phase. Hence, while the metallic glass matrix may be optically pale or white in color, the primary-Au dendrites may be designed to have high chromaticity by choice of the overall alloy composition and knowledge of the partitioning effect of the other solute metals (e.g. Cu, Ag, Pd, and Zn).

As determined from the compositional analysis of the primary-Au and metallic glass phases of the gold composites according to the disclosure (see Examples below), Ag and Zn are highly enriched and Au slightly enriched in the primary-Au phase, Cu is essentially equally present between the primary-Au and metallic glass, while Pd and Si are both practically absent in the primary-Au phase. The latter two elements are almost solely present in the metallic glass matrix phase. This is important for controlling the average color of the gold metallic glass matrix composite, since both Pd and Si are known to bleach the color from Au-based alloys. Essentially these elements reduce the magnitude of the CIELAB a* (red-green) and b* (blue-yellow) coordinates. Their higher content in the matrix is thought to have the same bleaching effect and is thought to be responsible for the pale color of the metallic glass matrix (as discussed above). Monolithic metallic glasses having composition very close to that of the metallic glass matrix phase of the composites according to the disclosure have a white/pale color, making them undesirable for applications in luxury goods. On the other hand, ternary face-centered-cubic (fcc) Au—Cu—Ag alloys are known to have CIELAB a* and b* coordinates that depend in a known and well characterized manner on their composition. In some embodiments of the disclosure, the primary-Au phase of the gold metallic glass matrix composites is a ternary Au—Cu—Ag fcc phase (see Examples below). The coordinates for the ternary Au—Cu—Ag alloy have been quantitatively mapped and determined [German, R. M., Guzowski, M. M. & Wright, D. C. "The color of Gold-Silver-Copper alloys; Quantitative Mapping on the Ternary Diagram" Gold Bulletin Vol. 13: p. 113, 1980, the disclosure of which is incorporated herein by reference in its entirety]. FIG. 1 shows a color-map of the ternary Au—Ag—Cu system that divides the alloy composition space into regions according to the optical appearance of the alloys.

From the color map of FIG. 1, the concentrations of Au, Ag, and Cu can be varied to design the color of the primary-Au phase, and by extension, the overall color of a gold metallic glass matrix composite (since metallic glass matrix phase will remain white/pale independent of the Au, Cu, and Ag concentrations due to the high concentration of Si and possibly Pd). Hence, one can also arrive at a systematic method for varying the CIELAB a* and b* coordinates of the composite overall color by controlling the composition of the primary-Au phase. For example, it is apparent from FIG. 1 that increasing the Ag concentration in the overall composite composition, which would result in a much higher increase of the Ag content in the primary-Au phase, should enhance the yellow appearance of the composite by significantly increasing the CIELAB b* coordinate of the Au—Cu—Ag primary-Au phase. Such increase of the Ag content in the overall alloy is not expected to significantly alter the white/pale color of the metallic glass phase of the composite, since Ag partitions very weakly to the metallic glass phase, and also because the Metallic glass phase will remain rich in Si regardless. This assumes that such increase in the overall Ag content would not significantly alter the relative molar fractions of the two phases in the composite, and would not significantly degrade the glass forming ability of the composite.

Using this approach, one may create gold metallic glass composites with desirable CIELAB coordinates that fall in the category of "yellow" chromaticity. Similarly, reducing the overall Ag-concentration in the composite composition will increase the CIELAB a* coordinate and reduce the b*—coordinate of the primary-Au phase, and by extension the composite. So doing will result in an increase in red chromaticity. This will result in a gold composite that will fall under the category of "rose gold" appearance.

Changing the concentration of certain color-influencing elements, such as Ag, is only one method for designing the gold composite to have desired CIELAB coordinates. One may also influence the overall color of the gold composite by varying the overall molar fractions of the respective phases. This may be achieved by making different compositional adjustments. By changing the overall concentrations of certain elements, and specifically that of Si, one may vary the relative molar fractions of the primary-Au and metallic glass phases. This may influence the overall color of the composite even if the respective colors of the two constituent phases remain unchanged. This is because, as will be discussed below in more detail, the average color of the overall composite roughly follows a molar-weighted average of the constituent phases colors.

The uniformity or non-uniformity of the appearance of the overall composite surface is controlled by the size scales characterizing the composite microstructure. In various embodiments of the disclosure, the average microstructural feature size of a gold metallic glass matrix composite includes, but is not limited to, the average dendrite trunk diameter, the average dendrite arm diameter, the average dendrite arm spacing, and the average interdendritic spacing. Size scales resolvable to the human eye are generally on the order of 30 micrometers or more. Hence, when the microstructural features of a composite have an average size on the order of 30 micrometers or less, such features may not be resolvable by the human eye, and consequently the overall appearance of the composite including the overall composite color may appear uniform to the human eye. On the other hand, if the average microstructural feature size is greater than about 30 micrometers the microstructure may develop a non-uniform or textured appearance to the naked eye.

Therefore, in some embodiments of the disclosure, the gold metallic glass matrix composite is considered to have a "visually unresolved microstructure" and a "uniform overall color" when microstructural features and color texture are not resolvable by a naked human eye. In some embodiments, these conditions are met when the average microstructural feature size is equal to less than 30 micrometers, while in other embodiments when the average microstructural feature size is equal to less than 20 micrometers, while in yet other embodiments, when the average microstructural feature size is equal to less than 10 micrometers.

In other embodiments where the microstructural length scales are smaller than ~1-2 wavelengths of visible light, that is, less than about 1-2 micrometers, the microstructure may be unresolvable even by optical microscopy. In such embodiments, optical interference effects, which may give the surface certain directional reflective properties that depend on the wavelength of light, may be developed. Such interference may result in a directionally dependent color appearance that depends on the details of the microstructure reflecting the light.

The simple rule of mixtures (linear interpolation) can be used to approximate the apparent uniform color of a two phase material, such as a gold metallic glass matrix composite, provided that the microstructural features are unresolvable by the human eye. In practice, microstructural features at an average size not exceeding about 30 micrometers may satisfy this condition. For such microstructures, the average CIELAB coordinates of the overall gold metallic glass matrix composite become approximately a volume-weighted average of those of the primary-Au and metallic glass phases.

Hence, in some embodiments, the overall color of a gold metallic glass matrix composite having an average microstructural feature size equal to or less than 30 micrometers may be uniform, and may be approximated by the volume-weighted average CIELAB a*, b*, and L* coordinates of the metallic glass and primary-Au phases. Since volume fractions are generally hard to quantify, in a first approximation the volume fractions will be assumed to be roughly equal to molar fractions, which are easier to quantify (this assumes that the molar volumes of the primary-Au and metallic glass phases are roughly equal). As such, a gold metallic glass matrix composite with an average microstructural feature size not exceeding 30 micrometers, having a molar fraction of the metallic glass phase defined by x, and comprising a metallic glass matrix phase with CIELAB coordinates of $a_g^*$, $b_g^*$, and $L_g^*$, and a primary-Au crystalline phase with CIELAB coordinates of $a_c^*$, $b_c^*$, and $L_c^*$, may exhibit a uniform overall surface color having CIELAB coordinates given approximately by the molar-weighted average as $a^*=xa_g^*+(1-x)a_c^*$, $b^*=xb_g^*+(1-x)b_c^*$, and $L^*=xL_g+(1-x)L_c^*$.

Therefore, in various embodiments of the disclosure, the average uniform color for a visually unresolvable composite microstructure, where the resolution of naked eye is generally above 20 micrometers, is approximately determined by the molar-weighted average of the CIELAB a*, b* and L* coordinates for the metallic glass phase and primary-Au phase. By adjusting the solute concentration of Cu and/or Ag and/or Pd and/or Zn in the primary-Au phase, the color of the primary-Au phase may be varied from yellow, to red, rose, or green, etc., while the color of the Si-rich metallic glass phase may remain pale or white. Therefore, the a*, b*, and L* CIELAB coordinates of the primary-Au phase, and primarily the a* and b* CIELAB coordinates (as the L* coordinate may not vary much between the metallic glass and primary-Au phases), may control the chromaticity of the overall color of the gold metallic glass matrix composite.

Therefore, in various embodiments of the disclosure, the average uniform color for a visually unresolvable composite microstructure (where the average microstructural feature size is generally less than 30 micrometers) may be controlled by the color of the primary-Au dendrites, as the color of the metallic glass matrix may generally remain pale or white owing to its high Si content. In some embodiments of the disclosure, the dendritic phase may exhibit "yellow gold", "rose gold" or other standard gold colors determined by control of the concentrations of dissolved solute metals in the primary-Au dendrites. For example, by adjusting the concentration of Cu and/or Ag and/or Pd and/or Zn in the primary-Au phase, the color of the primary-Au phase may be varied from yellow, to red, rose, or green, etc., while the color of the Si-rich metallic glass phase may remain pale or white. The overall gold metallic glass matrix composite therefore may exhibit optical properties and color that is designed and controlled. The design of the overall composite, its microstructure, visual appearance, and color are accomplished as follows:

(1) choose an overall composition of an alloy capable of forming a gold metallic glass matrix composite (e.g., by selecting a proper Si content) to achieve desirable molar fractions of primary-Au and metallic glass phases in the overall composite;

(2) systematically fine tune the alloy composition to vary the concentrations of solute metals (e.g. Cu, Ag, Pd, or Zn) in the primary-Au phase thereby controlling the dendrite optical properties and color; and (3) adjust the solidification conditions (primarily the cooling history) to control the desired characteristic microstructural size scales (i.e. the average microstructural feature size) and achieve a visually unresolvable composite microstructure.

To implement this strategy requires knowledge of certain features of the alloy phase diagram, partitioning coefficients for various solutes between the liquid and dendritic phase, and control of temperature and process parameters during cooling and solidification.

Mechanical Properties of Gold Metallic Glass Matrix Composites

A primary motivation of using gold metallic glass matrix composites for jewelry and luxury products is their high strength, hardness, and associated potential for high wear resistance. The hardness of a gold metallic glass matrix composite will be determined by the respective hardness values of the primary-Au phase and the metallic glass phase, weighted by their corresponding volume fractions in the composite. Since volume fractions are generally hard to quantify, in a first approximation the volume fractions will be assumed to be roughly equal to molar fractions, which are easier to quantify (this assumes that the molar volumes of the primary-Au and metallic glass phases are roughly equal). Hence, the linear rule of mixtures would predict that the hardness of the composite would be a molar-weighted average of that of the hardness values of the two phases. Monolithic metallic glasses in the Au—Cu—Ag—Pd—Si system have a reported Vicker's hardness of 360 HV (J. Schroers, B. Lohwongwatana, W. L. Johnson, A. Peker, "Gold Based Bulk Metallic Glass", Applied Physics Letters 87, 061912 (2005), the disclosure of which is incorporated herein by reference in its entirety), higher than the hardness of conventional crystalline 18-Karat gold alloys used in jewelry and luxury goods (ranging between 150 and 200 HV for conventional yellow gold alloys). On the other hand, primary-Au solid solutions phases (such as Au—Cu—Ag) have even lower hardness values (ranging between 100-150 HV). The hardness of a gold metallic glass matrix composite consisting of these two phases (i.e. a metallic glass phase and a primary-Au phase) will be influenced by the hardness values of these phases and their relative volume fractions, but also by several other factors. The scale of the microstructure of the gold metallic glass matrix composite may be relatively fine, with the average microstructural feature size being as low as a few micrometers. Specifically, the characteristic size scale of the particulate morphology (e.g. the dendrite trunk radius) in a gold metallic glass matrix composite may be much smaller than that in a monolithic primary-Au phase alloy because the former is diffusion limited while the latter is heat flow limited. As such, the yield strength and hardness for the dendrites in a composite may be higher than those in a monolithic primary-Au phase alloy due to the typical Hall-Petch size effect. Further, the particulates (e.g. dendrites) of the primary-Au phase are confined in a much stronger metallic glass matrix phase. This may constrain deformation of the primary-Au phase and tend to enhance the overall strength of the composite.

Because of the reasons above, a gold metallic glass matrix composite may exhibit an overall hardness exceeding that predicted by a linear rule of mixtures. According to a linear rule of mixtures, the hardness of the composite HV may be estimated as $HV=xHV_g+(1-x)\ HV_c$, where $HV_g$ is the hardness of the metallic glass phase of the composite, $HV_c$ the hardness of the primary-Au phase of the composite, and x is the molar fraction of the metallic glass phase in the composite. The yield strength of the composites, which should approximately scale with hardness, may also exceed the yield strength predicted by a linear rule of mixtures. Hence, the yield of the composite $\sigma_y$ may be estimated as $\sigma_y=x\sigma_{yg}+(1-x)\sigma_{yc}$, where $\sigma_{yg}$ is the yield strength of the metallic glass phase of the composite, $\sigma_{yc}$ the yield strength of the primary-Au phase of the composite, and x is the molar fraction of the metallic glass phase in the composite. The yield load $F_y$ would also follow the same rule of mixtures as the yield strength $\sigma_y$ (with $F_y$ substituting for $\sigma_y$ in the equation above).

Hence, owing to the presence of the strong and hard metallic glass matrix phase and because of the very fine morphological features of the primary-Au phase, a gold metallic glass matrix composite may demonstrate a strength and hardness that may be considerably higher than the primary-Au phase. Additionally, gold metallic glass matrix composites may also demonstrate a toughness and ductility that may be considerably higher than the metallic glass phase. In its monolithic form, the metallic glass phase is very strong and hard but also very brittle demonstrating essentially zero ductility. By contrast, the primary-Au phase is relatively tough and very ductile but is also very soft and generally demonstrates a very low strength. A gold metallic glass matrix composite comprising these two phases in a properly designed microstructure may provide the best compromise between strength/hardness and toughness/ductility. Specifically, a gold metallic glass matrix composite may inherit a relatively high strength and hardness from the metallic glass phase and a relatively high toughness and ductility from the primary-Au phase.

A combination of high strength together with a high toughness and ductility provides "damage tolerance", which is a highly desirable engineering property. Engineering materials are generally considered those having the best combination of strength and toughness/ductility. Generally, a high tensile ductility where considerable work hardening occurs prior to necking is highly preferred as such materials tend to display higher toughness (R. O. Ritchie et al., J. Mech. Phys. Solids, Vol. 21, p. 395 (1973), the disclosure of which is incorporated herein by reference in its entirety). In such work hardening materials, plastic deformation is distributed uniformly through the material as the material hardens during tensile loading up to a maximum stress value. At the maximum stress value, a small constriction or neck begins to form and all subsequent deformation is confined wthin this neck, which promotes gradual softening. Certain metallic glass matrix composites (Zr—Ti-based, Be-bearing) demonstrate high ductility but very little or no work hardening prior to necking during tensile loading (see for example D. C. Hofmann et al., Nature, Vol. 451, p. 1085 (2008), the disclosure of which is incorporated herein by reference). Other metallic glass matrix composites (Zr—Cu-based, Al-bearing) demonstrate good ductility but also significant work hardening with uniform plastic deformation during tensile loading (see for example Y. Wu et al., Advanced Materials, Vol. 22, p. 2270 (2010), the disclosure of which is incorporated herein by reference).

Fracture toughness is generally assessed by subjecting a sample containing a pre-crack in either bending or tensile loading, and evaluating the plane strain stress intensity factor $K_{IC}$. However, for metallic glasses (and possibly metallic glass matrix composites), fracture toughness may be sufficiently assessed by subjecting an uncracked or unnotched sample in bending loading, end evaluating the plastic strain to fracture $\varepsilon_f$ (see for example R. D. Conner et al., Journal of Applied Physics, Vol. 94, p. 904 (2003), the disclosure of which is incorporated herein by reference). In this case, the largest $E_f$, the higher the fracture toughness.

An enhanced fracture toughness and good tensile ductility accompanied by work hardening may be achieved in a gold metallic glass matrix composite by properly designing the composite microstructure such that the dendritic morphology of the primary-Au phase confines the metallic glass matrix into an interdendritic spacing that on average is narrower than the plastic zone size of the metallic glass phase. In the case of a metallic glass phase, the plastic zone size essentially defines the length scale over which a propagating shear band evolves into a crack. As such, shear bands developing in the plastically deforming metallic glass matrix phase may be arrested by the soft primary-Au dendrites prior to evolving into cracks.

Generally, under plane strain conditions the plastic zone size $R_p$ is assumed to be equal to $K_{IC}^2/(6\pi\sigma_y^2)$, where $K_{IC}$ is the plane strain fracture toughness and $\sigma_y$ the yield strength of the material. In order to evaluate the plastic zone size of the metallic glass phase of a gold metallic glass matrix composite, a monolithic sample of the metallic glass phase must be produced and its fracture toughness ($K_{IC}$) and yield strength ($\sigma_y$) must be evaluated. The evaluated plastic zone size $R_p$ would represent the upper limit for the average microstructural feature size such that the composite demonstrates enhanced damage tolerance, characterized by a high toughness and good ductility accompanied by work hardening.

Thermal and Electrical Transport Properties of Gold Metallic Glass Matrix Composites The primary-Au phase in the gold metallic glass matrix composite may have a relatively high thermal conductivity and electrical conductivity, substantially greater than those of the metallic glass matrix phase. The monolithic Au-based metallic glass phase alloy may have electrical resistivity in the range of 120-160 μΩ-cm as is the case for metal-metalloid metallic glasses. In contrast the primary-Au fcc phase may have much lower electrical resistivity in the range of 10-20 μΩ-cm. The thermal conductivity of metallic materials is generally known to scale approximately with the electrical conductivity (Wiedemann-Franz Law). The thermal conductivity of all metallic glasses is generally in the range of 3-8 W/m-K at ambient temperature and increases to 10-20 W/m-K in the liquid state above the glass transition. Primary-Au fcc solid solutions, such as the ternary Au—Cu—Ag phase, may have thermal conductivity that increases from 20-40 W/m-K at ambient temperature up to 60-100 W/m-K near the melting point of the alloys. Essentially, the electrical and thermal conductivity of the primary-Au phase are roughly an order of magnitude greater that those of the metallic glass matrix phase. The enhanced electrical and thermal conductivity at ambient temperature of gold metallic glass matrix composites is expected to be useful in applications where heat flow management or low Ohmic electrical dissipation are important.

Composition of Gold Metallic Glass Matrix Composites

In various embodiments, the disclosure provides Au-based alloys capable of forming metallic glass-matrix composites, and metallic glass matrix composites formed thereof.

In one embodiment, the disclosure is directed to a Au-based alloy comprising Si capable of forming a Au-based metallic glass matrix composite;

where the atomic fraction of Si is in the range of 1 to 16; and where the Au-based metallic glass matrix composite consists essentially of a primary-Au crystalline phase and a metallic glass phase.

In another embodiment, the atomic fraction of Si is in the range of 5 to 13 percent. In another embodiment, the atomic fraction of Si is in the range of 6 to 12 percent. In another embodiment, the atomic fraction of Si is in the range of 7 to 11 percent. In yet another embodiment, the atomic fraction of Si is not more than 10 percent.

In another embodiment, the alloy also comprises one or more of Cu, Ag, Pd, and Zn. In another embodiment, the alloy also comprises Cu in atomic fraction of up to 40 percent. In another embodiment, the alloy also comprises Cu in an atomic concentration ranging from 15 to 35 percent. In yet another embodiment, the alloy also comprises Cu in an atomic fraction ranging from 20 to 30 percent. In another embodiment, the alloy also comprises Ag in an atomic fraction of up to 30 percent. In another embodiment, the alloy also comprises Ag in an atomic fraction ranging from 3 to 27 percent. In another embodiment, the alloy also comprises Ag in an atomic fraction ranging from 5 to 25 percent. In another embodiment, the alloy also comprises Ag in an atomic fraction of up to 15 percent. In another embodiment, the alloy also comprises Ag in an atomic fraction ranging from 1 to 14 percent. In yet another embodiment, the alloy also comprises Ag in an atomic fraction ranging from 2 to 12 percent. In yet another embodiment, the alloy also comprises Ag in an atomic fraction ranging from 4 to 10 percent. In another embodiment, the alloy also comprises Pd in an atomic fraction of up to 7.5 percent. In another embodiment, the alloy also comprises Pd in an atomic fraction of up to 5 percent. In yet another embodiment, the alloy also comprises Pd in an atomic fraction ranging from 1 to 4 percent. In another embodiment, the alloy also comprises Zn in an atomic fraction of up to 7.5 percent. In another embodiment, the alloy also comprises Zn in an atomic fraction of up to 5 percent. In another embodiment, the alloy also comprises Zn in an atomic fraction ranging from 0.5 to 4 percent. In yet another embodiment, the alloy also comprises Zn in an atomic fraction ranging from 1 to 3 percent.

In another embodiment, the disclosure is directed to a Au-based alloy capable of forming a Au-based metallic glass matrix composite having a composition represented by the following formula (subscripts denote atomic percentages):

$$Au_{(100-a-b-c-d-e)}Cu_aAg_bPd_cZn_dSi_e \quad \text{EQ. (1)}$$

where:

a ranges from 5 to 35;

b ranges from 1 to 30;

c is up to 7.5;

d is up to 7.5;

e ranges from 1 to 16; and wherein the Au-based metallic glass matrix composite consists essentially of a primary-Au crystalline phase and a metallic glass phase.

In another embodiment, the weight fraction of Au is at least 75 percent. In another embodiment, a ranges from 10 to 30. In another embodiment, a ranges from 15 to 25. In another embodiment, a ranges from 15 to 35. In another embodiment, a ranges from 20 to 30. In another embodiment, a ranges from 21 to 27. In another embodiment, b ranges from 3 to 27. In another embodiment, b ranges from 5 to 25. In another embodiment, b ranges from 10 to 30. In another embodiment, b ranges from 13 to 27. In another embodiment, b ranges from 4 to 10. In another embodiment, c ranges from 0.5 to 5. In another embodiment, c ranges from 1 to 4. In another embodiment, d ranges from 0.5 to 4. In another embodiment, e ranges from 2 to 15. In another embodiment, e ranges from 3 to 14. In another embodiment, e ranges from 5 to 13. In another embodiment, e ranges from 6 to 12. In another embodiment, e ranges from 7 to 11. In another embodiment, e is less than 12. In yet another embodiment, e is less than 10.

In other embodiments, the disclosure is directed to a Au-based alloy capable of forming a Au-based metallic glass matrix composite comprising Au, Cu, Ag, Pd, and Si;

where the atomic concentrations of Au, Cu, Ag, Pd, and Si depend on a parameter x, where x is selected from the range of $0<x<1$;

where the concentration of Au in atomic percent is defined by equation $a_1+a_2 \cdot x$, where $60<a_1<70$ and $-16<a_2<-14$;

where the concentration of Cu in atomic percent is defined by equation $b_1+b_2 \cdot x$, where $20<b_1<25$ and $2.9<b_2<3.3$;

where the concentration of Ag in atomic percent is defined by equation $c_1+c_2 \cdot x$, where $11<c_1<14$ and $-10<c_2<-9$;

where the concentration of Pd in atomic percent is defined by equation $d \cdot x$, where $2<d<4$;

where the concentration of Si in atomic percent is defined by equation $e \cdot x$, where $17<e<20$; and wherein the Au-based metallic glass matrix composite consists essentially of a primary-Au crystalline phase and a metallic glass phase.

In another embodiment, $62.5<a_1<67.5$. In another embodiment, $-15.5<a_2<-15$. In another embodiment, $21<b_1<23$. In another embodiment, $3.0<b_2<3.2$. In another embodiment, $12<c_1<13$. In another embodiment, $-9.6<c_2<-9.2$. In another embodiment, $2.5<d<3.5$. In yet another embodiment, $18<e<19$.

In another embodiment, the alloy also comprises Ge in an atomic fraction of up to 7.5 percent. In another embodiment, the alloy also comprises Pt in an atomic fraction of up to 7.5 percent. In another embodiment, the alloy also comprises one or more of Ni, Co, Fe Al, Be, Y, La, Sn, Sb, Pb, P. In another embodiment, the alloy also comprises one or more of Ni, Co, Fe Al, Be, Y, La, Sn, Sb, Pb, P, each in an atomic fraction of up to 5 percent.

Processing of Gold Metallic Glass Matrix Composite Articles

The disclosure is also directed to articles made of a gold metallic glass matrix composite, and methods of preparing the same.

In some embodiments, a gold metallic glass matrix composite article is formed by heating an alloy ingot to a temperature above the liquidus temperature of the alloy to create a molten alloy, shaping the molten alloy into a desired shape, and simultaneously or subsequently quenching the molten alloy fast enough to avoid crystallization of the metallic glass matrix phase. In one embodiment, prior to quenching the molten alloy is heated to at least 100° C. above the liquidus temperature of the alloy. In another embodiment, prior to quenching the molten alloy is heated to at least 200° C. above the liquidus temperature of the alloy. In another embodiment, prior to quenching the molten alloy is heated to at least 900° C. In yet another embodiment, prior to quenching the molten alloy is heated to at least 1000° C.

In other embodiments, a gold metallic glass matrix composite article is formed by semi-solid processing. Semi-solid processing methods involve heating an alloy ingot to a semi-solid temperature that is above the solidus temperature but below the liquidus temperature of the alloy under inert atmosphere to create a semi-solid alloy, holding the semi-solid alloy at the semi-solid temperature for at least 10 seconds, shaping the semi-solid alloy into a desired shape, and simultaneously or subsequently quenching the molten alloy fast enough to avoid crystallization of the metallic glass matrix phase. In one embodiment, the semi-solid alloy is held at the semi-solid temperature for at least 30 seconds. In another embodiment, the semi-solid alloy is held at the semi-solid temperature for at least 60 seconds. In another embodiment, the semi-solid temperature is at least 50° C. above the solidus temperature and not higher than 50° C. below the liquidus temperature of the alloy. In another embodiment, the semi-solid temperature is at least 100° C. above the solidus temperature and not higher than 100° C. below the liquidus temperature of the alloy. In another embodiment, the semi-solid temperature between 400° C. and 700° C. In another embodiment, the semi-solid temperature between 440° C. and 650° C. In some embodiments, semi-solid processing methods may include thixocasting, rheocasting, or thixomolding.

In one embodiment, the alloy ingot is heated and melted using an induction coil. In another embodiment, the alloy ingot is heated and melted using a plasma arc. In some embodiments, the alloy ingot is heated and melted over a water-cooled hearth, or within a water-cooled crucible. In one embodiment, the water-cooled hearth or crucible is made of copper. In one embodiment, the alloy ingot is heated and melted within a crucible made of an oxide glass (e.g. quartz) or a ceramic (e.g. zirconia, alumina, sintered silica). In other embodiments, the alloy ingot is heated and melted using ohmic heating. In some embodiments, ohmic heating is performed on an alloy ingot that has a uniform cross section. In some embodiments, ohmic heating is performed by discharge of a quantum of electrical energy across an alloy ingot. In some embodiments, the discharge of a quantum of electrical energy is performed using at least one capacitor.

In various embodiments, the step of heating the alloy ingot is performed under inert atmosphere. In some embodiments, the inert atmosphere comprises argon or helium gas. In other embodiments, the inert atmosphere is vacuum. In one embodiment, vacuum is associated with a pressure of less than 1 mbar. In another embodiment, vacuum is associated with a pressure of less than 0.1 mbar.

In some embodiments, the step of simultaneously shaping and quenching the molten alloy or semi-solid alloy is performed by injecting or pouring the molten alloy or semi-solid alloy into a mold. In other embodiments, the step of simultaneously shaping and quenching the molten alloy or semi-solid alloy is performed by forging, stamping, or extruding the molten alloy or semi-solid alloy using a die. In some embodiments, the mold or die comprises a metal. In some embodiments, the mold comprises copper, brass, steel, or tool steel among other materials. In some embodiments, injection molding, forging, stamping, or extruding the molten alloy or semi-solid alloy is performed by a pneumatic drive, a hydraulic drive, an electric drive, or a magnetic drive. In some embodiments, pouring the molten alloy or semi-solid alloy into a mold is performed by tilting a tandish containing the molten alloy or semi-solid alloy.

The disclosure is also directed to methods of thermoplastically shaping a metallic glass matrix composite into an article.

In such embodiments, a sample of metallic glass matrix composite is heated to a softening temperature $T_0$ above the glass transition temperature $T_g$ conducive for thermoplastic forming, shaping the softened sample into a desired shape, and simultaneously or subsequently quenching the molten alloy fast enough to avoid crystallization of the metallic glass matrix phase. In one embodiment, the softening temperature $T_0$ is a temperature where the viscosity of the metallic glass matrix phase is between $10^{-2}$ and $10^{6}$ Pa-s. In another embodiment, the softening temperature $T_0$ is a temperature where the viscosity of the metallic glass matrix phase is between $10^{-1}$ and $10^{5}$ Pa-s. In another embodiment, the softening temperature $T_0$ is a temperature where the viscosity of the metallic glass matrix phase is between $10^{0}$ and $10^{4}$ Pa-s. In one embodiment, the softening temperature $T_0$ is between 120° C. and 350° C. In another embodiment, the softening temperature $T_0$ is between 150° C. and 300° C. In another embodiment, the softening temperature $T_0$ is between 175° C. and 275° C. In yet another embodiment, the softening temperature $T_0$ is between 200° C. and 250° C.

In some embodiments, heating of the metallic glass matrix composite sample is performed by conduction to a hot surface. In other embodiments, heating of the metallic glass matrix composite sample is performed by inductive heating. In yet other embodiments, heating of the metallic glass matrix composite sample is performed by ohmic heating. In one embodiment, the ohmic heating is performed at a heating rate of at least 1000 K/s. In another embodiment, the ohmic heating is performed at a heating rate of at least 10000 K/s. In certain embodiments, the ohmic heating is performed by discharge of a quantum of electrical energy across the metallic glass matrix composite sample. In one embodiment, the discharge of a quantum of electrical energy is performed over a time not exceeding 100 ms. In another embodiment, the discharge of a quantum of electrical energy is performed over a time not exceeding 10 ms. In some embodiments, the discharge of a quantum of electrical energy is performed using at least one capacitor. In some embodiments, ohmic heating is performed by the Rapid Capacitor Discharge Forming (RCDF) method and apparatus, as described in U.S. Pat. No. 8,613,813, which is incorporated herein by reference in its entirety.

In some embodiments, the step of simultaneously shaping and quenching of the softened sample is performed by injection molding the softened sample. In some embodiments, the step of simultaneously shaping and quenching of the softened sample is performed by blow molding the softened sample. In some embodiments, the step of simultaneously shaping and quenching of the softened sample is performed by forging, stamping, or extruding the softened sample using a die. In some embodiments, the mold or die comprises a metal. In some embodiments, the mold or die comprises copper, brass, steel, or tool steel among other materials.

In some embodiments, the application of the deformational force to thermoplastically shape the softened sample is performed using one of a pneumatic drive, a hydraulic drive, an electric drive, and a magnetic drive.

EXAMPLE I

Au—Cu—Ag—Pd—Si Gold Metallic Glass Matrix Composite

An example Au—Cu—Ag—Pd—Si alloy capable of forming gold metallic glass matrix composite according to embodiments of the disclosure has composition $Au_{57.6}Cu_{24}Ag_{7.7}Pd_{1.5}Si_{9.2}$ (Example 1). The composite was processed by directly cooling the equilibrium melt from above the liquidus temperature of the alloy to below the glass-transition temperature of the metallic glass phase. Specifically, the high temperature equilibrium melt contained in a quartz tube having inner diameter of 3 mm and 0.5 mm thick walls is quenched in room temperature water. The composite has a critical rod diameter of 3 mm. The composite also has Au weight fraction of 80.6 percent and thus satisfies the 18-Karat hallmark. These properties are listed in Table 1.

TABLE 1

Example Au—Cu—Ag—Pd—Si and Au—Cu—Ag—Zn—Pd—Si alloys capable of forming gold metallic glass matrix composites.

| | Example | |
|---|---|---|
| | 1 | 2 |
| Composition (at. %) | $Au_{58}Cu_{24}Ag_{7.5}Pd_{1.5}Si_9$ | $Au_{56}Cu_{24}Ag_{7.5}Zn_2Pd_{1.5}Si_9$ |
| Au wt. % | 80.62 | 79.31 |
| Critical Rod Diameter | 3 mm | 4 mm |
| Glass-transition temperature | 115.1° C. | 117.5° C. |
| Crystallization temperature | 159.1° C. | 162.7° C. |

TABLE 1-continued

Example Au—Cu—Ag—Pd—Si and Au—Cu—Ag—Zn—Pd—Si alloys capable of forming gold metallic glass matrix composites.

| | Example | |
|---|---|---|
| | 1 | 2 |
| Solidus temperature | 348.6° C. | 341.7° C. |
| Liquidus temperature | 800.1° C. | 777.1° C. |
| Heat of crystallization | 9.4 J/g | 9.2 J/g |

Figure 2:
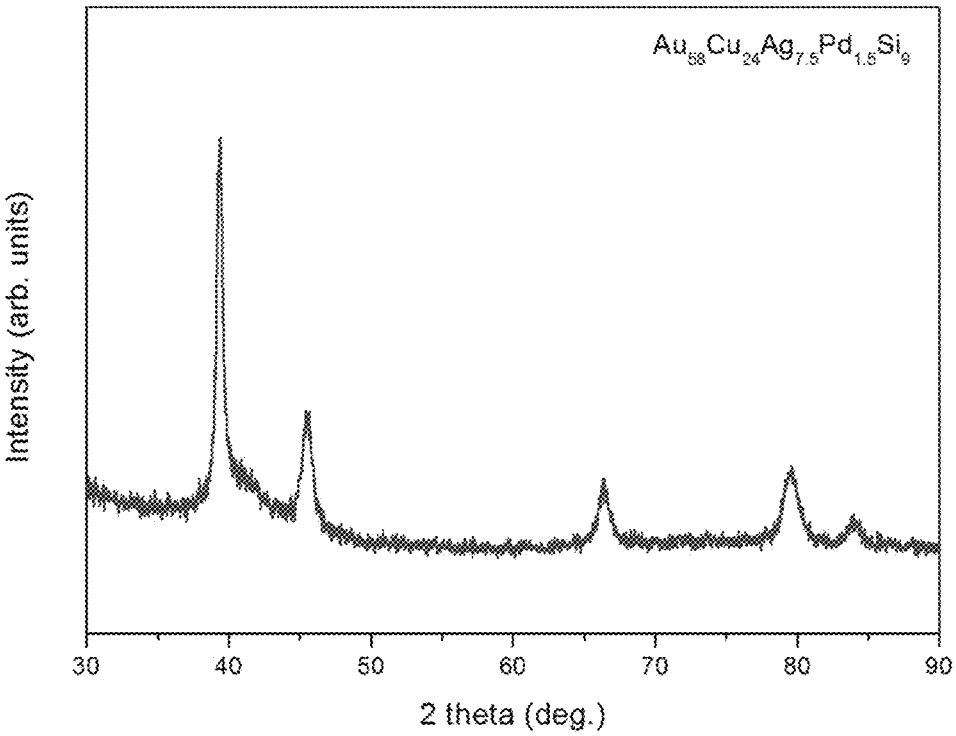
FIG. 2 provides an x-ray diffractogram for example metallic glass matrix composite $Au_{58}Cu_{24}Ag_{7.5}Pd_{1.5}Si_9$ in accordance with embodiments of the disclosure.

FIG. 2 provides an x-ray diffractogram for example metallic glass matrix composite $Au_{58}Cu_{24}Ag_{7.5}Pd_{1.5}Si_9$. The diffractograms reveal that the composite comprises a primary-Au crystalline phase and a metallic glass phase and is free of any other phase. Specifically, the diffraction peaks revealed in the diffractogram are consistent with a crystalline solid-solution that has the face-centered cubic structure of pure Au (i.e. a primary-Au phase), while the diffused halo background pattern is consistent with the amorphous structure of a metallic glass. No peaks other than those consistent with the primary-Au crystalline phase are evident in the diffractogram, confirming the absence of any other crystalline phase.

Figure 3:
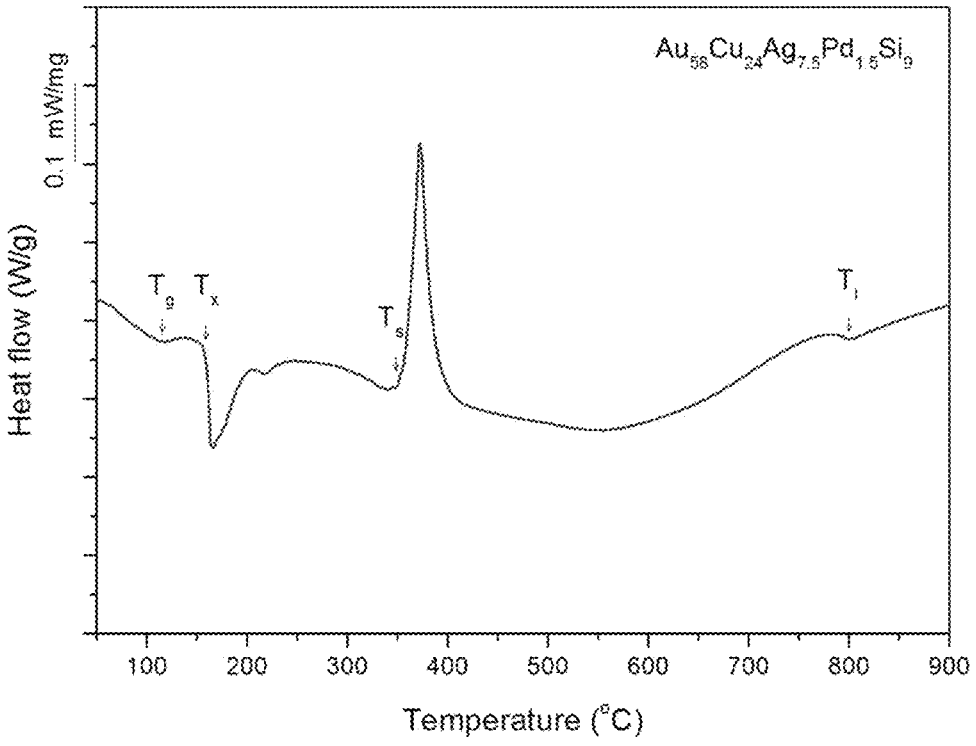
FIG. 3 provides a calorimetry scan for example metallic glass matrix composite $Au_{58}Cu_{24}Ag_{7.5}Pd_{1.5}Si_9$ in accordance with embodiments of the disclosure. The glass transition temperature $T_g$, crystallization temperature $T_x$, solidus temperature $T_s$, and liquidus temperature $T_l$ are indicated by arrows.

FIG. 3 provides a calorimetry scan for example metallic glass matrix composite $Au_{58}Cu_{24}Ag_{7.5}Pd_{1.5}Si_9$. The glass transition temperature $T_g$ of 115.1° C., the crystallization temperature $T_x$ of 159.1° C., the solidus temperature $T_s$ of 348.6° C., and the liquidus temperature $T_i$ of 800.1° C. are indicated by arrows in FIG. 3. The heat of crystallization $\Delta H_x$ is also measured to be 9.4 J/g. These properties are also listed in Table 1.

Figure 4:
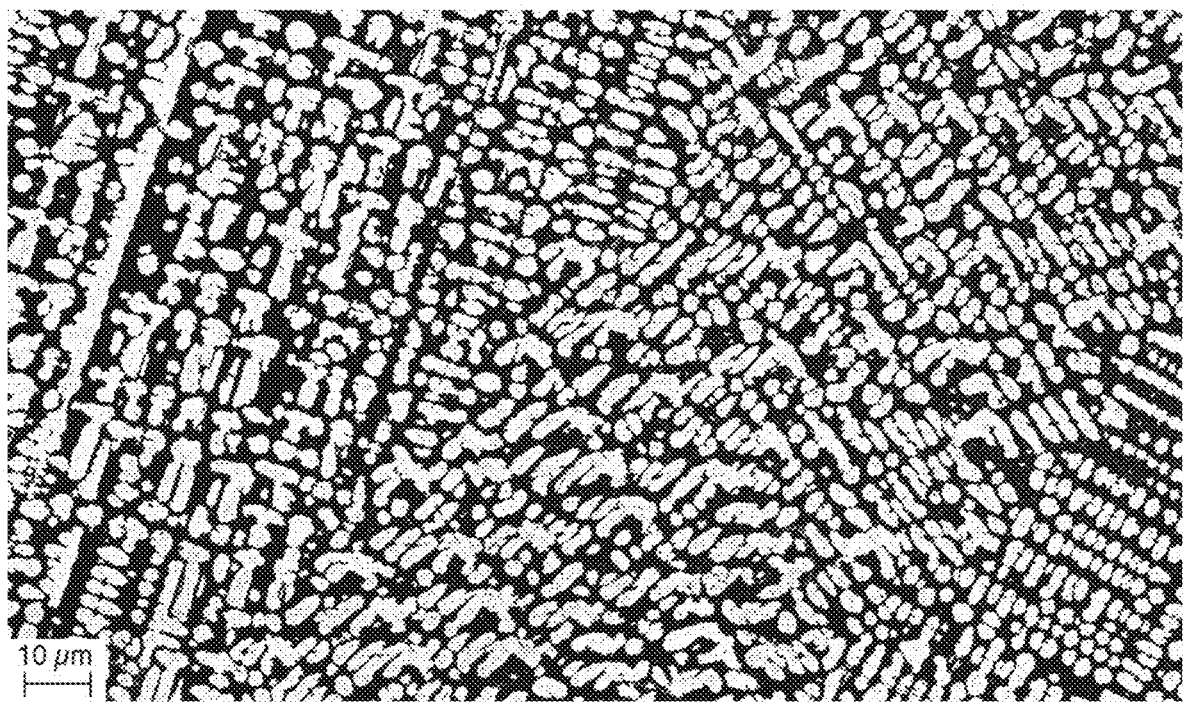
FIG. 4 presents a micrograph showing the microstructure of example metallic glass matrix composite $Au_{58}Cu_{24}Ag_{7.5}Pd_{1.5}Si_9$.

The microstructure of the example metallic glass matrix composite $Au_{58}Cu_{24}Ag_{7.5}Pd_{1.5}Si_9$ is investigated using scanning electron microscopy. FIG. 4 presents a micrograph showing the microstructure of $Au_{58}Cu_{24}Ag_{7.5}Pd_{1.5}Si_9$ over a radial cross section of a rod produced by the method of direct melt quenching. The micrograph reveals that the microstructure of the composite comprises two phases. The darker colored phase represents the metallic glass matrix phase while the light colored phase represents the primary-Au particulate phase. No other phase is detectable in the micrographs, thereby verifying that this composite is a metallic glass matrix composite comprising a primary-Au crystalline phase and a metallic glass phase and are free of any other phase. The micrograph also reveals that the primary-Au crystalline phase is characterized by a dendritic shape and is distributed uniformly and homogeneously through the metallic glass matrix. The dendrite trunks appear to have developed radially through the rod samples. This is because dendritic crystals tend to nucleate copiously throughout the sample and grow rapidly with the dendrite trunk developing along the direction of the temperature gradient established by the quench of the sample (along the radial direction of the rod). Visually, the volume fraction of the metallic glass phase appears to be approximately 50%. Lastly, the micrograph reveals that the average microstructural feature size appears to be less than 10 μm. Specifically, the average dendrite trunk and dendrite arm diameters appear to be approximately between 2 and 4 μm while the average interdendritic spacing appears to be approximately between 2 and 4 μm. This relatively fine and uniform microstructure is a consequence of processing the composites by directly quenching the equilibrium molten state.

Therefore, in some embodiments where a metallic glass matrix composite is processed by directly cooling the equilibrium melt from above the liquidus temperature of the alloy to below the glass-transition temperature of the metallic glass phase, the average microstructural feature size is less than 30 μm, while in other embodiments less than 20 μm, while in yet other embodiments less than 10 μm.

Compositional analysis of the two phases in the $Au_{58}Cu_{24}Ag_{7.5}Pd_{1.5}Si_9$ composite using Secondary Ion Mass Spectroscopy (SIMS) reveals that the composition of the metallic glass matrix phase is Au 50.04±0.18, Cu 25.30±0.09, Ag 3.06±0.08, Pd 3.06±0.29, Si 18.53±0.15 (at. %) while that of the primary-Au particulate phase is Au 65.21±0.18, Cu 22.39±0.63, Ag 12.39±0.41, Pd 0.01±0.02, Si 0.00±0.00 (at. %). A round-off analysis suggests that the composition of the metallic glass matrix phase is $Au_{50}Cu_{25.5}Ag_3Pd_3Si_{18.5}$ while that of the primary-Au particulate phase is $Au_{65.2}Cu_{22.4}Ag_{12.4}$. The composition analysis therefore reveals that Si and Pd entirely partition to the metallic glass matrix phase, as the primary-Au particulate phase is a ternary Au—Cu—Ag phase free of Si and Pd. Also, Au and Ag partition more preferably to primary-Au particulate phase, while Cu partitions roughly equally to the two phases.

Therefore, in some embodiments, the primary-Au particulate phase is free of Si. In other embodiments, the atomic concentration of Au in the primary-Au particulate phase is higher than the nominal atomic concentration of Au in the composite, while the atomic concentration of Au in the metallic glass matrix phase is lower than the nominal atomic concentration of Au in the composite. In other embodiments where the gold metallic glass matrix composite comprises Ag, the atomic concentration of Ag in the primary-Au particulate phase is higher than the nominal atomic concentration of Ag in the composite, while the atomic concentration of Ag in the metallic glass matrix phase is lower than the nominal atomic concentration of Ag in the composite. In other embodiments where the gold metallic glass matrix composite comprises Pd, the primary-Au particulate phase is free of Pd.

EXAMPLE II

Au—Cu—Ag—Zn—Pd—Si Gold Metallic Glass Matrix Composites

An example Au—Cu—Ag—Zn—Pd—Si alloy capable of forming a gold metallic glass matrix composite, showing the effect of substituting Au by Zn, has composition $Au_{56}Cu_{24}Ag_{7.5}Zn_2Pd_{1.5}Si_9$ (Example 2). The composite was processed by directly cooling the equilibrium melt from above the liquidus temperature of the alloy to below the glass-transition temperature of the metallic glass phase. Specifically, the high temperature equilibrium melt contained in a quartz tube having inner diameter of 4 mm and 0.5 mm thick walls is quenched in room temperature water. The composite has a critical rod diameter of 4 mm. The Zn-bearing composite has Au weight fraction of 79.31 percent, lower than the Zn-free composite but still satisfying the 18-Karat hallmark.

As seen, substituting 2 atomic percent of Au by Zn in $Au_{58}Cu_{24}Ag_{7.5}Pd_{1.5}Si_9$ slightly improves the critical rod diameter of the gold metallic glass matrix composites. Specifically, the critical rod diameter increases from 3 mm for the Zn-free composite $Au_{58}Cu_{24}Ag_{7.5}Pd_{1.5}Si_9$ (Example 1) to 4 mm for composite $Au_{56}Cu_{24}Ag_{7.5}Zn_2Pd_{1.5}Si_9$ comprising 2 atomic percent Zn (Example 2).

Figure 5:
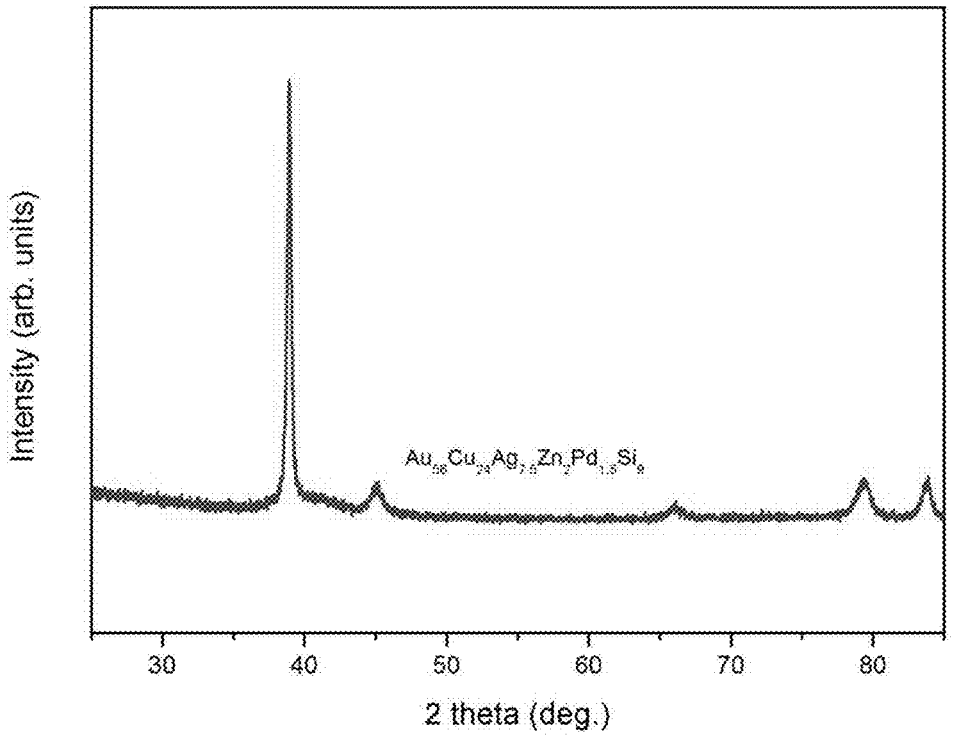
FIG. 5 provides an x-ray diffractogram for example metallic glass matrix composite $Au_{56}Cu_{24}Ag_{7.5}Zn_2Pd_{1.5}Si_9$ in accordance with embodiments of the disclosure.

FIG. 5 provides an x-ray diffractogram for example metallic glass matrix composite $Au_{56}Cu_{24}Ag_{7.5}Zn_2Pd_{1.5}Si_9$. The diffractogram reveals that the composite comprises a primary-Au crystalline phase and a metallic glass phase and is free of any other phase. Specifically, the diffraction peaks reveled in the diffractogram are consistent with a crystalline solid-solution that has the face-centered cubic structure of pure Au (i.e. a primary-Au phase), while the diffused halo background pattern is consistent with the amorphous structure of a metallic glass. No peaks other than those consistent with the primary-Au crystalline phase are evident in the diffractograms, confirming the absence of any other phase.

Figure 6:
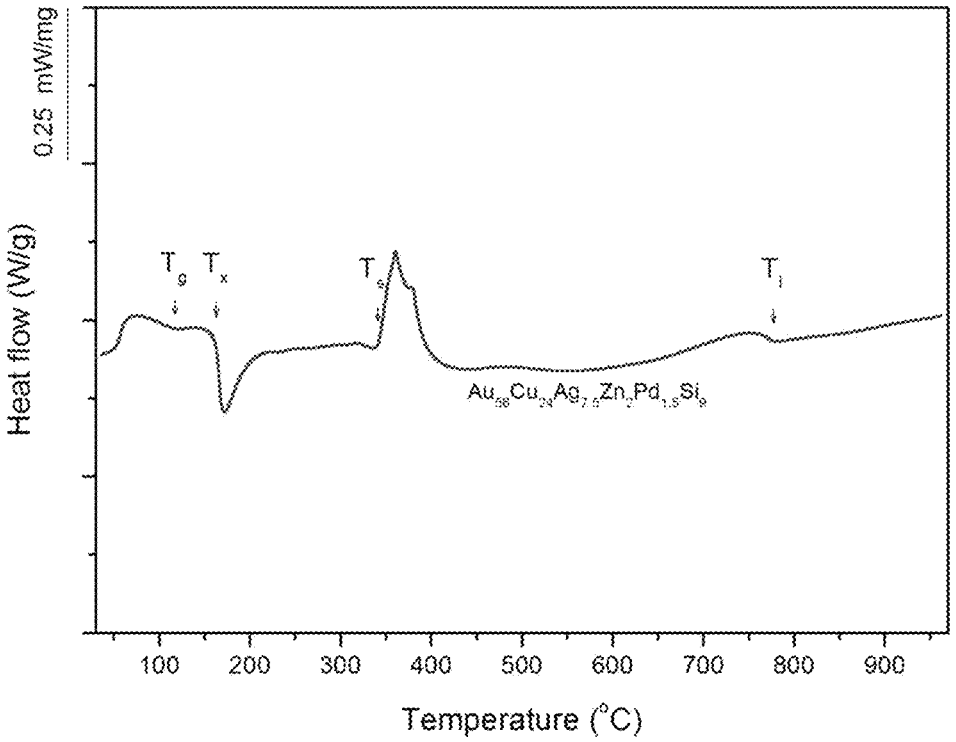
FIG. 6 provides a calorimetry scan for example metallic glass matrix composite $Au_{56}Cu_{24}Ag_{7.5}Zn_2Pd_{1.5}Si_9$ in accordance with embodiments of the disclosure. The glass transition temperature $T_g$, crystallization temperature $T_x$, solidus temperature $T_s$, and liquidus temperature $T_l$ are indicated by arrows.

FIG. 6 provides a calorimetry scan for example metallic glass matrix composite $Au_{56}Cu_{24}Ag_{7.5}Zn_2Pd_{1.5}Si_9$. The glass transition temperature $T_g$ of 117.5° C., the crystallization temperature $T_x$ of 162.7° C., the solidus temperature $T_s$ of 341.7° C., and the and liquidus temperature $T_l$ of 777.1° C. are indicated by arrows. The heat of crystallization of the metallic glass phase $\Delta H_x$ is also measured to be 9.2 J/g. These properties are also listed in Table 1.

As seen in Table 1 and FIGS. 2 and 5, substituting 2 atomic percent of Au by Zn has a significant effect on $T_g$, $T_x$, $T_s$ and $T_l$ of the gold metallic glass matrix composites. Specifically, $T_g$ increases from 115.1° C. for the Zn-free composite $Au_{58}Cu_{24}Ag_{7.5}Pd_{1.5}Si_9$ (Example 1) to 117.5° C. for the Zn-bearing composite $Au_{56}Cu_{24}Ag_{7.5}Zn_2Pd_{1.5}Si_9$ (Example 2); $T_x$ increases from 159.1° C. for the Zn-free composite $Au_{58}Cu_{24}Ag_{7.5}Pd_{1.5}Si_9$ (Example 1) to 162.7° C. for the Zn-bearing composite $Au_{56}Cu_{24}Ag_{7.5}Zn_2Pd_{1.5}Si_9$ (Example 2); $T_s$ decreases from 348.6° C. for the Zn-free composite $Au_{58}Cu_{24}Ag_{7.5}Pd_{1.5}Si_9$ (Example 1) to 341.7° C. for the Zn-bearing composite $Au_{56}Cu_{24}Ag_{7.5}Zn_2Pd_{1.5}Si_9$ (Example 2); $T_l$ decreases from 800.1° C. for the Zn-free composite $Au_{58}Cu_{24}Ag_{7.5}Pd_{1.5}Si_9$ (Example 1) to 777.1° C. for the Zn-bearing composite $Au_{56}Cu_{24}Ag_{7.5}Zn_2Pd_{1.5}Si_9$ (Example 2). The increase in $T_g$ and $T_x$ accompanied by a decrease in $T_s$ and $T_l$ when 2 atomic percent Au is substituted by Zn suggests an improvement in the glass forming ability of the metallic glass matrix composite, and to a large extent may explain the higher critical rod diameter of $Au_{56}Cu_{24}Ag_{7.5}Zn_2Pd_{1.5}Si_9$ compared to $Au_{58}Cu_{24}Ag_{7.5}Pd_{1.5}Si_9$. This is because an increasing $T_g$ and $T_x$ and a decreasing $T_s$ and $T_l$ is generally associated with an improved glass forming ability of a metallic glass forming alloy, and in the case of a metallic glass matrix composite would be associated with an improved glass forming ability of the metallic glass forming matrix phase of the composite. Lastly, as seen in Table 1 and FIGS. 2 and 5, substituting 2 atomic percent of Au by Zn has a negligible effect on the heat of crystallization of the metallic glass phase $\Delta H_x$. Specifically, $\Delta H_x$ decreases slightly from 9.4 J/g for the Zn-free composite $Au_{58}Cu_{24}Ag_{7.5}Pd_{1.5}Si_9$ (Example 1) to 9.2 J/g for the Zn-bearing composite $Au_{56}Cu_{24}Ag_{7.5}Zn_2Pd_{1.5}Si_9$ (Example 2).

Figure 7:
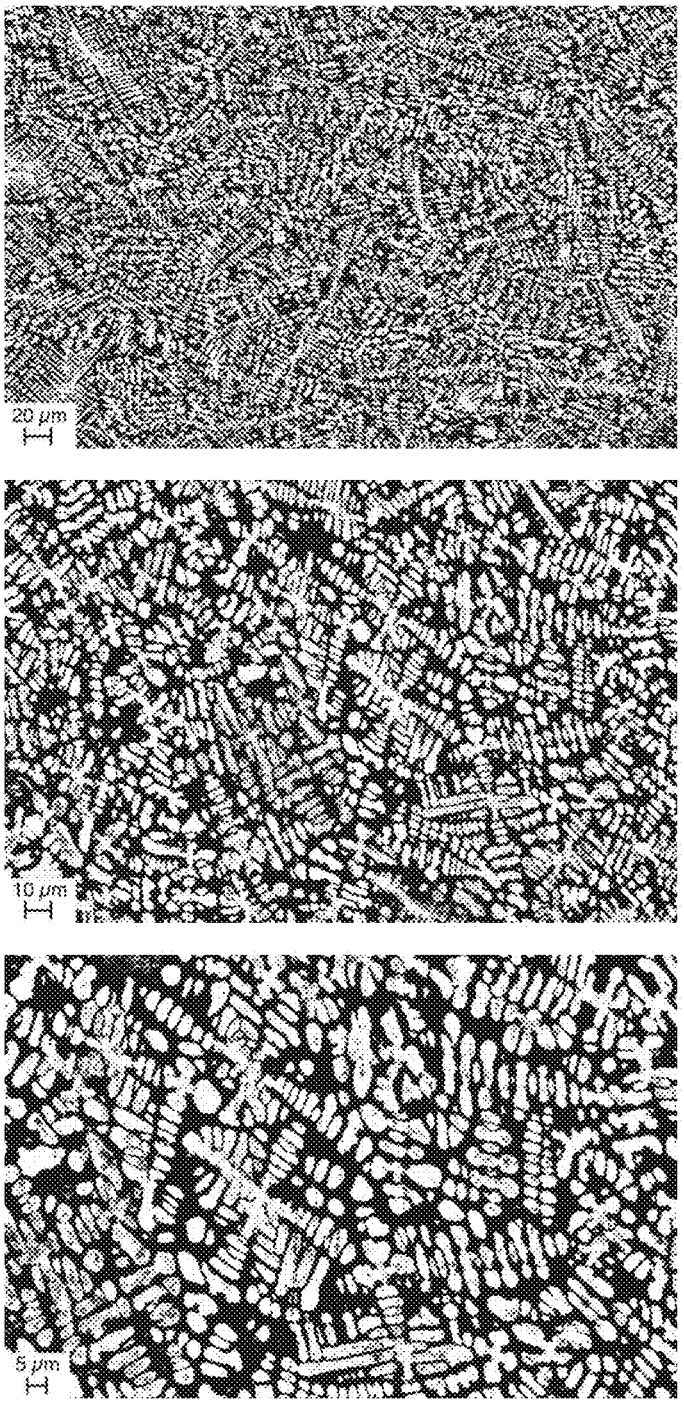
FIG. 7 presents micrographs showing the microstructure of example metallic glass matrix composite $Au_{56}Cu_{24}Ag_{7.5}Zn_2Pd_{1.5}Si_9$ in three different magnifications.

The microstructure of example metallic glass matrix composite $Au_{56}Cu_{24}Ag_{7.5}Zn_2Pd_{1.5}Si_9$ (Example 2) is investigated using scanning electron microscopy. FIG. 7 presents micrographs showing the microstructure of $Au_{56}Cu_{24}Ag_{7.5}Zn_2Pd_{1.5}Si_9$ (Example 2) over a radial cross section of a rod produced by the method of direct melt quenching, in three different magnifications. The micrographs reveal that the microstructure of the composite comprises two phases. The darker colored phase represents the metallic glass matrix phase while the light colored phase represents the primary-Au particulate phase. No other phase is detectable in the micrographs, thereby verifying that this composite is a metallic glass matrix composites comprising a primary-Au crystalline phase and a metallic glass phase and is free of any other phase. Visually, the volume fraction of the metallic glass phase appears to be approximately 50%. The micrographs also reveal that the primary-Au particulates have a dendritic shape and are distributed uniformly and homogeneously through the metallic glass matrix. The dendrite trunks appear to have developed radially along the direction of the temperature gradient established by the quench of the sample. Lastly, the micrographs reveal that the average microstructural feature size appears to be less than 10 μm. Specifically, the average dendrite trunk and dendrite arm diameters appear to be approximately between 4 and 6 μm while the average interdendritic spacing appears to be approximately between 5 and 8 μm. This relatively fine and uniform microstructure is a consequence of processing the composites by directly quenching the equilibrium molten state.

Composition analysis of the two phases in the $Au_{56}Cu_{24}Ag_{7.5}Zn_2Pd_{1.5}Si_9$ composite using Secondary Ion Mass Spectroscopy (SIMS) reveals that the composition of the metallic glass matrix phase is Au 48.26±0.17, Cu 25.80±0.18, Ag 3.65±0.09, Zn 0.37±0.01, Pd 3.08±0.09, Si 18.84±0.11 (at. %) while that of the primary-Au particulate phase is Au 62.69±0.13, Cu 22.94±0.26, Ag 11.57±0.27, Zn 2.76±0.14, Pd 0.05±0.03, Si 0.00±0.00 (at. %). A round-off analysis suggests that the composition of the metallic glass matrix phase is $Au_{48.3}Cu_{25.8}Ag_{3.7}Zn_{0.4}Pd_3Si_{18.8}$ while that of the primary-Au particulate phase is $Au_{62.7}Cu_{23}Ag_{11.6}Zn_{2.7}$. The composition analysis reveals that Si and Pd entirely partition to the metallic glass matrix phase, as the primary-Au particulate phase is a quaternary Au—Cu—Ag—Zn phase free of Si and Pd. Also, Zn appears to partition very strongly to the primary-Au particulate phase, as the metallic glass matrix phase is very poor in Zn. Lastly, Au and Ag partition more preferably to primary-Au particulate phase, while Cu partitions roughly equally to the two phases.

Therefore, in some embodiments where the gold metallic glass matrix composite comprises Zn, the atomic concentration of Zn in the primary-Au particulate phase is higher than the nominal atomic concentration of Zn in the composite, while the atomic concentration of Zn in the metallic glass matrix phase is lower than the nominal atomic concentration of Zn in the composite.

EXAMPLE III

Phase Equilibria in Gold Metallic Glass Matrix Composite

Identifying the compositions of the metallic glass matrix phase and Au-primary particulate phase in Au—Cu—Ag—Pd—Si and in Au—Cu—Ag—Zn—Pd—Si gold metallic glass matrix composites enables determining the phase equilibria in these alloy systems. The phase equilibria in the Au—Cu—Ag—Pd—Si alloy system will be analyzed here.

Figure 8:
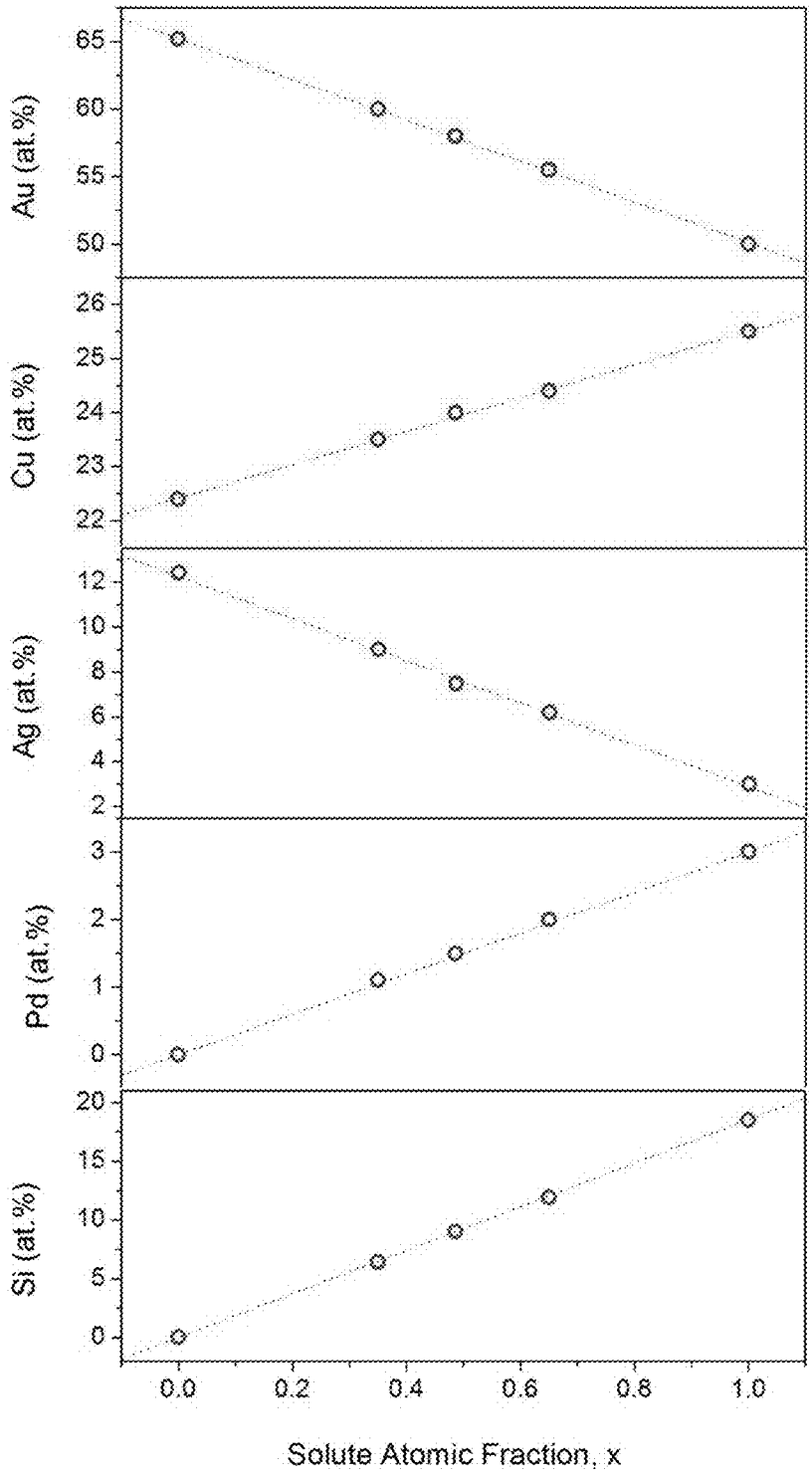
FIG. 8 presents a plot of the concentration of the constituent elements Au, Cu, Ag, Pd, and Si in the primary-Au phase $Au_{65.2}Cu_{22.4}Ag_{12.4}$ (x=0), composite $Au_{60}Cu_{23.5}Ag_9Pd_{1.1}Si_{6.4}$ (x=0.35), composite $Au_{58}Cu_{24}Ag_{7.5}Pd_{1.5}Si_9$ (x=0.49), composite $Au_{55.5}Cu_{24.4}Ag_{6.2}Pd_2Si_{11.9}$ (x=0.65), and metallic glass phase $Au_{50}Cu_{25.5}Ag_3Pd_3Si_{18.5}$ (x=1) is plotted against x, and an interconnecting "tie line" is drawn between the data points.

Having identified the composition of the metallic glass matrix phase of $Au_{50}Cu_{25.5}Ag_3Pd_3Si_{18.5}$ and that of Au-primary particulate phase of $Au_{65.2}Cu_{22.4}Ag_{12.4}$ for composite $Au_{58}Cu_{24}Ag_{7.5}Pd_{1.5}Si_9$, a tie line in the Au—Cu—Ag—Pd—Si system can be constructed by plotting the atomic concentrations of each element within each phase against a solute fraction parameter x, where x varies between 0 and 1.0 and also indicates the molar fraction of the metallic glass phase. As such, x=0 indicates a pure primary-Au phase, x=1.0 indicates a pure metallic glass phase, while 0<x<1.0 indicates a composite with x indicating the molar fraction of the metallic glass phase in the composite. In FIG. 8, the concentration of the constituent elements Au, Cu, Ag, Pd, and Si in the primary-Au phase (x=0) and metallic glass phase (x=1) is plotted against x., and an interconnecting "tie line" is drawn between the data points. When superimposing the concentration of Au, Cu, Ag, Pd, and Si in the composite $Au_{58}Cu_{24}Ag_{7.5}Pd_{1.5}Si_9$ onto each plot, one can see that composite is associated with a value of x of 0.49, suggesting that the phase fraction of the metallic glass phase in the composite may be approximately 50%. This is consistent with the molar fraction suggested by visual inspection of the micrograph of FIG. 2.

According to the plot of FIG. 8, a tie line formulation can be constructed as follows:

$$Au_{65.2-15.2x}Cu_{22.4+3.1x}Ag_{12.4-9.4x}Pd_{3x}Si_{18.5x} \quad \text{EQ. (2)}$$

with x ranging between 0 and 1 and representing the molar fraction of the metallic glass phase within the composite. Essentially, EQ. (2) connects compositions capable of forming gold metallic glass matrix composites that share the same Au-primary particulate phase and metallic glass matrix phase (though at different molar fractions). With x=0 EQ. (2) produces the primary-Au phase having composition $Au_{65.2}Cu_{22.4}Ag_{12.4}$, with x=1 it produces the metallic glass phase having composition $Au_{50}Cu_{25.5}Ag_3Pd_3Si_{18.5}$, while with 0<x<1 it produces a composite comprising both phases with x representing the molar fraction of the metallic glass phase. For example, with x=0.49 EQ. (2) produces the composite having composition $Au_{58}Cu_{24}Ag_{7.5}Pd_{1.5}Si_9$.

It is also important to highlight that the coefficient of the Si dependence on xis exactly the atomic concentration of Si in the metallic glass phase of 18.5%. Therefore, the nominal atomic concentration of Si in the alloy alone can approximate the molar fraction of the metallic glass phase in the composite, x. Specifically, in some embodiments, the molar fraction of the metallic glass phase in the composite, x, can be approximated as $x=(e-e_c)/e_g$, where e is the nominal atomic concentration of Si in the overall alloy, $e_c$ is the atomic concentration of Si in the primary-Au phase, and $e_g$ is the atomic concentration of Si in the metallic glass phase. Since in some embodiments the atomic concentration of Si in the primary-Au phase is nearly zero, i.e. $e_c \approx 0$, in such embodiments x can be approximated as $x=e/e_g$. Since in some embodiments the atomic concentration of Si in the metallic glass phase phase is about 18.5%, i.e. $e_c \approx 18.5\%$, in such embodiments x can be approximated as x=e/18.5%.

In accordance with the formulation of EQ. (2), composites with different molar fractions of the metallic glass phase can be constructed by varying x in EQ. (2). For example, composites with x values of 0.35 and 0.65 can be constructed, having alloy compositions $Au_{60}Cu_{23.5}Ag_{9.1}Pd_1Si_{6.4}$ (Example 3) and $Au_{55.5}Cu_{24.4}Ag_{6.2}Pd_2Si_{11.9}$ (Example 4), respectively. The concentrations of each element in alloys $Au_{60}Cu_{23.5}Ag_{9.1}Pd_1Si_{6.4}$ and $Au_{55.5}Cu_{24.4}Ag_{6.2}Pd_2Si_{11.9}$ are superimposed in FIG. 8 against their respective x values. Alloy composition $Au_{60}Cu_{23.5}Ag_{9.1}Pd_1Si_{6.4}$ (Example 3) corresponding to x=0.35 would be expected to form a composite having a molar fraction of the metallic glass phase of 35%, while alloy composition $Au_{55.5}Cu_{24.4}Ag_{6.2}Pd_2Si_{11.9}$ (Example 4) corresponding to x=0.65 would be expected to form a composite having a molar fraction of the metallic glass phase of 65%.

To validate this concept, gold metallic glass matrix composites having compositions $Au_{60}Cu_{23.5}Ag_9Pd_{1.1}Si_{6.4}$ and $Au_{55.5}Cu_{24.4}Ag_{6.2}Pd_2Si_{11.9}$ corresponding to x=0.35 and 0.65, respectively, were produced and analyzed. Also, the primary-Au phase $Au_{65.2}Cu_{22.4}Ag_{12.4}$ and the metallic glass phase $Au_{50}Cu_{25.5}Ag_3Pd_3Si_{18.5}$ corresponding to x=0 and 1, respectively, were also produced and analyzed.

Alloy compositions according to EQ. (2) corresponding to x values of 0, 0.35, 0.49, 0.65, and 1 are presented in Table 2. The example composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4) were processed by directly cooling the equilibrium melt from above the liquidus temperature of the alloy to below the glass-transition temperature of the metallic glass phase. Specifically, the high temperature equilibrium melt contained in a quartz tube having inner diameter of 2, 3 or 4 mm and 0.5 mm thick walls is quenched in room temperature water. The Au weight fraction in each alloy is listed in Table 1. The composites have Au weight fraction of at least 75.0 percent and satisfy the 18-Karat hallmark.

TABLE 2

Alloy compositions according to EQ. (2) corresponding to x values of 0, 0.35, 0.49, 0.65, and 1, along with the corresponding Au wt. % and critical rod diameter.

| Example | Composition (at. %) | x (at. %) | Au wt. % | Critical Rod Diameter |
|---|---|---|---|---|
| N/A | $Au_{65.2}Cu_{22.4}Ag_{12.4}$ | 0 | 82.3 | N/A |
| 3 | $Au_{60}Cu_{23.5}Ag_9Pd_{1.1}Si_{6.4}$ | 0.35 | 81.1 | 2 mm |
| 1 | $Au_{58}Cu_{24}Ag_{7.5}Pd_{1.5}Si_9$ | 0.49 | 80.6 | 3 mm |
| 4 | $Au_{55.5}Cu_{24.4}Ag_{6.2}Pd_2Si_{11.9}$ | 0.65 | 79.8 | 4 mm |
| N/A | $Au_{50}Cu_{25.5}Ag_3Pd_3Si_{18.5}$ | 1.0 | 78.0 | >5 mm |

The critical rod diameters for example composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4) are listed in Table 1. As seen, increasing x improves the critical rod diameter of the gold metallic glass matrix composites. Specifically, the critical rod diameter is 2 mm for composite $Au_{60}Cu_{23.5}Ag_9Pd_{1.1}Si_{6.4}$ corresponding to x=0.35 (Example 3), increases to 3 mm for composite $Au_{58}Cu_{24}Ag_{7.5}Pd_{1.5}Si_9$ corresponding to x=0.49 (Example 1), and increases further to 4 mm for composite $Au_{55.5}Cu_{24.4}Ag_{6.2}Pd_2Si_{11.9}$ corresponding to x=0.65 (Example 4). Alloy $Au_{50}Cu_{25.5}Ag_3Pd_3Si_{18.5}$ corresponding to x=1.0, which forms a monolithic metallic glass, has critical rod diameter greater than 5 mm.

Figure 9:
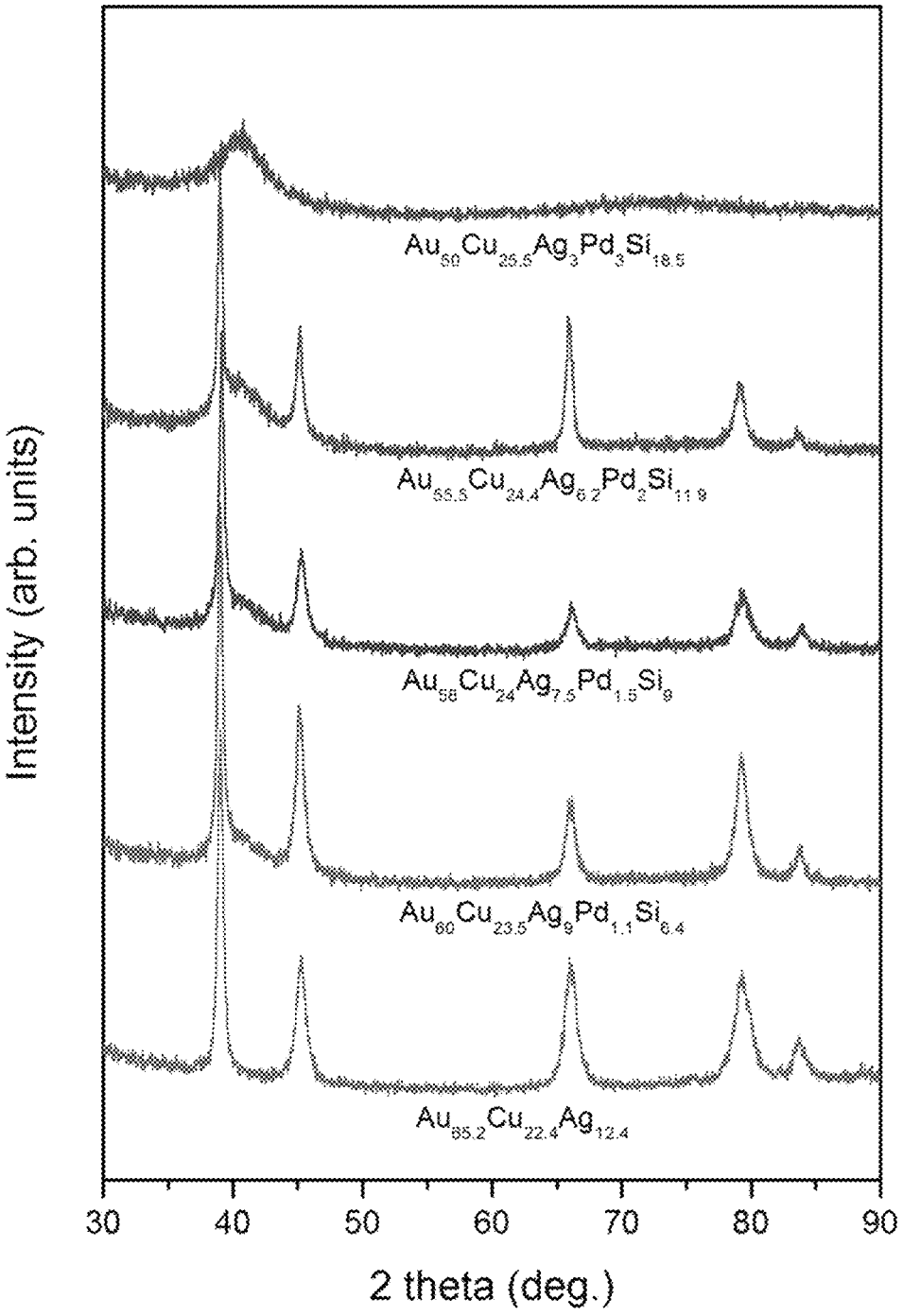
FIG. 9 provides x-ray diffractograms for example metallic glass matrix composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4) corresponding to x values of 0.35, 0.49, and 0.65, along with the x-ray diffractogram for the metallic glass matrix phase $Au_{50}Cu_{25.5}Ag_3Pd_3Si_{18.5}$ corresponding to x=1.0 and that for the primary-Au particulate phase $Au_{65.2}Cu_{22.4}Ag_{12.4}$ corresponding to x=0.

FIG. 9 provides x-ray diffractograms for example metallic glass matrix composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4) corresponding to x values of 0.35, 0.49, and 0.65, respectively, along with the x-ray diffractogram for the metallic glass matrix phase $Au_{50}Cu_{25.5}Ag_3Pd_3Si_{18.5}$ corresponding to x=1.0 and that for the primary-Au particulate phase $Au_{65.2}Cu_{22.4}Ag_{12.4}$ corresponding to x=0. The diffractogram of the metallic glass phase $Au_{50}Cu_{25.5}Ag_3Pd_3Si_{18.5}$ reveals a diffused halo background pattern and no crystallographic peaks, consistent with a fully amorphous phase. The diffractogram of the primary-Au particulate phase $Au_{65.2}Cu_{22.4}Ag_{12.4}$ reveals crystallographic peaks consistent with a crystalline solid-solution that has the face-centered cubic structure of pure Au (i.e. a primary-Au phase) and no halo background confirming the absence of any amorphous phase. The diffractograms of the gold metallic glass composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4) reveal that the composites comprise a primary-Au crystalline phase and a metallic glass phase and are free of any other phase.

Specifically, the diffractograms reveal crystallographic peaks consistent with a crystalline solid-solution that has the face-centered cubic structure of pure Au (i.e. a primary-Au phase), and a diffused halo background pattern is consistent with the amorphous structure of a metallic glass. No peaks other than those consistent with the primary-Au crystalline phase are evident in the diffractograms, confirming the absence of any other crystalline phase. As x increases from 0.35 to 0.65 the intensity of the diffuse halo increases, suggesting that molar fraction of the metallic glass phase increases at the expense of the primary-Au crystalline phase. This effect is consistent with the metallic glass matrix composites being "equilibrium composites".

Figure 10:
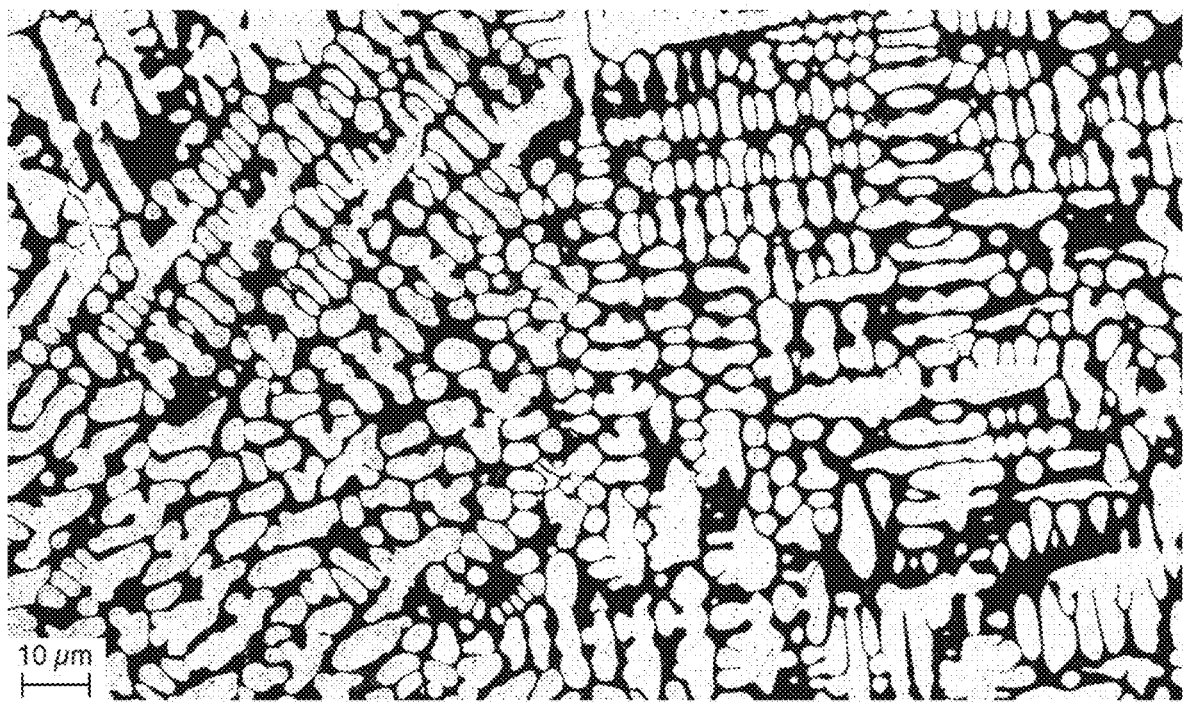
FIG. 10 presents a micrograph showing the microstructure of example metallic glass matrix composite $Au_{60}Cu_{23.5}Ag_9Pd_{1.1}Si_{6.4}$.
Figure 11:
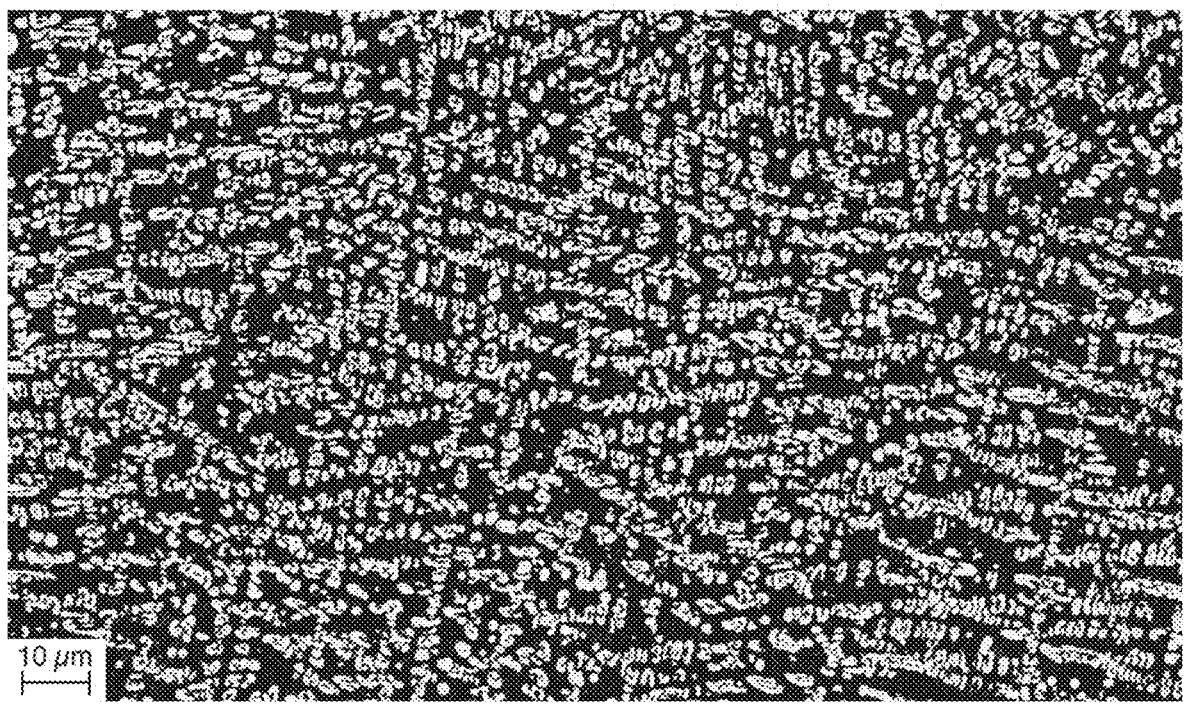
FIG. 11 presents a micrograph showing the microstructure of example metallic glass matrix composite $Au_{55.5}Cu_{24.4}Ag_{6.2}Pd_2Si_{11.9}$.

The microstructures of example metallic glass matrix composites $Au_{60}Cu_{23.5}Ag_9Pd_{1.1}Si_{6.4}$ and $Au_{55.5}Cu_{24.4}Ag_{6.2}Pd_2Si_{11.9}$ (Examples 3 and 4) corresponding to x values of 0.35 and 0.65 are investigated using scanning electron microscopy. FIGS. 10 and 11 present micrographs showing the microstructures of $Au_{60}Cu_{23.5}Ag_9Pd_{1.1}Si_{6.4}$ and $Au_{55.5}Cu_{24.4}Ag_{6.2}Pd_2Si_{11.9}$ respectively, over radial cross sections of rods produced by the method of direct melt quenching. Like in composite $Au_{58}Cu_{24}Ag_{7.5}Pd_{1.5}Si_9$ (Example 1), the micrographs reveal that the microstructure of the composites comprises two phases. The darker colored phase represents the metallic glass matrix phase while the light colored phase represents the primary-Au particulate phase. No other phase is detectable in the micrographs, thereby verifying that these composites are metallic glass matrix composites comprising a primary-Au crystalline phase and a metallic glass phase and are free of any other phase. The micrographs also reveal that the primary-Au crystalline phase is characterized by a dendritic shape and is distributed uniformly and homogeneously through the metallic glass matrix. The dendrite trunks appear to have developed radially along the direction of the temperature gradient established by the quench of the sample. The volume fraction of the metallic glass phase appears to increase with increasing x, which is consistent with the metallic glass matrix composites being "equilibrium composites". Specifically, the volume fraction of the metallic glass phase in composite $Au_{58}Cu_{24}Ag_{7.5}Pd_{1.5}Si_9$ (FIG. 4) appears to be larger than that in $Au_{60}Cu_{23.5}Ag_9Pd_{1.1}Si_{6.4}$ (FIG. 10), while the volume fraction of the metallic glass phase in composite $Au_{55.5}Cu_{24.4}Ag_{6.2}Pd_2Si_{11.9}$ (FIG. 11) appears to be larger than that in $Au_{58}Cu_{24}Ag_{7.5}Pd_{1.5}Si_9$ (FIG. 4) Lastly, the micrographs reveal that the average microstructural feature size in $Au_{60}Cu_{23.5}Ag_9Pd_{1.1}Si_{6.4}$ (FIG. 10), $Au_{58}Cu_{24}Ag_{7.5}Pd_{1.5}Si_9$ (FIG. 4), and $Au_{55.5}Cu_{24.4}Ag_{6.2}Pd_2Si_{11.9}$ (FIG. 11) composites appears to be less than 10 μm. Specifically, the average dendrite trunk and dendrite arm diameters appear to be approximately between 3 and 5 μm in composite $Au_{60}Cu_{23.5}Ag_9Pd_{1.1}Si_{6.4}$, (FIG. 10), between 2 and 4 μm in composite $Au_{58}Cu_{24}Ag_{7.5}Pd_{1.5}Si_9$ (FIG. 4), and between 1 and 3 μm in composite $Au_{55.5}Cu_{24.4}Ag_{6.2}Pd_2Si_{11.9}$ (FIG. 11) while the average interdendritic spacing appears to be approximately between 1 and 3 μm in composite $Au_{60}Cu_{23.5}Ag_9Pd_{1.1}Si_{6.4}$, (FIG. 10), between 2 and 4 μm in composite $Au_{58}Cu_{24}Ag_{7.5}Pd_{1.5}Si_9$ (FIG. 4), and between 4 and 6 μm in composite $Au_{55.5}Cu_{24.4}Ag_{6.2}Pd_2Si_{11.9}$ (FIG. 10). This relatively fine and uniform microstructure is a consequence of processing the composites by directly quenching the equilibrium molten state.

Figure 12:
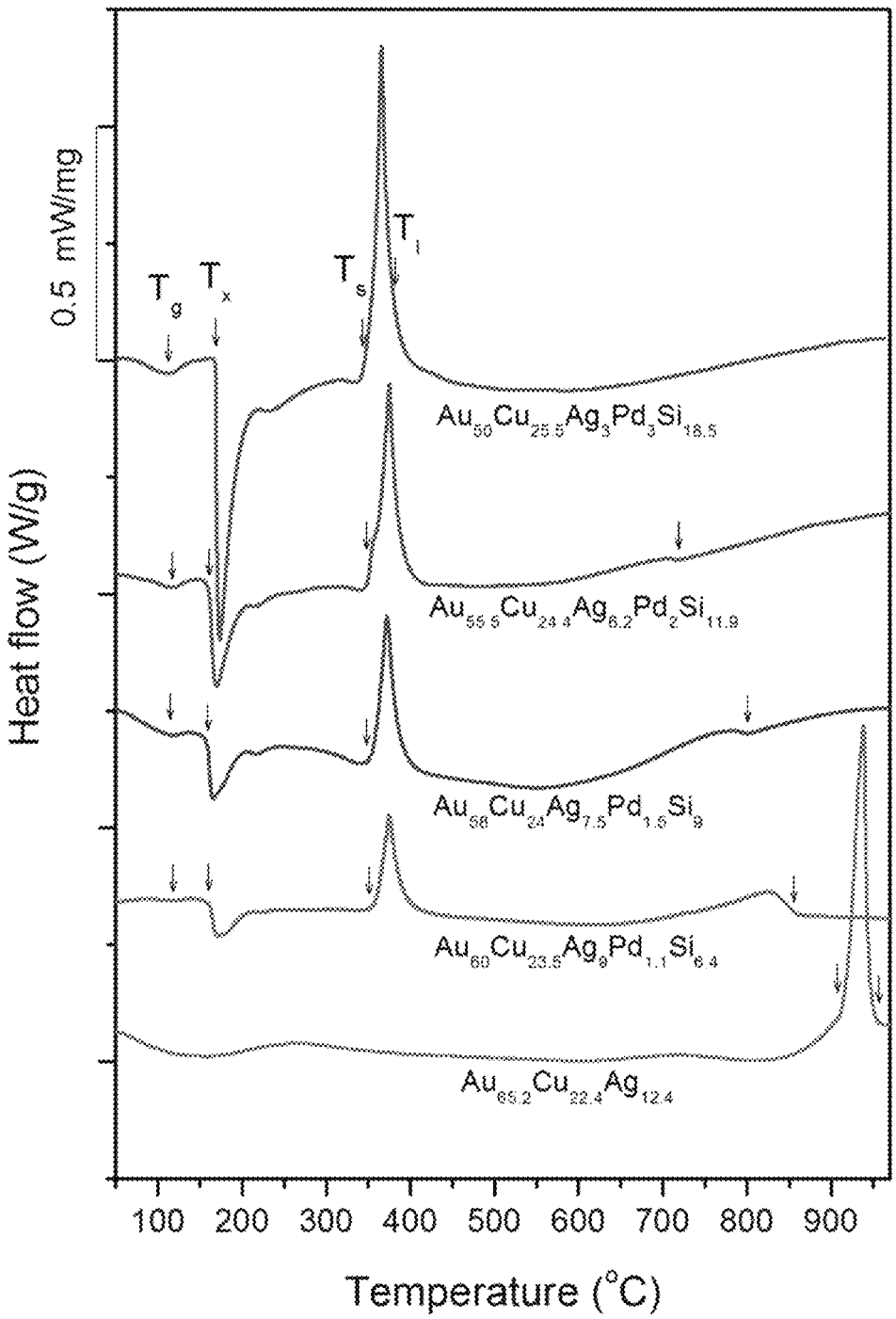
FIG. 12 provides calorimetry scans for example metallic glass matrix composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4) corresponding to x values of 0.35, 0.49, and 0.65, respectively, along with the calorimetry scan for the metallic glass matrix phase $Au_{50}Cu_{25.5}Ag_3Pd_3Si_{18.5}$ corresponding to x=1.0 and that for the primary-Au particulate phase $Au_{65.2}Cu_{22.4}Ag_{12.4}$ corresponding to x=0.

FIG. 12 provides calorimetry scans for example gold metallic glass matrix composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4) corresponding to x values of 0.35, 0.49, and 0.65, respectively, along with the calorimetry scan for the metallic glass matrix phase $Au_{50}Cu_{25.5}Ag_3Pd_3Si_{18.5}$ corresponding to x=1.0 and that for the primary-Au particulate phase $Au_{65.2}Cu_{22.4}Ag_{12.4}$ corresponding to x=0. The glass transition temperature $T_g$, crystallization temperature $T_x$, solidus temperature $T_s$, and liquidus temperature $T_l$ are indicated by arrows and are listed in Table 3. As seen in Table 3 and FIG. 12, increasing x has a negligible effect on the glass transition temperature $T_g$ and crystallization temperature $T_x$ of the gold metallic glass matrix composites. Specifically, $T_g$ is between 115° C. and 118° C. while $T_x$ is between 159° C. and 161° C. for all three example composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4). However, the monolithic metallic glass $Au_{50}Cu_{25.5}Ag_3Pd_3Si_{18.5}$ has a slightly lower $T_g$ of 112.6° C. and a slightly higher $T_x$ of 168.7° C. As also seen in Table 3 and FIG. 12, increasing x has a negligible effect on the solidus temperature $T_s$ of the gold metallic glass matrix composites. Specifically, $T_s$ remains fairly constant, varying between 347-350° C. between the three example composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4). The monolithic metallic glass $Au_{50}Cu_{25.5}Ag_3Pd_3Si_{18.5}$ also has a similar $T_s$ of 344.4° C. This is because $T_s$ represents the eutectic temperature of the alloys, which is roughly constant among the three composites and the metallic glass phase. The eutectic temperature is an invariant temperature within an alloy phase diagram and does not change as the composition of off-eutectic alloys is varied. As such, the lack of variation of $T_s$ confirms the presence of a eutectic liquid in all of the composite compositions. In contrast to the solidus temperature, as seen in Table 3 and FIG. 12, increasing x has a rather significant effect on the liquidus temperature $T_l$ of the gold metallic glass matrix composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4), as well as that of the metallic glass matrix phase $Au_{50}Cu_{25.5}Ag_3Pd_3Si_{18.5}$ and the primary-Au particulate phase $Au_{65.2}Cu_{22.4}Ag_{12.4}$. Specifically, $T_l$ decreases significantly with increasing x, from 946.4° C. for the primary-Au phase $Au_{65.2}Cu_{22.4}Ag_{12.4}$ corresponding to x=0, to 857.8° C. for composite $Au_{60}Cu_{23.5}Ag_9Pd_{1.1}Si_{6.4}$ corresponding to x=0.35, to 800.1° C. for composite $Au_{58}Cu_{24}Ag_{7.5}Pd_{1.5}Si_9$ corresponding to x=0.49, to 718.6° C. for composite $Au_{55.5}Cu_{24.4}Ag_{6.2}Pd_2Si_{11.9}$ corresponding to x=0.65, and finally to 376.9° C. for the metallic glass phase $Au_{50}Cu_{25.5}Ag_3Pd_3Si_{18.5}$ corresponding to x=1.0. The constant eutectic temperature, as defined by $T_s$, along with a receding liquidus temperature, $T_l$, as the solute concentration x increases towards the eutectic composition demonstrates that the metallic glass matrix composites are indeed mixtures of equilibrium phases and can thereby be considered "equilibrium composites".

TABLE 3

Glass transition temperature $T_g$, crystallization temperature $T_x$, solidus temperature $T_s$, and liquidus temperature $T_l$ for alloy compositions according to EQ. (2) corresponding to x values of 0, 0.35, 0.49, 0.65, and 1.

| Example | Composition (at. %) | x (at. %) | $T_g$ (° C.) | $T_x$ (° C.) | $T_s$ (° C.) | $T_l$ (° C.) |
|---|---|---|---|---|---|---|
| N/A | $Au_{65.2}Cu_{22.4}Ag_{12.4}$ | 0 | N/A | N/A | 917.8 | 946.4 |
| 3 | $Au_{60}Cu_{23.5}Ag_9Pd_{1.1}Si_{6.4}$ | 0.35 | 118.4 | 160.4 | 350.6 | 857.8 |
| 1 | $Au_{58}Cu_{24}Ag_{7.5}Pd_{1.5}Si_9$ | 0.49 | 115.1 | 159.1 | 348.6 | 800.1 |
| 4 | $Au_{55.5}Cu_{24.4}Ag_{6.2}Pd_2Si_{11.9}$ | 0.65 | 116.8 | 161.1 | 347.2 | 718.6 |
| N/A | $Au_{50}Cu_{25.5}Ag_3Pd_3Si_{18.5}$ | 1.0 | 112.6 | 168.7 | 344.4 | 376.9 |

To provide further evidence that the gold metallic glass matrix composites of the disclosure are indeed equilibrium composites, composition analysis is performed to prove that the composites associated with x=0.35 and 0.65 share the same Au-primary particulate phase (i.e. the x=0 phase) and metallic glass matrix phase (i.e. the x=1.0 phase) as the composite associated with x=0.49.

Composition analysis of the two phases in the $Au_{60}Cu_{23.5}Ag_9Pd_{1.1}Si_{6.4}$ composite using Secondary Ion Mass Spectroscopy (SIMS) reveals that the composition of the metallic glass matrix phase is Au 49.70±0.29, Cu 25.68±0.17, Ag 3.33±0.08, Pd 2.95±0.05, Si 18.35±0.18 (at. %) while that of the primary-Au particulate phase is Au 65.13±0.12, Cu 21.77±0.14, Ag 13.07±0.18, Pd 0.03±0.02, Si 0.00±0.00 (at. %). Therefore, the rounded-off compositions of the metallic glass and primary-Au phases are, within the quoted variance, the same as in the $Au_{58}Cu_{24}Ag_{7.5}Pd_{1.55}Si_9$ composite, namely $Au_{50}Cu_{25.5}Ag_3Pd_3Si_{18.5}$ and $Au_{65.2}Cu_{22.4}Ag_{12.4}$, respectively.

Composition analysis of the two phases in the $Au_{55.5}Cu_{24.4}Ag_{6.2}Pd_2Si_{11.9}$ composite using Secondary Ion Mass Spectroscopy (SIMS) reveals that the composition of the metallic glass matrix phase is Au 49.85±0.32, Cu 25.46±0.17, Ag 3.33±0.08, Pd 3.00±0.03, Si 18.23±0.19 (at. %) while that of the primary-Au particulate phase is Au 65.32±0.51, Cu 21.17±0.54, Ag 13.23±0.18, Pd 0.03±0.03, Si 0.25±0.11 (at. %). Therefore, the rounded-off compositions of the metallic glass and primary-Au phases are, within the quoted variance, the same as in the $Au_{58}Cu_{24}Ag_{7.5}Pd_{1.55}Si_9$ composite, namely $Au_{50}Cu_{25.5}Ag_3Pd_3Si_{18.5}$ and $Au_{65.2}Cu_{22.4}Ag_{12.4}$, respectively.

Figure 13:
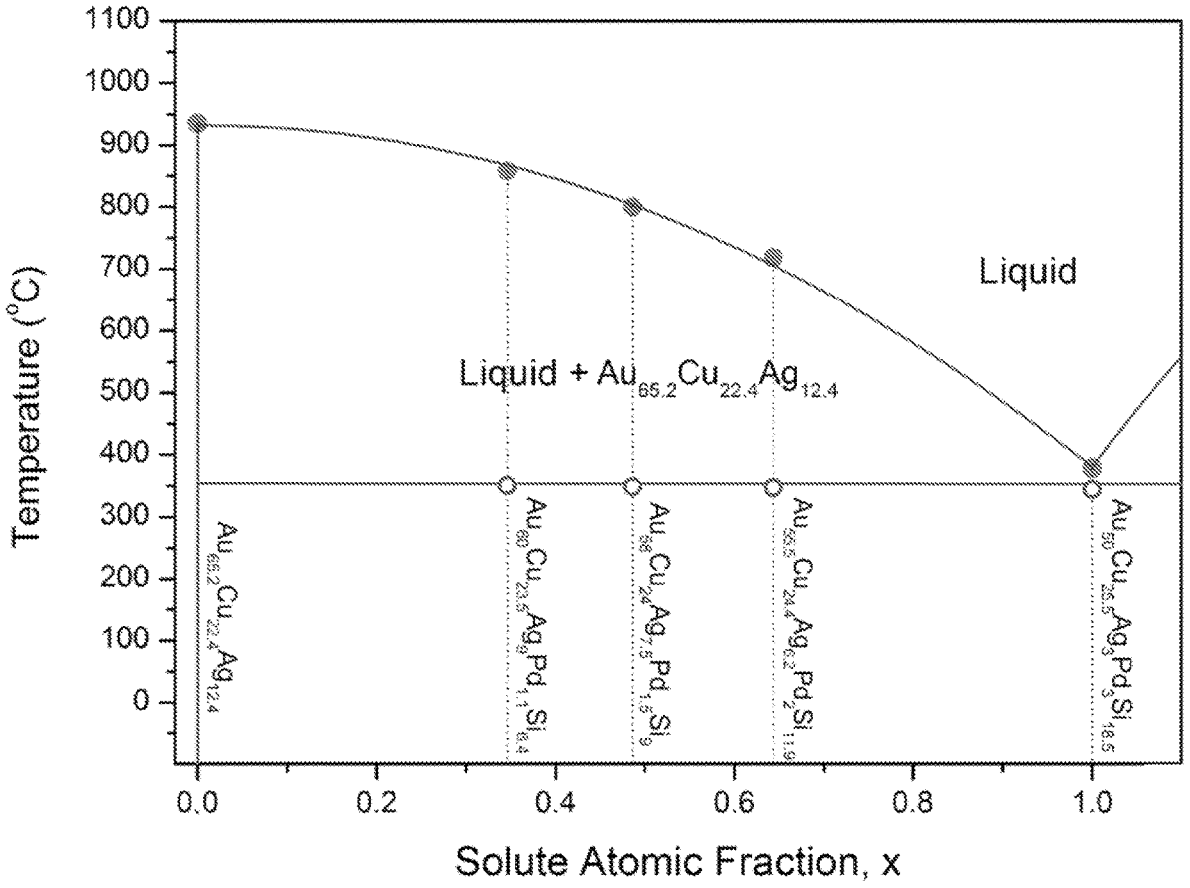
FIG. 13 presents a pseudo-binary eutectic phase diagram corresponding to example gold metallic glass matrix composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2S_{11.9}$ (Examples 3, 1, and 4), along with metallic glass eutectic alloy $Au_{50}Cu_{25.5}Ag_3Pd_3Si_{18.5}$ and primary-Au alloy $Au_{65.2}Cu_{22.4}Ag_{12.4}$.

Recognizing that the gold metallic glass matrix composites of the disclosure are indeed "equilibrium composites" sharing the same Au-primary particulate phase and metallic glass matrix phase, one can use the liquidus and solidus temperature data obtained from calorimetry (Table 3) and construct a pseudo-binary phase diagram along coordinate x, which can be thought to represent the "solute atomic fraction". Specifically, x represents the concentration of "solute" elements Pd and Si in "solvent" $Au_{65.2}Cu_{22.4}Ag_{12.4}$ in accordance with the formula given by EQ. (2). From the calorimetry data of Table 3 one can observe a drastically receding liquidus temperature (from about 950° C. to 375° C.) and a fairly constant solidus temperature (between about 345° C. to 350 C) as x increases from the composition of the primary-Au alloy (x=0) to the composition of the metallic glass alloy is reached (x=1.0), where the liquidus and solidus temperatures roughly merge. As such, one can expect the pseudo-binary phase diagram arising from the data of Table 3 to be a eutectic phase diagram, with the composition of the metallic glass alloy (x=1.0) representing the eutectic composition and the solidus temperatures of the alloys representing the eutectic temperature. The liquidus curve of the pseudo-primary eutectic phase diagram can be obtained by fitting the liquidus temperature data. FIG. 13 presents a pseudo-binary eutectic phase diagram corresponding to example gold metallic glass matrix composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4), along with metallic glass eutectic alloy $Au_{50}Cu_{25.5}Ag_3Pd_3Si_{18.5}$ and primary-Au alloy $Au_{65.2}Cu_{22.4}Ag_{12.4}$.

The solubility of solute elements Pd and and Si in the primary-Au phase $Au_{65.2}Cu_{22.4}Ag_{12.4}$ is shown to be essentially zero. This was verified by producing an alloy according to EQ. (2) having a very small solute concentration of x=0.02, and performing differential scanning calorimetry. The scan of that alloy revealed a very small eutectic melting signal around 345° C., indicating a small amount of eutectic phase present in the alloy. It is interesting to note that the solubility of Si in the face-centered cubic structure of pure metallic Au is also effectively zero (<100 ppm).

Molten alloys with 0<x<1 cooled from the high temperature liquid phase to below the liquidus temperature along the vertical dashed lines will form primary dendrites of the fcc primary-Au phase $Au_{65.2}Cu_{22.4}Ag_{12.4}$. As the alloy continues to cool these dendrites coexist with a liquid whose composition is given by the liquidus curve corresponding to the instantaneous temperature. The two phases, dendrite and liquid, form a semisolid mixture. As cooling proceeds to the eutectic temperature, the liquid composition attains the eutectic composition $Au_{50}Cu_{25.5}Ag_3Pd_3Si_{18.5}$ at x=1.0. The molar fraction of the liquid in the semisolid mixture at any temperature during cooling is determined by the lever rule, and at the eutectic temperature would be exactly equal to x.

One can define partitioning coefficients $z_i$ for each element i in the composite-forming alloy (where i is Au, Cu, Ag, Pd, and Si), as follows:

$$z_i = (\text{at. \% of element } i \text{ in the primary-Au phase})/(\text{at. \% of element } i \text{ in the overall alloy})$$

The composition analysis results along with the composition formula given by EQ. (2), suggest that the partitioning coefficients for Si and Pd in the primary-Au phase of the gold metallic glass matrix composite are essentially zero, that is, $z_{Si}=z_{Pd}=0$. The composition formula of EQ. (2) also suggest that the partitioning coefficients for Au, Cu, and Ag in the primary-Au phase are a function of the solute fraction parameter x characterizing the composite. Specifically, $z_{Au}=65.2/(65.2-15.2x)$, $z_{Cu}=22.4/(22.4+3.1x)$, and $z_{Ag}=12.4/(12.4-9.4x)$. The partitioning coefficients for Au, Cu, and Ag therefore suggest that the primary-Au phase would be slightly enriched in Au, highly enriched in Ag, and slightly depleted in Cu. In one embodiment of a gold metallic glass matrix composite where x=0.35 one obtains $z_{Au}=1.09$, $z_{Cu}=0.95$, $z_{Ag}=3.61$, and $z_{Si}=z_{Pd}=0$. In another embodiment of a gold metallic glass matrix composite where x=0.49 one obtains $z_{Au}$=1.13, $z_{Cu}$=0.94, $z_{Ag}$=3.45, and $z_{Si}$=$z_{Pd}$=0. In yet another embodiment of a gold metallic glass matrix composite where x=0.65 one obtains $z_{Au}$=1.18, $z_{Cu}$=0.92, $z_{Ag}$=3.28, and $z_{Si}$=$z_{Pd}$=0. In embodiments of gold metallic glass matrix composites comprising Zn (e.g. the alloy of Example II), one can estimate that the partitioning coefficient for Zn in the primary-Au phase of the gold metallic glass matrix composite, $z_{Zn}$, is greater than 1. For the specific alloy given in Example II having composition $Au_{56}Cu_{24}Ag_{7.6}Zn_2Pd_{1.5}Si_9$ one can estimate $z_{Zn}$=1.38.

Therefore, in one embodiment of the disclosure, the partitioning coefficient for Si in the primary-Au phase of a gold metallic glass matrix composite is less than 0.2, while in another embodiment less than 0.1, while in yet another embodiment less than 0.05. In one embodiment of the disclosure, the partitioning coefficient for Pd in the primary-Au phase of a gold metallic glass matrix composite is less than 0.2, while in another embodiment less than 0.1, while in yet another embodiment less than 0.05. In one embodiment of the disclosure, the partitioning coefficient for Au in the primary-Au phase of a gold metallic glass matrix composite is greater than 1, while in another embodiment is in the range of 0.9 to 1.5, while in yet another embodiment is in the range of 1 to 1.3. In one embodiment of the disclosure, the partitioning coefficient for Cu in the primary-Au phase of a gold metallic glass matrix composite is less than 1, while in another embodiment is in the range of 0.6 to 1.1, while in yet another embodiment is in the range of 0.8 to 1. In one embodiment of the disclosure, the partitioning coefficient for Ag in the primary-Au phase of a gold metallic glass matrix composite is greater than 1, while in another embodiment is in the range of 2 to 5, while in yet another embodiment is in the range of 3 to 4. In one embodiment of the disclosure, the partitioning coefficient for Zn in the primary-Au phase of a gold metallic glass matrix composite is greater than 1, while in another embodiment is in the range of 0.95 to 3, while in yet another embodiment is in the range of 1 to 2.

The equilibrium phase diagram presented in FIG. 13 and the partitioning coefficient analysis presented above are useful to predict the respective compositions and molar fractions of liquid and primary phase obtained in a liquid cooled from high initial temperature is cooled slowly enough to achieve chemical equilibrium conditions in the semi-solid mixture. In certain embodiments, the cooling rate during processing of the gold metallic glass matrix composite processing may be very high such that chemical equilibrium may not be fully established. In this case, liquid composition will tend to deviate from that predicted by the equilibrium diagram in a manner that reflects less partitioning of the solute elements.

The ratio of the heat of crystallization of the metallic glass phase $\Delta H_x$ to the heat of crystallization of the monolithic metallic glass $\Delta H_{x,g}$, i.e. $\Delta H_x/\Delta H_{x,g}$, is thought to be a semi-quantitative measure of the molar fraction of the metallic glass phase in the composite. As such, one may expect the $\Delta H_x/\Delta H_{x,g}$ of the composite to roughly match the respective x value of the composite. The heat of crystallization of the metallic glass phase $\Delta H_x$ in the three example gold metallic glass matrix composites $Au_{60}Cu_{23.5}Ag_9Pd_{1.1.5}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ (Examples 3, 1, and 4), along with metallic glass eutectic alloy $Au_{50}Cu_{25.5}Ag_3Pd_3Si_{18.5}$, are listed in Table 4. The ratio $\Delta H_x/\Delta H_{x,g}$, is also listed for each alloy in Table 4. As seen, $\Delta H_{x,g}$ is equal to −32.2 J/g, while $\Delta H_x/\Delta H_{x,g}$ is equal to 0.18, 0.30, and 0.51 for composites $Au_{60}Cu_{23.5}Ag_9Pd_{1.1}Si_{6.4}$, $Au_{58}Cu_{24}Ag_{7.5}Pd_{1.5}Si_9$, and $Au_{55.5}Cu_{24.4}Ag_{6.2}Pd_2Si_{11.9}$ corresponding to x values of 0.35, 0.49, 0.65. These suggest a molar fraction of the metallic glass of about 0.18, 0.30, and 0.51 for the three composites. These values are slightly lower than molar fractions suggested by the respective x values of 0.35, 0.49, 0.65. But, one should consider that the $\Delta H_x$ values obtained from calorimetry may have errors associated with them, mostly due to a difficulty in correctly tracking the base line of the scan before and after the crystallization event.

TABLE 4

The heat of crystallization of the metallic glass phase $\Delta H_x$ and ratio $\Delta H_x/\Delta H_{x,g}$ for alloy compositions according to EQ. (2) corresponding to x values of 0.35, 0.49, 0.65, and 1.

| Example | Composition (at. %) | x (at. %) | $\Delta H_x$ (J/g) | $\Delta H_x/\Delta H_{x,g}$ |
|---|---|---|---|---|
| 3 | $Au_{60}Cu_{23.5}Ag_9Pd_{1.1}Si_{6.4}$ | 0.35 | −5.7 | 0.18 |
| 1 | $Au_{58}Cu_{24}Ag_{7.5}Pd_{1.5}Si_9$ | 0.49 | −9.6 | 0.30 |
| 4 | $Au_{55.5}Cu_{24.4}Ag_{6.2}Pd_2Si_{11.9}$ | 0.65 | −16.3 | 0.51 |
| N/A | $Au_{50}Cu_{25.5}Ag_3Pd_3Si_{18.5}$ | 1 | −32.2 | 1 |

EXAMPLE IV

Effect of Semi-Solid Processing on the Microstructure of Gold Metallic Glass Matrix Composites The effect of semi-solid processing on the microstructure of gold metallic glass matrix composites is investigated. Example metallic glass matrix composite $Au_{59.5}Cu_{24}Ag_7Pd_{11.5}Si_8$ is processed in the semi-solid state. Specifically the alloy is processing by heating the alloy to 950° C., which is above the liquidus temperature of the alloy, to obtain an equilibrium melt, cooling the melt to 650° C., which is within the "semi-solid" region of the alloy (i.e. between the liquidus and the eutectic temperature of the alloy) to form a "semi-solid", holding the semi-solid isothermally at 650° C. for approximately 300 s, and subsequently cooling the semi-solid to room temperature, which is below the glass-transition temperature of the metallic glass phase, sufficiently rapidly to form the metallic glass matrix composite. The critical rod diameter of example metallic glass matrix composite $Au_{59.5}Cu_{24}Ag_7Pd_{1.5}Si_8$ processed according to the semi-solid processing method described above is found to be 3 mm.

Figure 14:
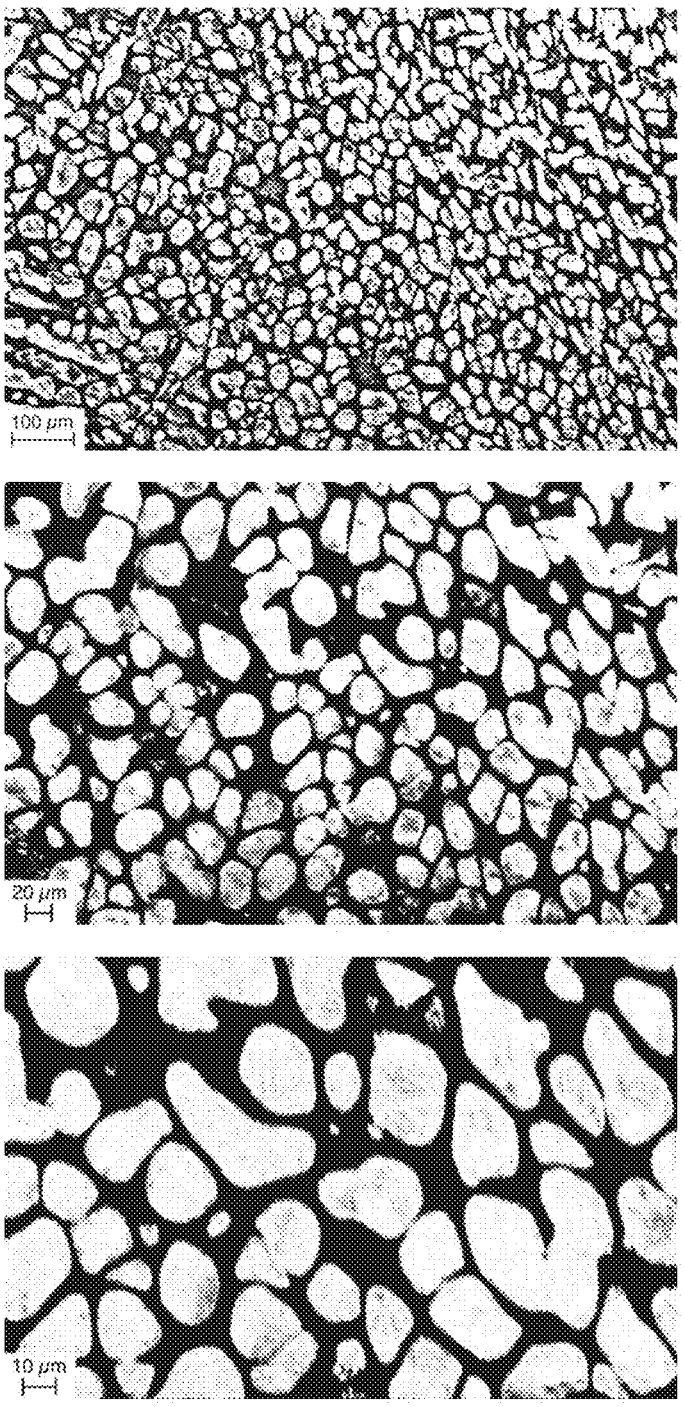
FIG. 14 presents micrographs showing the microstructure of example metallic glass matrix composite $Au_{59.5}Cu_{24}Ag_7Pd_{1.5}Si_8$ in three different magnifications.

The microstructure of example metallic glass matrix composite $Au_{59.5}Cu_{24}Ag_7Pd_{11.5}Si_8$ processed in the semi-solid state is investigated using scanning electron microscopy. FIG. 14 presents micrographs showing the microstructure of $Au_{59.5}Cu_{24}Ag_7Pd_{1.5}Si_8$ over a radial cross section of a rod produced by semi-solid processing as described above, in three different magnifications. The micrographs reveal that the microstructure of the composite comprises two phases. The darker colored phase represents the metallic glass matrix phase while the light colored phase represents the primary-Au particulate phase. No other phase is detectable in the micrographs, thereby verifying that this composite is a metallic glass matrix composite comprising a primary-Au crystalline phase and a metallic glass phase and is free of any other phase. The micrographs also reveal that the primary-Au particulates have a dendritic shape and are distributed uniformly and homogeneously through the metallic glass matrix. The dendrite trunks appear to have developed radially along the direction of the temperature gradient established by the quench of the sample. Lastly, the micrographs reveal that the average microstructural feature size appears to be between 10 and 40 μm. Specifically, the average dendrite arm diameter appears to be approximately between 20 and 30 μm while the average interdendritic spacing appears to be approximately between 15 and 25 μm. These morphological features are coarser than those of metallic glass matrix composites that have been processed by direct melt quenching (e.g. FIGS. 3-5 and 8). This relatively coarse yet uniform microstructure is a consequence of processing the composites in the semi-solid state.

EXAMPLE V

Color of Gold Metallic Glass Matrix Composite

Figure 15:
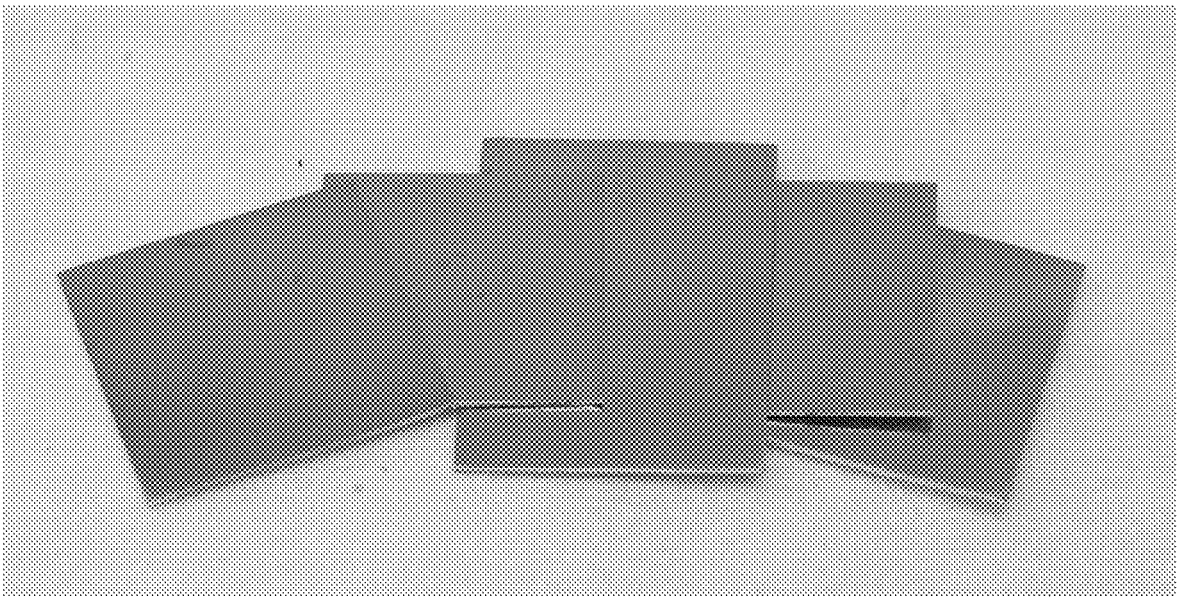
FIG. 15 presents a photograph of plate coupons of metallic glass $Au_{50}Cu_{25.5}Ag_3Pd_3Si_{18.5}$ (x=1.0), composites $Au_{55.5}Cu_{24.4}Ag_{6.2}Pd_2Si_{11.9}$ (x=0.65; Example 4) $Au_{58}Cu_{24}Ag_{7.5}Pd_{1.5}Si_9$ (x=0.49; Example 1), and $Au_{60}Cu_{23.5}Ag_9Pd_{1.1}Si_{6.4}$ (x=0.35; Example 3), and primary-Au alloy $Au_{65.2}Cu_{22.4}Ag_{12.4}$ (x=0) (from left to right).

Plate coupons of metallic glass $Au_{50}Cu_{25.5}Ag_3Pd_3Si_{18.5}$ (x=1.0), composites $Au_{55.5}Cu_{24.4}Ag_{6.2}Pd_2Si_{11.9}$ (x=0.65; Example 4) $Au_{58}Cu_{24}Ag_{7.5}Pd_{1.5}Si_9$ (x=0.49; Example 1), and $Au_{60}Cu_{23.5}Ag_9Pd_{1.1}Si_{6.4}$ (x=0.35; Example 3), and primary-Au alloy $Au_{65.2}Cu_{22.4}Ag_{12.4}$ (x=0) of approximate dimensions of 20 mm×20 mm×0.5 mm are shown in FIG. 15 (from left to right). The plate coupons were processed by directly quenching the high temperature equilibrium melt contained in a rectangular quartz ampule having 0.5 mm thick walls in room temperature water. The plate coupons shown in FIG. 15 reveal that the microstructure of the composites is visually unresolved, as the surface color of the composites appears uniform (visually not different than the surface color of the crystalline and metallic glass plate coupons). The color of the alloys from left to right transitions from the metallic/silver color of the metallic glass alloy to the yellow-gold color of the primary-Au alloy, with the composites displaying an increasingly yellower color as x decreases from 1 to 0 (the color transition is not obvious in a greyscale image). The CIELAB color coordinates of the composites having compositions according to EQ. (2) characterized by x of 0.35, 0.49, and 0.65), along with the coordinates of the primary-Au phase alloy characterized by x=0 and of the metallic glass phase alloy characterized by x=1.0, as measured in color-space by an optical spectrophotometer on plate coupons, are presented in Table 5.

TABLE 5

CIELAB color coordinates of alloys having compositions according to EQ. (2) corresponding to x values of 0, 0.35, 0.49, 0.65, and 1.

| Example | Composition (at. %) | x | L* | a* | b* |
|---|---|---|---|---|---|
| N/A | $Au_{65.2}Cu_{22.4}Ag_{12.4}$ | 0 | 86.87 | 6.72 | 24.96 |
| 3 | $Au_{60}Cu_{23.5}Ag_9Pd_{1.1}Si_{6.4}$ | 0.35 | 84.73 | 4.79 | 18.71 |
| 1 | $Au_{58}Cu_{24}Ag_{7.5}Pd_{1.5}Si_9$ | 0.49 | 85.06 | 2.80 | 15.80 |
| 4 | $Au_{55.5}Cu_{24.4}Ag_{6.2}Pd_2Si_{11.9}$ | 0.65 | 84.22 | 2.94 | 13.75 |
| N/A | $Au_{50}Cu_{25.5}Ag_3Pd_3Si_{18.5}$ | 1 | 82.55 | 0.97 | 7.77 |

The CIELAB coordinates of the ternary $Au_{65.2}Cu_{22.4}Ag_{12.4}$ primary-Au phase shown in Table 5 appear consistent with a yellow/yellowish color. The primary-Au phase has composition in weight percent of $Au_{82.3}Cu_{9.1}Ag_{8.6}$. The composition $Au_{82.3}Cu_{9.1}Ag_{8.6}$ (wt. %), which is approximately represented by triangular grid lines superimposed on the chromaticity phase diagram of FIG. 1, appears to roughly lie in the center of the yellow color region. This demonstrates that the color of the primary-Au phase of the composite has been fixed by the choice of the Ag and Cu concentrations to a custom yellow color. In principle, by choosing different Cu and Ag concentrations one may potentially achieve any color in the chromaticity phase diagram of FIG. 1. In one example, increasing the Ag content at the expense of Cu while keeping the Au content unchanged in $Au_{82.3}Cu_{9.1}Ag_{8.6}$ (wt. %) may transform its yellow color to a green yellow. In another example, increasing the Cu content at the expense of Ag while keeping the Au content unchanged in $Au_{82.3}Cu_{9.1}Ag_{8.6}$ (wt. %) may transform its yellow color to a reddish color.

The CIELAB coordinates of the $Au_{50}Cu_{25.5}Ag_3Pd_3Si_{18.5}$ metallic glass phase shown in Table 5 appear consistent with a pale white color. The pale white color is mostly a consequence of a high Si content along with modest Pd content, as both Si and Pd are known to "bleach" the color of gold alloys. Changing the concentrations of Cu and Ag in the overall alloy in order to influence the color of the primary-Au phase, as discussed above, may have little impact on the color of the metallic glass phase, which likely may remain pale white due to the presence of Si and Pd.

In general, CIELAB coordinate L*, which quantifies the "luminosity" or "reflectivity" of the alloy, is shown in Table 5 to decrease slightly with increasing x. A plot of L* vs. x is presented in FIG. 16. As seen, L* decreases roughly monotonically from 87.43 characterizing the primary-Au alloy (x=0) to 82.55 characterizing the metallic glass alloy (x=1.0). These are relatively high L* values within a range of 0.8 to 0.9, suggesting that all alloys are highly reflective at all wavelengths of visible light, and as such, they can be characterized as having a bright appearance. Nonetheless, the reflectivity slightly decreases as the molar (or volume) fraction of the metallic glass phase increases from 0 (pure primary-Au phase) to 1 (pure metallic glass phase).

Therefore, in one embodiment, the composite has a color characterized by CIELAB coordinate L* in the range of 65 to 100. In another embodiment, the composite has a color characterized by CIELAB coordinate L* in the range of 70 to 100. In another embodiment, the composite has a color characterized by CIELAB coordinate L* in the range of 72.5 to 97.5. In another embodiment, the composite has a color characterized by CIELAB coordinate L* in the range of 75 to 95. In another embodiment, the composite has a color characterized by CIELAB coordinate L* in the range of 77.5 to 92.5. In yet another embodiment, the composite has a color characterized by CIELAB coordinate L* in the range of 80 to 90.

CIELAB coordinate a*, which quantifies the "red-green" chromaticity of the alloy, is shown in Table 5 to decrease with increasing x. A plot of a* vs. x is presented in FIG. 16. As seen, a* decreases roughly monotonically from 6.72 characterizing the primary-Au alloy (x=0) to 0.97 characterizing the metallic glass alloy (x=1.0).

Therefore, in one embodiment, the composite has a color characterized by CIELAB coordinate a* in the range of −5 to 15. In another embodiment, the composite has a color characterized by CIELAB coordinate a* in the range of −4 to 12. In another embodiment, the composite has a color characterized by CIELAB coordinate a* in the range of −3 to 11. In another embodiment, the composite has a color characterized by CIELAB coordinate a* in the range of −2 to 10. In another embodiment, the composite has a color characterized by CIELAB coordinate a* in the range of −1 to 9. In yet another embodiment, the composite has a color characterized by CIELAB coordinate a* in the range of 0 to 8.

CIELAB coordinate b*, which quantifies the "blue-yellow" chromaticity of the alloy, is shown in Table 5 to decrease significantly with increasing x. A plot of b* vs. x is presented in FIG. 16. As seen, b* decreases roughly monotonically from 24.96 characterizing the primary-Au alloy (x=0) to 7.77 characterizing the metallic glass alloy (x=1.0). Therefore, it is shown that by varying x from 0 to 1 which essentially amounts to varying the molar (or volume) fraction of the metallic glass phase in the composite from 0% to 100%, one may control the yellow chromaticity of the composite by varying the CIELAB b* coordinate over a broad range from about 7 to about 25. Hence, if a certain yellow chromaticity is desired within a certain b* range, one may meet that specification by designing a composite alloy having a certain x value according to EQ. (2).

Therefore, in one embodiment, the composite has a color characterized by CIELAB coordinate b* in the range of 0 to 40. In another embodiment, the composite has a color characterized by CIELAB coordinate b* in the range of 0 to 35. In another embodiment, the composite has a color characterized by CIELAB coordinate b* in the range of 0 to 30. In another embodiment, the composite has a color characterized by CIELAB coordinate b* in the range of 2.5 to 40. In another embodiment, the composite has a color characterized by CIELAB coordinate b* in the range of 2.5 to 35. In another embodiment, the composite has a color characterized by CIELAB coordinate b* in the range of 2.5 to 30. In another embodiment, the composite has a color characterized by CIELAB coordinate b* in the range of 5 to 40. In another embodiment, the composite has a color characterized by CIELAB coordinate b* in the range of 5 to 35. In yet another embodiment, the composite has a color characterized by CIELAB coordinate b* in the range of 5 to 30.

Figure 16:
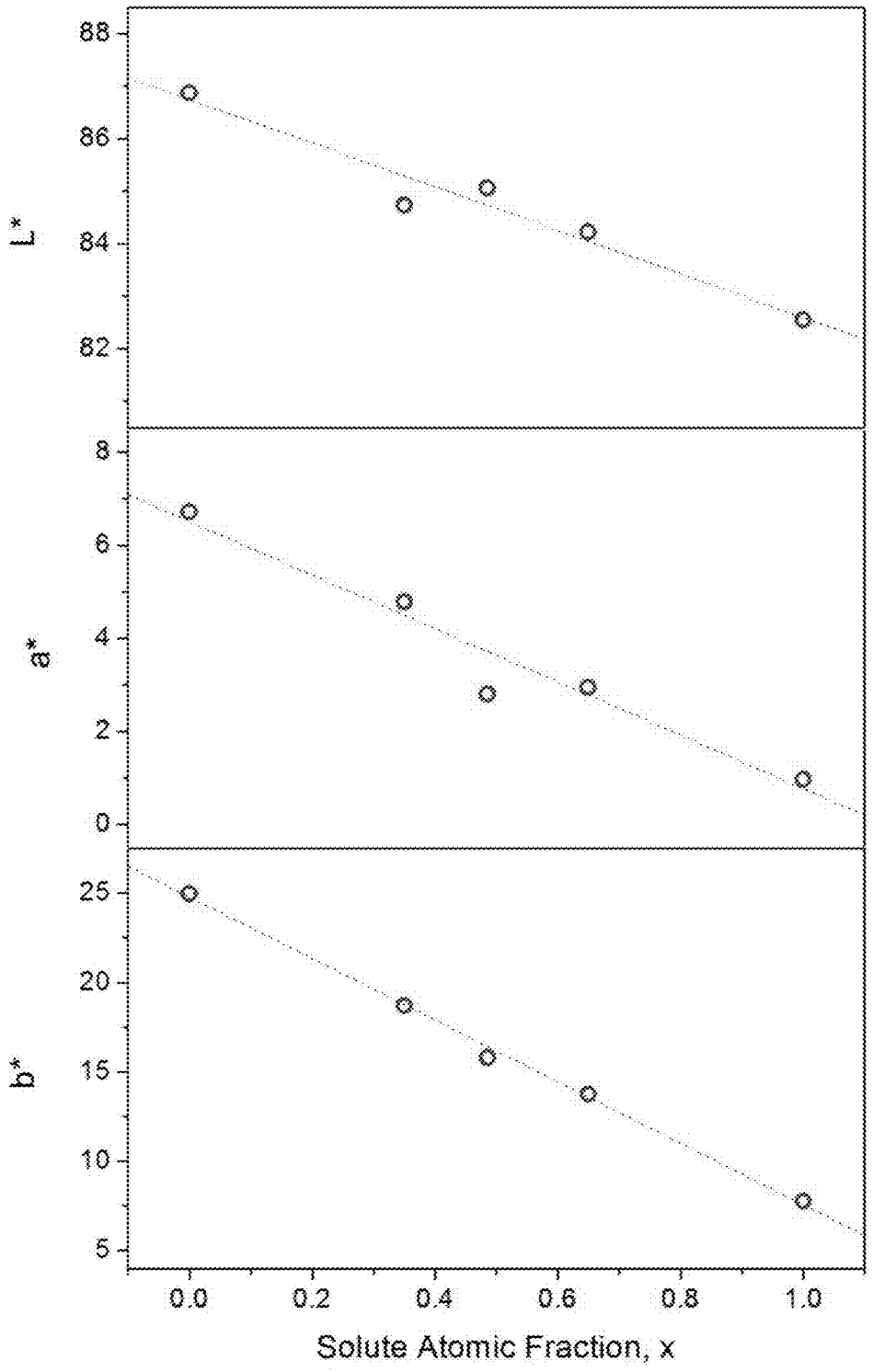
FIG. 16 presents a plot of CIELAB color coordinates L*, a*, and b* against the solute fraction parameter x for the composites having compositions according to EQ. (2) characterized by x of 0.35, 0.49, and 0.65, for the primary-Au phase alloy characterized by x=0, and for the metallic glass phase alloy characterized by x=1.0.

The roughly linear dependencies of CIELAB coordinates L*, a*, and b* against x revealed in FIG. 16 suggest that the overall color of the composite follows the rule of mixtures, which further implies that the microstructures of the composites are indeed visually unresolved. As such, one may use a linear interpolation between the overall color of the composite and the colors of the primary-Au and metallic glass phases to determine the volume fractions of the phases in the composite. Hence, the volume fraction of the metallic glass may in principle be determined from the L* coordinate of the composite as $(L^*-L_c^*)/(L_g^*-L_c^*)$, from the a* coordinate of the composite as $(a^*-a_c^*)/(a_g^*-a_c^*)$, and from the b* coordinate of the composite as $(b^*-b_c^*)/(b_g^*-b_c^*)$, where $a_g^*$, $b_g^*$, and $L_g^*$ are CIELAB coordinates of the metallic glass matrix phase of the composite, and $a_c^*$, $b_c^*$, and $L_c^*$ are CIELAB coordinates of the primary-Au phase of the composite.

Following this approach, the volume fraction of the metallic glass phase in composite $Au_{60}Cu_{23.5}Ag_9Pd_{1.1}Si_{6.4}$ (Example 3) suggested by its L* coordinate is 50%, the volume fraction suggested by its a* coordinate is 34%, while the volume fraction suggested by its b* coordinate is 40%. Hence, the average volume fraction of the metallic glass phase in $Au_{60}Cu_{23.5}Ag_9Pd_{1.1}Si_{6.4}$ (Example 3) suggested by its CIELAB coordinates is 40%, close to the molar fraction suggested by its x value of 0.35. For composite $Au_{58}Cu_{24}Ag_{7.5}Pd_{1.5}Si_9$ (Example 1), the volume fraction of the metallic glass phase suggested by its L* coordinate is 42%, the volume fraction suggested by its a* coordinate is 68%, while the volume fraction suggested by its b* coordinate is 53%. Hence, the average volume fraction of the metallic glass phase in $Au_{58}Cu_{24}Ag_{7.5}Pd_{1.5}Si_9$ (Example 1) suggested by its CIELAB coordinates is 54%, close to the molar fraction suggested by its x value of 0.49. For composite $Au_{55.5}Cu_{24.4}Ag_{6.2}Pd_2Si_{11.9}$ (Example 4), the volume fraction of the metallic glass phase suggested by its L* coordinate is 61%, the volume fraction suggested by its a* coordinate is 66%, while the volume fraction suggested by its b* coordinate is 65%. Hence, the average volume fraction of the metallic glass phase in $Au_{55.5}Cu_{24.4}Ag_{6.2}Pd_2Si_{11.9}$ (Example 4) suggested by its CIELAB coordinates is 64%, close to the molar fraction suggested by its x value of 0.65.

Therefore, in some embodiments, the Au-based metallic glass matrix composite has a color characterized by CIELAB coordinates a*, b*, and L* where:

$$0.75\cdot(xa_g^*+(1-x)a_c^*)<a^*<1.25\cdot(xa_g^*+(1-x)a_c^*),$$

$$0.75\cdot(xb_g^*+(1-x)b_c^*)<b^*<1.25\cdot(xb_g^*+(1-x)b_c^*),$$

$$0.75\cdot(xL_g^*+(1-x)L_c^*)<L^*<1.25\cdot(xL_g^*+(1-x)L_c^*);$$

where $x=(e-e_c)/e_g$, where e is the nominal atomic concentration of Si in the overall alloy, $e_c$ is the atomic concentration of Si in the primary-Au phase, and $e_g$ is the atomic concentration of Si in the metallic glass phase;

where $a_c^*$, $b_c^*$, and $L_c^*$ are the CIELAB coordinates characterizing the color of the primary-Au crystalline phase;

and where $a_g^*$, $b_g^*$, and $L_g^*$ are the CIELAB coordinates characterizing the color of the metallic glass phase.

In one embodiment, $x=e/e_g$. In another embodiment, x=e/18.5%.

EXAMPLE VI

Hardness of Gold Metallic Glass Matrix Composites

Figure 17:
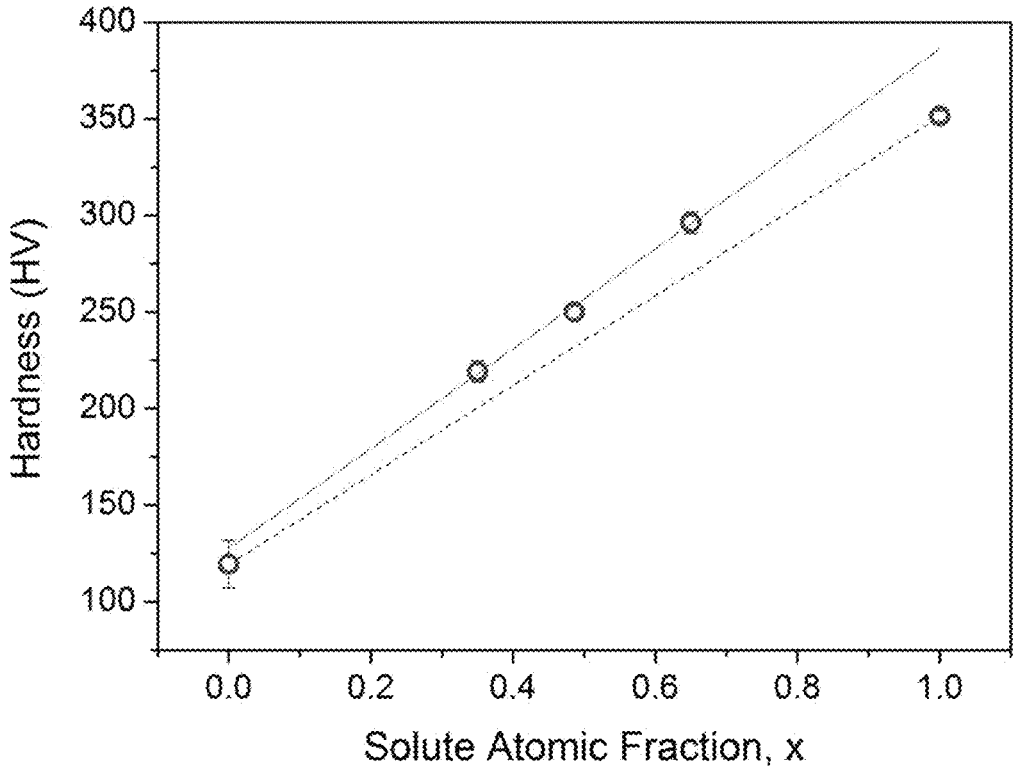
FIG. 17 presents a plot of the Vickers hardness against the solute fraction parameter x for the composites having compositions according to EQ. (2) characterized by x of 0.35, 0.49, and 0.65, for the primary-Au phase alloy characterized by x=0, and for the metallic glass phase alloy characterized by x=1.0. Data are presented with round symbols, with error bars representing the variance. The solid line is a linear regression through the three data corresponding to the composites, while the dotted line represents the relationship expected from a linear rule of mixtures.

The Vickers hardness of metallic glass matrix composites was investigated by measuring the Vickers hardness of the composites. The measurements were performed on a flat and polished cross section of 2 mm diameter rods of the composites processed by direct cooling of the equilibrium melt. An indenter having a width that is considerably larger than the average microstructural feature size of the composites was used. The Vickers hardness of composites having compositions according to EQ. (2) characterized by x of 0.35, 0.49, and 0.65, along with the Vickers hardness of the primary-Au phase alloy characterized by x=0 and of the metallic glass phase alloy characterized by x=1.0, as measured by a Vickers hardness tester on rod cross sections, are presented in Table 6. FIG. 17 presents a plot of the Vickers hardness against the solute fraction parameter x for the composites having compositions according to EQ. (2) characterized by x of 0.35, 0.49, and 0.65, for the primary-Au phase alloy characterized by x=0, and for the metallic glass phase alloy characterized by x=1.0. Data are presented with round symbols, with error bars representing the variance. The solid line is a linear regression through the three data corresponding to the composites, while the dotted line represents the relationship expected from a linear rule of mixtures.

TABLE 6

Vickers hardness of alloys having compositions according to EQ. (2) corresponding to x values of 0, 0.35, 0.49, 0.65, and 1.

| Example | Composition (at. %) | x | Hardness (HV) |
|---|---|---|---|
| N/A | $Au_{65.2}Cu_{22.4}Ag_{12.4}$ | 0 | 119.5 ± 12.3 |
| 3 | $Au_{60}Cu_{23.5}Ag_9Pd_{1.1}Si_{6.4}$ | 0.35 | 219.5 ± 5.5 |
| 1 | $Au_{58}Cu_{24}Ag_{7.5}Pd_{1.5}Si_9$ | 0.49 | 250.1 ± 3.2 |
| 4 | $Au_{55.5}Cu_{24.4}Ag_{6.2}Pd_2Si_{11.9}$ | 0.65 | 296.3 ± 5.5 |
| N/A | $Au_{50}Cu_{25.5}Ag_3Pd_3Si_{18.5}$ | 1 | 351.4 ± 2.7 |

As seen in Table 6 and FIG. 17, the hardness of the composites increases monotonically with increasing x, from 119.5 HV, corresponding to the primary-Au phase associated with x=0, to 351.4 HV, corresponding to the metallic glass phase associated by x=1.0. It is important to note that, as shown in FIG. 17, the hardness values of the composites are higher than those expected from a linear rule of mixtures. Specifically, according to a linear rule of mixtures, the hardness of a composite comprising a primary-Au phase with hardness of $HV_c$=119.5 HV and a metallic glass phase with hardness of $HV_g$=351.4 HV, would be 200.7 HV if the volume fraction of the metallic glass phase is 35%, 233.1 HV if the volume fraction of the metallic glass phase is 49%, and 270.2 HV if the volume fraction of the metallic glass phase is 65%. However, assuming that volume fractions are roughly equal to molar fractions (i.e. the molar volumes of the primary-Au and metallic glass phases are roughly equal), the hardness of a composite having a molar fraction of the metallic glass phase of 35% (i.e. x=0.35) is 219.5 HV, that of a composite having a molar fraction of the metallic glass phase of 49% (i.e. x=0.49) is 250.1 HV, and that of a composite having a molar fraction of the metallic glass phase of 65% (i.e. x=0.65) is 296.3 HV. Thus, assuming that volume fractions are roughly equal to molar fractions, the hardness of a gold metallic glass matrix composite appears to be about 10% higher than that predicted by a linear rule of mixtures.

Table 7 lists the Vickers hardness of Au—Cu—Ag—Pd—Si and Au—Cu—Ag—Zn—Pd—Si gold metallic glass matrix composites. As seen in Table 7, substituting 2 atomic percent of Au by Zn in Au—Cu—Ag—Pd—Si metallic glass matrix composites results in a large increase in hardness. Specifically, the hardness increases from 250.1 HV for metallic glass matrix composite $Au_{58}Cu_{24}Ag_{7.5}Pd_{1.5}Si_9$ (Example 1) to 294.4 HV for metallic glass matrix composite $Au_{56}Cu_{24}Ag_{7.5}Zn_2Pd_{1.5}Si_9$ (Example 2).

TABLE 7

Vickers hardness of Au—Cu—Ag—Pd—Si and Au—Cu—Ag—Zn—Pd—Si composites.

| Example | Composition | Hardness |
|---|---|---|
| 1 | $Au_{58}Cu_{24}Ag_{7.5}Pd_{1.5}Si_9$ | 250.1 ± 3.2 HV |
| 2 | $Au_{56}Cu_{24}Ag_{7.5}Zn_2Pd_{1.5}Si_9$ | 294.4 ± 4.4 HV |

In various embodiments of the present disclosure the hardness of gold metallic glass matrix composites is in the range of 125 to 350 HV. In one embodiment, the hardness of gold metallic glass matrix composites is in the range of 150 to 350 HV. In another embodiment, the hardness of gold metallic glass matrix composites is in the range of 175 to 350 HV. In yet another embodiments, the hardness of gold metallic glass matrix composites is in the range of 200 to 325 HV.

In other embodiments, the hardness of gold metallic glass matrix composites is at least as high as that predicted by a linear rule of mixture between the primary-Au and metallic glass phases. In one embodiment, the hardness of gold metallic glass matrix composites is higher than that predicted by a linear rule of mixture between the primary-Au and metallic glass phases. In another embodiment, the hardness of gold metallic glass matrix composites is higher than that predicted by a linear rule of mixture between the primary-Au and metallic glass phases by at least 5%. In another embodiment, the hardness of gold metallic glass matrix composites is higher than that predicted by a linear rule of mixture between the primary-Au and metallic glass phases by at least 10%. In yet another embodiment, the hardness of gold metallic glass matrix composites is higher than that predicted by a linear rule of mixture between the primary-Au and metallic glass phases by at least 15%.

In one embodiment, the gold metallic glass matrix composite comprises Si at an atomic concentration of at least 4 percent, and where the hardness of the gold metallic glass matrix composites is at least 200 HV. In another embodiment, the gold metallic glass matrix composite comprises Si at an atomic concentration of at least 6 percent, and where the hardness of the gold metallic glass matrix composites is at least 220 HV. In another embodiment, the gold metallic glass matrix composite comprises Si at an atomic concentration of at least 8 percent, and where the hardness of the gold metallic glass matrix composites is at least 240 HV. In another embodiment, the gold metallic glass matrix composite comprises Si at an atomic concentration of at least 10 percent, and where the hardness of the gold metallic glass matrix composites is at least 260 HV. In another embodiment, the gold metallic glass matrix composite comprises Si at an atomic concentration of at least 12 percent, and where the hardness of the gold metallic glass matrix composites is at least 280 HV.

In one embodiment, the molar fraction of the gold metallic glass matrix composite is at least 20%, and where the hardness of the gold metallic glass matrix composites is at least 140 HV. In another embodiment, the molar fraction of the gold metallic glass matrix composite is at least 35%, and where the hardness of the gold metallic glass matrix composites is at least 180 HV. In another embodiment, the molar fraction of the gold metallic glass matrix composite is at least 50%, and where the hardness of the gold metallic glass matrix composites is at least 220 HV. In another embodiment, the molar fraction of the gold metallic glass matrix composite is at least 65%, and where the hardness of the gold metallic glass matrix composites is at least 260 HV. In yet another embodiment, the molar fraction of the gold metallic glass matrix composite is at least 80%, and where the hardness of the gold metallic glass matrix composites is at least 300 HV.

In one embodiment, the gold metallic glass matrix composite comprises Si at an atomic concentration of at least 4 percent and Zn at an atomic concentration of at least 0.5 percent, and where the hardness of the gold metallic glass matrix composites is at least 220 HV. In another embodiment, the gold metallic glass matrix composite comprises Si at an atomic concentration of at least 6 percent and Zn at an atomic concentration of at least 0.5 percent, and where the hardness of the gold metallic glass matrix composites is at least 240 HV. In another embodiment, the gold metallic glass matrix composite comprises Si at an atomic concentration of at least 8 percent and Zn at an atomic concentration of at least 0.5 percent, and where the hardness of the gold metallic glass matrix composites is at least 260 HV. In another embodiment, the gold metallic glass matrix composite comprises Si at an atomic concentration of at least 10 percent and Zn at an atomic concentration of at least 0.5 percent, and where the hardness of the gold metallic glass matrix composites is at least 280 HV. In another embodiment, the gold metallic glass matrix composite comprises Si at an atomic concentration of at least 12 percent and Zn at an atomic concentration of at least 0.5 percent, and where the hardness of the gold metallic glass matrix composites is at least 300 HV.

In one embodiment, the gold metallic glass matrix composite comprises Zn at an atomic concentration of at least 0.5 percent, the molar fraction of the gold metallic glass matrix composite is at least 20%, and where the hardness of the gold metallic glass matrix composites is at least 160 HV. In another embodiment, the gold metallic glass matrix composite comprises Zn at an atomic concentration of at least 0.5 percent, the molar fraction of the gold metallic glass matrix composite is at least 35%, and where the hardness of the gold metallic glass matrix composites is at least 200 HV. In another embodiment, the gold metallic glass matrix composite comprises Zn at an atomic concentration of at least 0.5 percent, the molar fraction of the gold metallic glass matrix composite is at least 50%, and where the hardness of the gold metallic glass matrix composites is at least 240 HV. In another embodiment, the gold metallic glass matrix composite comprises Zn at an atomic concentration of at least 0.5 percent, the molar fraction of the gold metallic glass matrix composite is at least 65%, and where the hardness of the gold metallic glass matrix composites is at least 280 HV. In yet another embodiment, the gold metallic glass matrix composite comprises Zn at an atomic concentration of at least 0.5 percent, the molar fraction of the gold metallic glass matrix composite is at least 80%, and where the hardness of the gold metallic glass matrix composites is at least 320 HV.

EXAMPLE VII

Plastic Zone Size of the Metallic Glass Matrix Phase

To estimate the plastic zone size of the metallic glass matrix phase of a gold metallic glass matrix composite, the plane-strain critical stress intensity factor $K_{IC}$ and the tensile yield strength $\sigma_y$ should be measured on a macroscopic sample of the monolithic metallic glass phase. The plastic zone size can then be estimated as $R_p=K_{IC}^2/(6\pi\sigma_y^2)$.

The tensile yield strength of the monolithic metallic glass matrix phase of a gold metallic glass matrix composite having composition $Au_{50}Cu_{25.5}Ag_3Pd_3Si_{18.5}$ (corresponding to x=1.0 in the formula of EQ. (2)) is determined to be $\sigma_y$=1156 MPa (See Example IX below).

The plane-strain critical stress intensity factor $K_{IC}$ is evaluated using notch toughness measurements in a single-edge-notch bending geometry. Strictly speaking, the $K_{IC}$ should correspond to the value measured in the presence of an infinitely sharp crack. In the present work however, $K_{IC}$ was approximated by measuring the stress intensity factors $K_Q$ corresponding to increasingly sharper notches (i.e. increasingly smaller notch root radius $r_n$), and extrapolating the dependence of $K_Q$ on $r_n$ to determine the $K_Q$ value corresponding to $r_n\approx 0$. That is, $K_{IC}\approx K_Q(r_n\approx 0)$. Four different notch root radii $r_n$ were considered: 25, 100, 140, and 420 micrometers. The $K_Q$ values (and associated errors) corresponding to each of these notch root radii are listed in Table 8.

TABLE 8

Notch toughness $K_Q$ (and associated error) as a function of notch root radius $r_n$ for the metallic glass matrix alloy having composition $Au_{50}Cu_{25.5}Ag_3Pd_3Si_{18.5}$ (corresponding to x = 1.0 in the formula of EQ. (2).

| Notch Root Radius, $r_n$ [μm] | Notch Toughness, $K_Q$ [MPa $m^{1/2}$] |
|---|---|
| 25 | 25.5 ± 1.7 |
| 100 | 27.0 ± 1.9 |
| 140 | 30.1 ± 2.0 |
| 420 | 35.5 |

Figure 18:
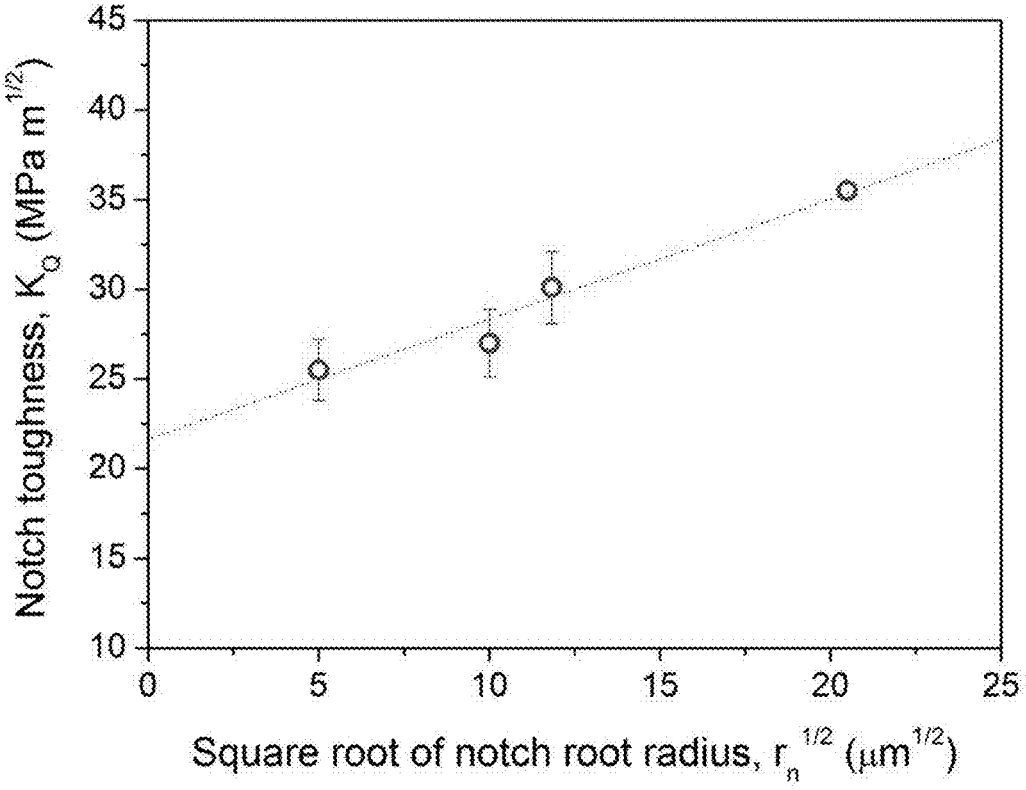
FIG. 18 presents a plot of the notch toughness $K_Q$ (and associated error) against the square root of the notch root radius $\sqrt{r_n}$ for the metallic glass matrix alloy having composition $Au_{50}Cu_{25.5}Ag_3Pd_3Si_{18.5}$ (corresponding to x=1.0 in the formula of EQ. (2).

The dependence of the notch toughness $K_Q$ on root radius $r_n$ is known to follow a square-root law, that is, $K_Q \sim \sqrt{r_n}$ (J. J. Lewandowski et al. Scripta Materialia, Vol. 54, pp. 337-341 (2006), the disclosure of which is incorporated herein by reference). FIG. 18 presents a plot of the notch toughness $K_Q$ (and associated error) against the square root of the notch root radius $\sqrt{r_n}$ for the metallic glass matrix alloy having composition $Au_{50}Cu_{25.5}Ag_3Pd_3Si_{18.5}$ (corresponding to x=1.0 in the formula of EQ. (2). Using linear extrapolation of the data one may determine the $K_Q$ value associated with $r_n\approx 0$ to be equal to 21.6 MPa $m^{1/2}$.

This value of $K_Q$=21.6 MPa $m^{1/2}$ is a good approximation of the critical stress intensity evaluated in the presence of an atomically sharp pre-crack. One may further show that this value is also consistent with plane strain and small-scale yielding conditions. For a linear-elastic $K_Q$ measurement to be consistent with plane strain and small-scale yielding conditions, the in-plane dimensions of the crack length, the remaining uncracked ligament, and the out-of-plane sample thickness dimension should be equal tot or less than 2.5 $(K_Q/\sigma_y)^2$, where $\sigma_y$ is the yield strength (ASTM E1820-15. Standard Test Method for Measurement of Fracture Toughness, ASTM International, West Conshohocken, Pa., USA, 2015). Using $K_Q$=21.6 MPa $m^{1/2}$ and $\rho_y$=1156 MPa, one may estimate that the minimum dimension to be matched in order to meet the small-scale yielding and plane strain requirements is 0.873 mm. The metallic glass rod samples evaluated in the present work had diameters of 3 mm, and were notched about half way through their diameters, which resulted in a crack length of about 1.5 mm, an uncracked ligament length ahead of the notch tip of about 1.5 mm, and a sample thickness of 3 mm at the notch tip, all of which are greater than the minimum dimension of 0.873 mm required to meet the small-scale yielding and plane strain criteria. Therefore, the notch toughness tests performed in the present work were consistent with plane strain and small scale yielding conditions, and thus meet the requirements for $K_{IC}$ validity. As such, the extrapolated $K_Q$ value associated with $r_n\approx 0$ of 21.6 MPa $m^{1/2}$ may be considered to represent the plane-strain critical stress intensity value, $K_{IC}$.

With knowledge of $K_{IC}$ and $\sigma_y$, one may estimate the plastic zone size of the metallic glass matrix phase. Using $K_{IC}$=21.6 MPa $m^{1/2}$ and $\sigma_y$=1156 MPa, one may estimate $R_p=K_{IC}^2/(6\pi\sigma_y^2)$=18.5 μm, or about 20 μm. Another critical and less conservative length scale is the plastic zone size under plane-stress conditions, which is known to be 3 times larger than the typical $R_p$ value estimated above that is consistent with plane-strain conditions, i.e. equal to $3R_p$. Hence, the plastic zone size of the metallic glass phase associated with plane-stress conditions is equal to 55.5 μm, or about 60 μm Therefore, in some embodiments of the disclosure, the average interdendritic spacing in the composite microstructure is equal to or less than the plastic zone radius of the metallic glass phase. Hence, in one embodiment, the average interdendritic spacing in the composite microstructure is equal to or less than 20 μm. In other embodiments of the disclosure, the average interdendritic spacing in the composite microstructure is equal to or less than 3 times the plastic zone radius of the metallic glass phase. Hence, in another embodiment, the average interdendritic spacing in the composite microstructure is equal to or less than 60 μm.

EXAMPLE VIII

Bending Test of Gold Metallic Glass Matrix Composites

As understood in the art, the fracture toughness of metallic glasses (and likely metallic glass matrix composites)

correlates with the plastic strain to fracture (or equivalently by the displacement to fracture) evaluated by subjecting an uncracked/unnotched sample in bending loading (see for example R. D. Conner et al., Journal of Applied Physics, Vol. 94, p. 904 (2003), the disclosure of which is incorporated herein by reference).

Therefore, the mechanical response in bending loading of a gold metallic glass matrix composite having composition $Au_{58}Cu_{24}Ag_{7.5}Pd_{1.5}Si_9$ (characterized by x of 0.49 in EQ. (2)) is investigated by means of three-point bending of a rod of the composite having a diameter of 2 mm. The rod of the composite is produced by the method of direct melt quenching, and it has a microstructure characterized by an average microstructural feature size of less than 10 micrometers. Hence, the average interdendritic spacing is less than the estimated plastic zone size of the metallic glass matrix phase $R_p$ of about 20 micrometers (see Example VII above). As such, the composite may be expected to have an optimal microstructure for enhanced toughness and ductility (i.e. enhanced displacement to fracture when tested in bending). The mechanical response in bending loading of the primary-Au and metallic glass phases of the composite, having compositions $Au_{65.2}Cu_{22.4}Ag_{12.4}$ (characterized by x=0 in EQ. (2)) and $Au_{50}Cu_{25.5}Ag_3Pd_3Si_{18.5}$ (characterized by x=1.0 in EQ. (2)), respectively, are also investigated by means of three-point bending of 2 mm-diameter rods of the monolithic phases. The rods of the monolithic primary-Au and metallic glass phases are also produced by the method of direct melt quenching.

Figure 19:
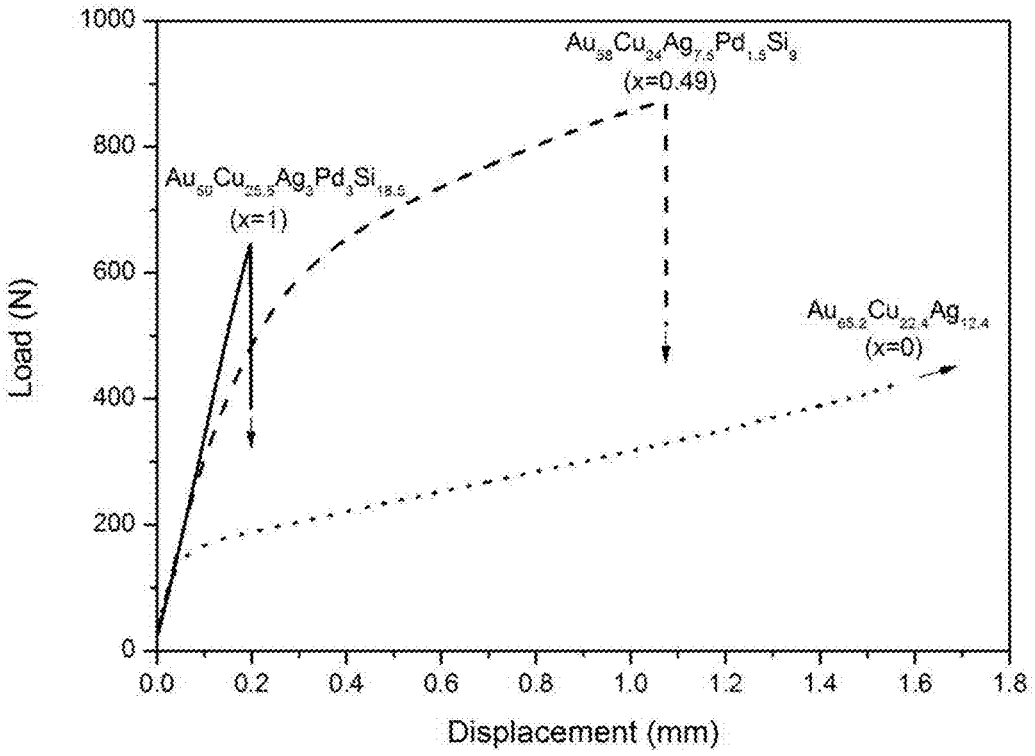
FIG. 19 presents load-displacement curves for the bending test of a composite having composition $Au_{58}Cu_{24}Ag_{7.5}Pd_{1.5}Si_9$ (characterized by x of 0.49 in EQ. (2)), a primary-Au phase alloy having composition $Au_{65.2}Cu_{22.4}Ag_{12.4}$ (characterized by x=0 in EQ. (2)), and a metallic glass phase alloy having composition $Au_{50}Cu_{25.5}Ag_3Pd_3Si_{18.5}$ (characterized by x=1.0 in EQ. (2)).

FIG. 19 presents the load-displacement curves for the bending of a composite having composition $Au_{58}Cu_{24}Ag_{7.5}Pd_{1.5}Si_9$ (characterized by x=0.49 in EQ. (2)), a primary-Au phase alloy having composition $Au_{65.2}Cu_{22.4}Ag_{12.4}$ (characterized by x=0 in EQ. (2)), and a metallic glass phase alloy having composition $Au_{50}Cu_{25.5}Ag_3Pd_3Si_{18.5}$ (characterized by x=1.0 in EQ. (2)). As seen in FIG. 19, the primary-Au phase alloy $Au_{65.2}Cu_{22.4}Ag_{12.4}$ (x=0) has a yield point characterized by a low bending yield load $F_y$ of 120 N, beyond which it deforms plastically continuously to a very large displacement exceeding 1.5 mm without fracturing. As such, a bending ultimate load $F_u$ and a bending displacement to fracture $\Delta/_f$ cannot be defined for the primary-Au phase alloy. By contrast, the monolithic metallic glass alloy $Au_{50}Cu_{25.5}Ag_3Pd_3Si_{18.5}$ (x=1.0) has a yield point characterized by a high bending yield load $F_y$ of 650 N, beyond which it immediately fractures catastrophically. Hence, its ultimate load at fracture $F_u$ coincides with its yield load $F_y$, while its bending displacement to fracture $\Delta/_f$ is limited to only 0.2 mm. Interestingly, the gold metallic glass matrix composite $Au_{58}Cu_{24}Ag_{7.5}Pd_{1.5}Si_9$ (x=0.49) has a yield point characterized by yield load $F_y$ of 250 N, which is between the primary-Au and metallic glass alloys. Following yielding however, the composite continues to deform plastically to a large displacement before it fractures. Specifically, the composite fractures at a bending displacement $\Delta/_f$ of 1.1 mm, which is much higher than the bending displacement to fracture of the metallic glass of 0.2 mm, and at a high bending ultimate load $F_u$ of 870 N, which is considerably higher than any load attained by the primary-Au alloy and even higher than the ultimate load of the metallic glass of 650 N. Table 9 lists the bending yield load $F_y$, bending ultimate load $F_u$, and bending displacement to fracture $\Delta/_f$ for the primary-Au phase alloy $Au_{65.2}Cu_{22.4}Ag_{12.4}$ (x=0), the gold metallic glass matrix composite $Au_{58}Cu_{24}Ag_{7.5}Pd_{1.5}Si_9$ (x=0.49), and the monolithic metallic glass alloy $Au_{50}Cu_{25.5}Ag_3Pd_3Si_{18.5}$ (x=1.0).

TABLE 9

Bending yield load $F_y$, bending ultimate load $F_u$, and bending displacement to fracture $\Delta/_f$ for the primary-Au phase alloy $Au_{65.2}Cu_{22.4}Ag_{12.4}$ (x = 0), the gold metallic glass matrix composite $Au_{58}Cu_{24}Ag_{7.5}Pd_{1.5}Si_9$ (x = 0.49), and the monolithic metallic glass alloy $Au_{50}Cu_{25.5}Ag_3Pd_3Si_{18.5}$ (x = 1.0).

| Example | Composition (at. %) | x | $F_y$ [N] | $F_u$ [N] | $\Delta/_f$ [mm] |
|---|---|---|---|---|---|
| N/A | $Au_{65.2}Cu_{22.4}Ag_{12.4}$ | 0 | 120 | N/A | N/A |
| 1 | $Au_{58}Cu_{24}Ag_{7.5}Pd_{1.5}Si_9$ | 0.49 | 250 | 870 | 1.1 |
| N/A | $Au_{50}Cu_{25.5}Ag_3Pd_3Si_{18.5}$ | 1 | 650 | 650 | 0.2 |

The damage tolerance of the primary-Au phase alloy is limited by its very low yield and ultimate load $F_y$ and $F_u$, while the damage tolerance of the metallic glass alloy is limited by its very low displacement to fracture $\Delta/_f$. The increased yield and ultimate load $F_y$ and $F_u$ of the composite with respect to the primary-Au phase alloy, and the enhanced bending deformability $\Delta/_f$ of the composite with respect to the metallic glass suggests a damage tolerance for the composite that exceeds those for both the primary-Au phase and metallic glass alloys. Hence, the composite is seen as curing the deficiencies of both the primary-Au phase and metallic glass alloy, namely the low yield/ultimate load and the low bending deformability, respectively. As a result of displaying both strength and ductility, the overall damage tolerance of the composite is enhanced over its constituent phases.

This enhanced damage tolerance of the composite over its constituent phases, the primary-Au and metallic glass phases, is accomplished by tuning the microstructure of the composite through cooling rate control to have features at optimal length scales. That is, the cooling rate achieved by quenching the equilibrium liquid phase of the alloy to form a macroscopic composite sample (i.e. 2 mm diameter rod) is such that the morphological features of each phase in the composite are smaller than the critical length scales associated with the mechanical failure of each phase. Specifically, the average interdendritic spacing in the composite microstructure is smaller than the plastic zone size $R_p$ of the metallic glass phase, which is associated with the distance a shear band can slide in the metallic glass phase before turning into a crack. This may enable a larger bending deformability for the composite compared to the glass. Furthermore, the characteristic dendrite length scales (e.g. the dendrite trunk diameter, dendrite arm diameter, etc.) are small enough such that they may promote an enhanced yield load compared to the monolithic primary-Au phase alloy through the Hall-Petch size effect.

Therefore, in one embodiment of the disclosure, the gold metallic glass matrix composite subjected to a bending test demonstrates a yield load that is higher than the yield load of the monolithic primary-Au phase alloy subjected to a bending test. In another embodiment, the gold metallic glass matrix composite subjected to a bending test demonstrates an ultimate load that is higher than the ultimate load of the monolithic primary-Au phase alloy subjected to a bending test. In another embodiment, the gold metallic glass matrix composite subjected to a bending test demonstrates an ultimate load that is higher than the ultimate load of the monolithic metallic glass phase alloy subjected to a bending test.

In another embodiment, the average microstructural feature size in the gold metallic glass matrix composite is less than 20 micrometers, and the composite subjected to a bending test demonstrates a yield load that is higher than that predicted by a linear rule of mixture between the yield loads of the monolithic primary-Au and metallic glass phase alloys subjected to a bending test. In another embodiment, the average microstructural feature size in the gold metallic glass matrix composite is less than 20 micrometers, and the composite subjected to a bending test demonstrates a yield load that is higher than that predicted by a linear rule of mixture between the yield loads of the monolithic primary-Au and metallic glass phase alloys subjected to a bending test by at least 5%. In another embodiment, the average microstructural feature size in the gold metallic glass matrix composite is less than 20 micrometers, and the composite subjected to a bending test demonstrates a yield load that is higher than that predicted by a linear rule of mixture between the yield loads of the monolithic primary-Au and metallic glass phase alloys subjected to a bending test by at least 10%.

In another embodiment of the disclosure, the gold metallic glass matrix composite subjected to a bending test demonstrates a displacement to facture (i.e. $\Delta/_f$) that is larger than the displacement to facture of the monolithic metallic glass phase alloy subjected to a bending test. In another embodiment, the average interdendritic spacing in the gold metallic glass matrix composite is less than the plastic zone size of the metallic glass phase, and the composite subjected to a bending test demonstrates a displacement to facture that is larger than the displacement to facture of the monolithic metallic glass phase alloy subjected to a bending test. In another embodiment, the average interdendritic spacing in the gold metallic glass matrix composite is less than the plastic zone size of the metallic glass phase, and the composite subjected to a bending test demonstrates a displacement to facture that is larger than the displacement to facture of the monolithic metallic glass phase alloy subjected to a bending test by at least a factor of 2. In another embodiment, the average interdendritic spacing in the gold metallic glass matrix composite is less than the plastic zone size of the metallic glass phase, and the composite subjected to a bending test demonstrates a displacement to facture that is larger than the displacement to facture of the monolithic metallic glass phase alloy subjected to a bending test by at least a factor of 3. In another embodiment, the average interdendritic spacing in the gold metallic glass matrix composite is less than the plastic zone size of the metallic glass phase, and the composite subjected to a bending test demonstrates a displacement to facture that is larger than the displacement to facture of the monolithic metallic glass phase alloy subjected to a bending test by at least a factor of 4. In another embodiment, the average interdendritic spacing in the gold metallic glass matrix composite is less than the plastic zone size of the metallic glass phase, and the composite subjected to a bending test demonstrates a displacement to facture that is larger than the displacement to facture of the monolithic metallic glass phase alloy subjected to a bending test by at least a factor of 5.

It is noted that the rod samples investigated here were prepared by the method of direct melt quenching in quartz tubes. Hence, the trunks of the primary-Au dendrites are expected to align in the direction of the heat flow gradient developed during the quench, which is in the radial direction of the rods. As such, the rods of the composites may be anisotropic, and the mechanical response of the composites may be linked to the orientation of dendrites with respect to the loading axis. Therefore, the results reported above may be specifically associated with testing performed on rods of composites that have been prepared by the direct melt quench method, where the dendrite trunks of the primary-Au phase are predominantly aligned along the radial direction of the rods.

EXAMPLE IX

Tensile Test of Gold Metallic Glass Matrix Composites

The mechanical response in tensile loading of a gold metallic glass matrix composite having composition $Au_{58}Cu_{24}Ag_{7.5}Pd_{1.5}Si_9$ (characterized by x of 0.49 in EQ. (2)) is investigated by performing a tensile test on a round dogbone specimen of the composite having a reduced gauge section of 1.74 mm in diameter and 13.7 mm in length. The round dogbone specimen sample of the composite is machined from a 2.5 mm diameter rod that was produced by the method of direct melt quenching, and it has a microstructure characterized by an average microstructural feature size of less than 10 micrometers. Hence, the average interdendritic spacing is less than the estimated plastic zone size of the metallic glass matrix phase of $R_p$ of about 20 micrometers (see Example VII above). As such, the composite may be expected to have an optimal microstructure for enhanced toughness and ductility (i.e. enhanced tensile ductility with work hardening when tested in tension). The mechanical response in tensile loading of the primary-Au and metallic glass phases of the composite, having compositions $Au_{65.2}Cu_{22.4}Ag_{12.4}$ (characterized by x=0 in EQ. (2)) and $Au_{50}Cu_{25.5}Ag_3Pd_3Si_{1.5}$ (characterized by x=1.0 in EQ. (2)), respectively, are also investigated by performing tensile tests on cylindrical tensile dogbone samples of the monolithic phases having gauge sections with diameters of 1.78 mm and 1.34 mm, respectively, and lengths of 12.0 mm and 10.0 mm, respectively. The tensile dogbone specimens of the monolithic primary-Au and metallic glass phases are machined from 4 and 3 mm diameter rods, respectively, which were also produced by the method of direct melt quenching.

Figure 20:
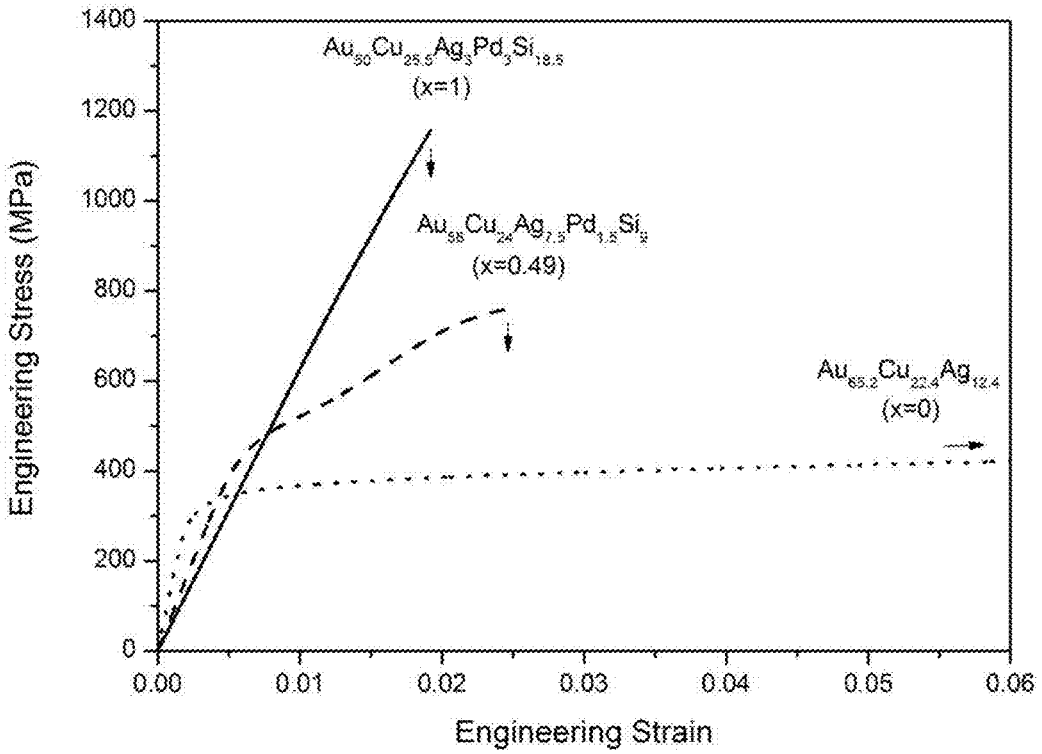
FIG. 20 presents engineering stress-strain curves for the tensile test of a composite having composition $Au_{58}Cu_{24}Ag_{7.5}Pd_{1.5}Si_9$ (characterized by x=0.49 in EQ. (2)), a primary-Au phase alloy having composition $Au_{65.2}Cu_{22.4}Ag_{12.4}$ (characterized by x=0 in EQ. (2)), and a metallic glass phase alloy having composition $Au_{50}Cu_{25.5}Ag_3Pd_3Si_{18.5}$ (characterized by x=1.0 in EQ. (2)).

FIG. 20 presents engineering stress-strain curves for the tensile test of a composite having composition $Au_{58}Cu_{24}Ag_{7.5}Pd_{1.5}Si_9$ (characterized by x=0.49 in EQ. (2)), a primary-Au phase alloy having composition $Au_{65.2}Cu_{22.4}Ag_{12.4}$ (characterized by x=0 in EQ. (2)), and a metallic glass phase alloy having composition $Au_{50}Cu_{25.5}Ag_3Pd_3Si_{18.5}$ (characterized by x=1.0 in EQ. (2)).

As seen in FIG. 20, the primary-Au phase alloy $Au_{65.2}Cu_{22.4}Ag_{12.4}$ (x=0) has a high Young's modulus E of 152.4 GPa and a low yield strength $\sigma_y$ of 210 MPa, resulting in a very small elongation at yield (i.e. elastic strain limit) $\varepsilon_y$ of 0.14%. By contrast, the monolithic metallic glass alloy $Au_{50}Cu_{25.5}Ag_3Pd_3Si_{18.5}$ (x=1.0) has a low Young's modulus E of 62.4 GPa and a high yield strength $\sigma_y$ of 1156 MPa, resulting in a very large elongation at yield $\varepsilon_y$ of 1.92%. Interestingly, the gold metallic glass matrix composite $Au_{58}Cu_{24}Ag_{7.5}Pd_{1.5}Si_9$ (x=0.49) that comprises the primary-Au phase and the metallic glass phase at approximately equal volume fractions has a Young's modulus E of 80.7 GPa, which is closer to that of the primary-Au phase, a yield strength $\sigma_y$ of 380 MPa, which is also closer to that of the primary-Au phase, resulting in an elongation at yield $\square_y$ of 0.36%, which is likewise closer to that of the primary-Au phase. The rule of mixtures would have predicted the elastic properties of the composite (i.e. E, $\sigma_y$, $\varepsilon_y$) to be about halfway between those of the primary-Au and metallic glass phases, due to the roughly equal volume fractions of these phases in the $Au_{58}Cu_{24}Ag_{7.5}Pd_{1.5}Si_9$ composite. However, the elastic properties of the composite appear to be closer to those of the primary-Au phase. Table 10 lists the Young's modulus E, yield strength $\sigma_y$, and elongation at yield $\varepsilon_y$ for the primary-Au phase alloy $Au_{65.2}Cu_{22.4}Ag_{12.4}$ (x=0), the gold metallic glass matrix composite $Au_{58}Cu_{24}Ag_{7.5}Pd_{1.5}Si_9$ (x=0.49), and the monolithic metallic glass alloy $Au_{50}Cu_{25.5}Ag_3Pd_3Si_{18.5}$ (x=1.0).

TABLE 10

Young's modulus E, yield strength $\sigma_y$, and elongation at yield $\varepsilon_y$, or the primary-Au phase alloy $Au_{65.2}Cu_{22.4}Ag_{12.4}$ (x = 0), the gold metallic glass matrix composite $Au_{58}Cu_{24}Ag_{7.5}Pd_{1.5}Si_9$ (x = 0.49), and the monolithic metallic glass alloy $Au_{50}Cu_{25.5}Ag_3Pd_3Si_{18.5}$ (x = 1.0).

| Example | Composition (at. %) | x | Young's modulus (GPa) | Yield Strength (MPa) | Elongation at Yield (%) |
|---|---|---|---|---|---|
| N/A | $Au_{65.2}Cu_{22.4}Ag_{12.4}$ | 0 | 152.4 | 210 | 0.14 |
| 1 | $Au_{58}Cu_{24}Ag_{7.5}Pd_{1.5}Si_9$ | 0.49 | 80.7 | 380 | 0.36 |
| N/A | $Au_{50}Cu_{25.5}Ag_3Pd_3Si_{18.5}$ | 1 | 62.4 | 1156 | 1.92 |

Therefore, in various embodiments of the disclosure, the gold metallic glass matrix composite demonstrates a Young's modulus that is lower than the Young's modulus of the monolithic primary-Au phase alloy. In one embodiment, the gold metallic glass matrix composite demonstrates a Young's modulus that is lower than 150 GPa. In another embodiment, the gold metallic glass matrix composite demonstrates a Young's modulus that is between 60 and 150 GPa. In another embodiment, the gold metallic glass matrix composite demonstrates a Young's modulus that is between 65 and 120 GPa. In yet another embodiment, the gold metallic glass matrix composite demonstrates a Young's modulus that is between 70 and 100 GPa.

In other embodiments, the gold metallic glass matrix composite demonstrates a yield strength that is higher than the yield strength of the monolithic primary-Au phase alloy. In one embodiment, the gold metallic glass matrix composite demonstrates a yield strength that is higher than 200 MPa. In another embodiment, the gold metallic glass matrix composite demonstrates a yield strength that is between 200 and 1000 MPa. In another embodiment, the gold metallic glass matrix composite demonstrates a yield strength that is between 250 and 800 MPa. In yet another embodiment, the gold metallic glass matrix composite demonstrates a yield strength that is between 300 and 600 MPa.

In other embodiments, the gold metallic glass matrix composite demonstrates an elongation at yield (i.e. an elastic strain limit) that is higher than the elongation at yield of the monolithic primary-Au phase alloy. In one embodiment, the gold metallic glass matrix composite demonstrates an elongation at yield that is higher than 0.15%. In another embodiment, the gold metallic glass matrix composite demonstrates an elongation at yield that is between 0.15 and 1.5%. In another embodiment, the gold metallic glass matrix composite demonstrates an elongation at yield that is between 0.2 and 1%. In yet another embodiment, the gold metallic glass matrix composite demonstrates an elongation at yield that is between 0.25 and 0.75%.

As also seen in FIG. 20, the monolithic metallic glass alloy $Au_{50}Cu_{25.5}Ag_3Pd_3Si_{18.5}$ (x=1.0) fractures immediately after yielding. However, the gold metallic glass matrix composite $Au_{58}Cu_{24}Ag_{7.5}Pd_{1.5}Si_9$ (x=0.49) and the primary-Au phase alloy $Au_{65.2}Cu_{22.4}Ag_{12.4}$ (x=0) continue to deform plastically following yielding, thus demonstrating tensile ductility. Furthermore, the plastic deformation of the primary-Au and metallic glass alloys appears to be accompanied by strain hardening—a phenomenon whereby a ductile material becomes harder and stronger as it is plastically deforms. For materials that undergo strain hardening during plastic tensile deformation, a strain hardening exponent n can be calculated. The strain hardening exponent quantifies the steepness of the stress-strain curve in the plastic elongation regime from the onset of plastic deformation to the point at which necking begins, and relates the true stress $\sigma_t$ and true strain Et in the plastic elongation regime as $\sigma_t = C\varepsilon t^n$, where the true strain $\varepsilon_t$ is related to the engineering strain $\varepsilon$ as $\varepsilon_t = \ln(1+\varepsilon)$, and the true stress $\sigma_t$ is related to the engineering stress $\sigma$ and engineering strain $\varepsilon$ as $\sigma_t = \sigma(1+\varepsilon)$, and C is a constant representing the strength coefficient of the material. Hence, to determine the strain hardening exponent n, one may convert the engineering stress-strain data in the plastic elongation regime to true stress strain data, plot the natural logarithm of true stress against the natural logarithm of the true strain, and evaluate the slope of that plot, which by definition would be equal to n.

Despite its low yield strength $\sigma_y$, the primary-Au phase alloy $Au_{65.2}Cu_{22.4}Ag_{12.4}$ (x=0) demonstrates a large tensile ductility, as it is able to undergo large tensile deformation prior to fracturing $\varepsilon_f$. Also, owing to a small degree of strain hardening occurring during plastic tensile deformation, the primary-Au phase alloy demonstrates an ultimate tensile strength $\sigma_u$ that is higher than $\sigma_y$. Though not shown in FIG. 20, the primary-Au phase alloy $Au_{65.2}Cu_{22.4}Ag_{12.4}$ demonstrates an elongation at break $\varepsilon_f$ of 24.1%, and an ultimate tensile strength $\sigma_u$ of 550 MPa. The tensile ductility, defined as the difference between the elongation at break and the elongation at yield, is about 24%. Using the data in the plastic elongation regime, a strain hardening exponent n of 0.145 is calculated. On the other hand, despite its very high yield strength $\sigma_y$, the metallic glass alloy $Au_{50}Cu_{25.5}Ag_3Pd_3Si_{18.5}$ (x=1.0) is unable to undergo any tensile elongation prior to fracturing. As such, the ultimate strength $\sigma_u$ of the metallic glass alloy is equal to the yield strength $\sigma_y$, the elongation at fracture $\varepsilon_f$ is equal to the elongation at yield $\varepsilon_y$, the tensile ductility is essentially zero, and since no plastic elongation could be achieved a strain hardening exponent n cannot be calculated. Unlike the metallic glass alloy, the gold metallic glass matrix composite $Au_{58}Cu_{24}Ag_{7.5}Pd_{1.5}Si_9$ (x=0.49) is able to undergo considerable plastic deformation following yielding, though not as large as the primary-Au phase alloy. However, because of a much larger strain hardening exponent compared to the primary-Au phase alloy, the composite attains a much larger ultimate strength than the primary-Au phase alloy. Specifically, the composite demonstrates an elongation at break $\varepsilon_f$ of 2.5% and a tensile ductility of about 2.1%, which are rather modest compared to those of the primary-Au phase alloy. However, the composite demonstrates a strain hardening exponent n of 0.465, which is more than three times larger than the strain hardening exponent of the primary-Au alloy. Owing to such large n, the composite attains a very high ultimate strength $\sigma_u$ of 762 MPa, which is twice as high as its yield strength of $\sigma_y$ of 380 MPa. The ultimate strength of the composite is higher than that of the primary-Au phase alloy by about 40%, and is about 35% lower than the ultimate strength of the metallic glass alloy. Table 11 lists the ultimate strength $\sigma_u$, elongation at break $\varepsilon_f$, tensile ductility, and strain hardening exponent n for the primary-Au phase alloy $Au_{65.2}Cu_{22.4}Ag_{12.4}$ (x=0), the gold metallic glass matrix composite $Au_{58}Cu_{24}Ag_{7.5}Pd_{1.5}Si_9$ (x=0.49), and the monolithic metallic glass alloy $Au_{50}Cu_{25.5}Ag_3Pd_3Si_{18.5}$ (x=1.0).

TABLE 11

Ultimate strength $\sigma_u$, elongation at break $\varepsilon_f$, tensile ductility, and strain hardening exponent n for the primary-Au phase alloy $Au_{65.2}Cu_{22.4}Ag_{12.4}$ (x = 0), the gold metallic glass matrix composite $Au_{58}Cu_{24}Ag_{7.5}Pd_{1.5}Si_9$ (x = 0.49), and the monolithic metallic glass alloy $Au_{50}Cu_{25.5}Ag_3Pd_3Si_{18.5}$ (x = 1.0).

| Example | Composition (at. %) | x | Ultimate Strength (MPa) | Elongation at Break (%) | Tensile Ductility (%) | Strain Hardening Exponent |
|---|---|---|---|---|---|---|
| N/A | $Au_{65.2}Cu_{22.4}Ag_{12.4}$ | 0 | 550 | 24.1 | 24.0 | 0.145 |
| 1 | $Au_{58}Cu_{24}Ag_{7.5}Pd_{1.5}Si_9$ | 0.49 | 762 | 2.5 | 2.1 | 0.465 |
| N/A | $Au_{50}Cu_{25.5}Ag_3Pd_3Si_{18.5}$ | 1 | 1156 | 1.92 | 0 | N/A |

Owing to the yield strength, work hardening exponent, and ultimate strength of the composite being much higher than those of the primary-Au phase alloy, and the tensile ductility of the composite being much higher than that of the metallic glass, the composite appears to exhibit a much higher damage tolerance compared to its constituent phases, the primary-Au and metallic glass phases. This high damage tolerance is accomplished by tuning the microstructure of the composite through cooling rate control to have features at optimal length scales. That is, the cooling rate achieved by quenching the equilibrium liquid phase of the alloy to form a macroscopic sample of the composite is such that the morphological features of each phase in the composite are smaller than the critical length scales associated with the mechanical failure of each phase. Specifically, the average interdendritic spacing in the composite microstructure is smaller than the plastic zone size $R_p$ of the metallic glass phase, which is associated with the distance a plastic shear band can slide in the metallic glass phase before turning into a crack. This may enable a larger tensile ductility for the composite compared to the glass. Furthermore, the characteristic dendrite length scales (e.g. the dendrite trunk diameter, dendrite arm diameter, etc.) are small enough such that they may promote an enhanced local yield strength through the Hall-Petch size effect. Such enhanced local yield strength may be responsible for the enhanced global yield strength, ultimate strength, and strain hardening exponent of the composite compared to the monolithic primary-Au phase alloy.

Therefore, in various embodiments of the disclosure, the gold metallic glass matrix composite demonstrates an ultimate strength that is higher than the ultimate strength of the monolithic primary-Au phase alloy. In other embodiments, the average interdendritic spacing in the gold metallic glass matrix composite is less than the plastic zone size of the metallic glass phase, and the composite demonstrates an ultimate strength that is higher than the ultimate strength of the monolithic primary-Au phase alloy. In yet other embodiments, the average microstructural feature size in the gold metallic glass matrix composite is less than 20 micrometers, and the composite demonstrates an ultimate strength that is higher than the ultimate strength of the monolithic primary-Au phase alloy. In one embodiment, the gold metallic glass matrix composite demonstrates an ultimate strength that is higher than 550 MPa. In another embodiment, the gold metallic glass matrix composite demonstrates an ultimate strength that is between 550 and 1150 MPa. In another embodiment, the gold metallic glass matrix composite demonstrates an ultimate strength that is between 600 and 1000 MPa. In yet another embodiment, the gold metallic glass matrix composite demonstrates an ultimate strength that is between 650 and 900 MPa.

In other embodiments of the disclosure, the gold metallic glass matrix composite demonstrates an elongation at break that is higher than the elongation at break of the monolithic metallic glass phase alloy. In other embodiments, the average interdendritic spacing in the gold metallic glass matrix composite is less than the plastic zone size of the metallic glass phase, and the composite demonstrates an elongation at break that is higher than the elongation at break of the monolithic metallic glass phase alloy. In yet other embodiments, the average microstructural feature size in the gold metallic glass matrix composite is less than 20 micrometers, and the composite demonstrates an elongation at break that is higher than the elongation at break of the monolithic metallic glass phase alloy. In one embodiment, the gold metallic glass matrix composite demonstrates an elongation at break that is higher than 1.5%. In another embodiment, the gold metallic glass matrix composite demonstrates an elongation at break that is higher than 1.75%. In another embodiment, the gold metallic glass matrix composite demonstrates an elongation at break that is higher than 2.0%. In yet another embodiment, the gold metallic glass matrix composite demonstrates an elongation at break that is higher than 2.25%.

In other embodiments of the disclosure, the gold metallic glass matrix composite demonstrates a tensile ductility that is higher than the tensile ductility of the monolithic metallic glass phase alloy. In other embodiments, the average interdendritic spacing in the gold metallic glass matrix composite is less than the plastic zone size of the metallic glass phase, and the composite demonstrates a tensile ductility that is higher than the tensile ductility of the monolithic metallic glass phase alloy. In yet other embodiments, the average microstructural feature size in the gold metallic glass matrix composite is less than 20 micrometers, and the composite demonstrates a tensile ductility that is higher than the tensile ductility of the monolithic metallic glass phase alloy. In one embodiment, the gold metallic glass matrix composite demonstrates a tensile ductility that is higher than 0%. In another embodiment, the gold metallic glass matrix composite demonstrates a tensile ductility that is higher than 0.5%. In another embodiment, the gold metallic glass matrix composite demonstrates a tensile ductility that is higher than 1.0%. In yet another embodiment, the gold metallic glass matrix composite demonstrates a tensile ductility that is higher than 1.5%.

In other embodiments of the disclosure, the gold metallic glass matrix composite demonstrates a strain hardening exponent that is higher than the strain hardening exponent of the monolithic primary-Au phase alloy. In other embodiments, the average interdendritic spacing in the gold metallic glass matrix composite is less than the plastic zone size of the metallic glass phase, and the composite demonstrates a strain hardening exponent that is higher than the strain hardening exponent of the monolithic primary-Au phase alloy. In yet other embodiments, the average microstructural feature size in the gold metallic glass matrix composite is less than 20 micrometers, and the composite demonstrates a strain hardening exponent that is higher than the strain hardening exponent of the monolithic primary-Au phase alloy. In one embodiment, the gold metallic glass matrix composite demonstrates a strain hardening exponent that is higher than 0.15. In another embodiment, the gold metallic glass matrix composite demonstrates a strain hardening exponent that is between 0.15 and 0.8. In another embodiment, the gold metallic glass matrix composite demonstrates a strain hardening exponent that is between 0.25 and 0.75. In yet another embodiment, the gold metallic glass matrix composite demonstrates a strain hardening exponent that is between 0.3 and 0.6.

It is noted that the rod samples investigated here were prepared by the method of direct melt quenching in quartz tubes. Hence, the trunks of the primary-Au dendrites are expected to align in the direction of the heat flow gradient developed during the quench, which is in the radial direction of the rods. As such, the rods of the composites may be anisotropic, and the mechanical response of the composites may be linked to the orientation of dendrites with respect to the loading axis. Therefore, the results reported above may be specifically associated with testing performed on rods of composites that have been prepared by the direct melt quench method, where the dendrite trunks of the primary-Au phase are predominantly aligned along the radial direction of the rods.

EXAMPLE X

Resistivity of Gold Metallic Glass Matrix Composites

The electrical resistivity of a sample rod of gold metallic glass matrix composite having composition $Au_{56}Cu_{24}Ag_{7.5}Zn_2Pd_{1.5}Si_9$ (Example 2) is measured using the four-point probe method. Specifically, the measurement was performed on a rod of the composite having diameter of 3.2 mm and length of 13.11 mm. The rod was prepared by the method of direct melt quenching. The volume fraction of the metallic glass phase in this composite from visual inspection of its morphology (see Section II and FIG. 7) appears to be approximately 50%. An electrical resistivity value of 24.5 μΩ-cm was obtained for this composite.

Therefore, in some embodiments, the electrical resistivity of the gold metallic glass matrix composites is between 5 and 100 μΩ-cm. In other embodiments, the electrical resistivity of the gold metallic glass matrix composites is between 10 and 50 μΩ-cm. In yet other embodiments, the electrical resistivity of the gold metallic glass matrix composites is between 15 and 40 μΩ-cm.

It is noted that the rod sample measured here was prepared by the method of direct melt quenching in quartz tubes. Hence, the trunks of the primary-Au dendrites are expected to align in the direction of the heat flow gradient developed during the quench, which is in the radial direction of the rods. As such, the rods of the composites may be anisotropic, and the measured electrical resistivity of the composite may be linked to the orientation of dendrites with respect to the measurement axis. Therefore, the result reported above may be specifically associated with measurements performed on rods of composites that have been prepared by the direct melt quench method, where the dendrite trunks of the primary-Au phase are predominantly aligned along the radial direction of the rods.

EXAMPLE XI

Processing of a Gold Metallic Glass Matrix Composite Article by Ohmic Heating Gold metallic glass matrix composite articles are processed thermoplastically by the method of Ohmic heating using an RCDF apparatus. The ohmic heating is performed by placing the feedstock rod between two copper platens, which act as both electrodes and plungers, discharging a quantum of electrical energy to the feedstock to ohmically heat it and soften it while simultaneously applying pressure to the feedstock to shape it. The electrical energy discharged through the feedstock by the copper platens ohmically heats the sample to a temperature above the glass transition temperature of the metallic glass matrix phase, thereby softening the metallic glass matrix phase, over a millisecond time scale on the order of the RC time constant, thereby preventing crystallization of the metallic glass matrix phase of the composite. The pressure applied to the softened feedstock by the copper platens shapes the entire feedstock into a disk, at a time scale on the order of less than 50 ms thereby preventing crystallization of the metallic glass matrix phase. Hence, a gold metallic glass matrix composite disk is obtained. The ohmic heating setup used includes a capacitor having a capacitance of 0.792 F, capable of storing electrical energy of up to 15.8 kJ.

Figure 21:
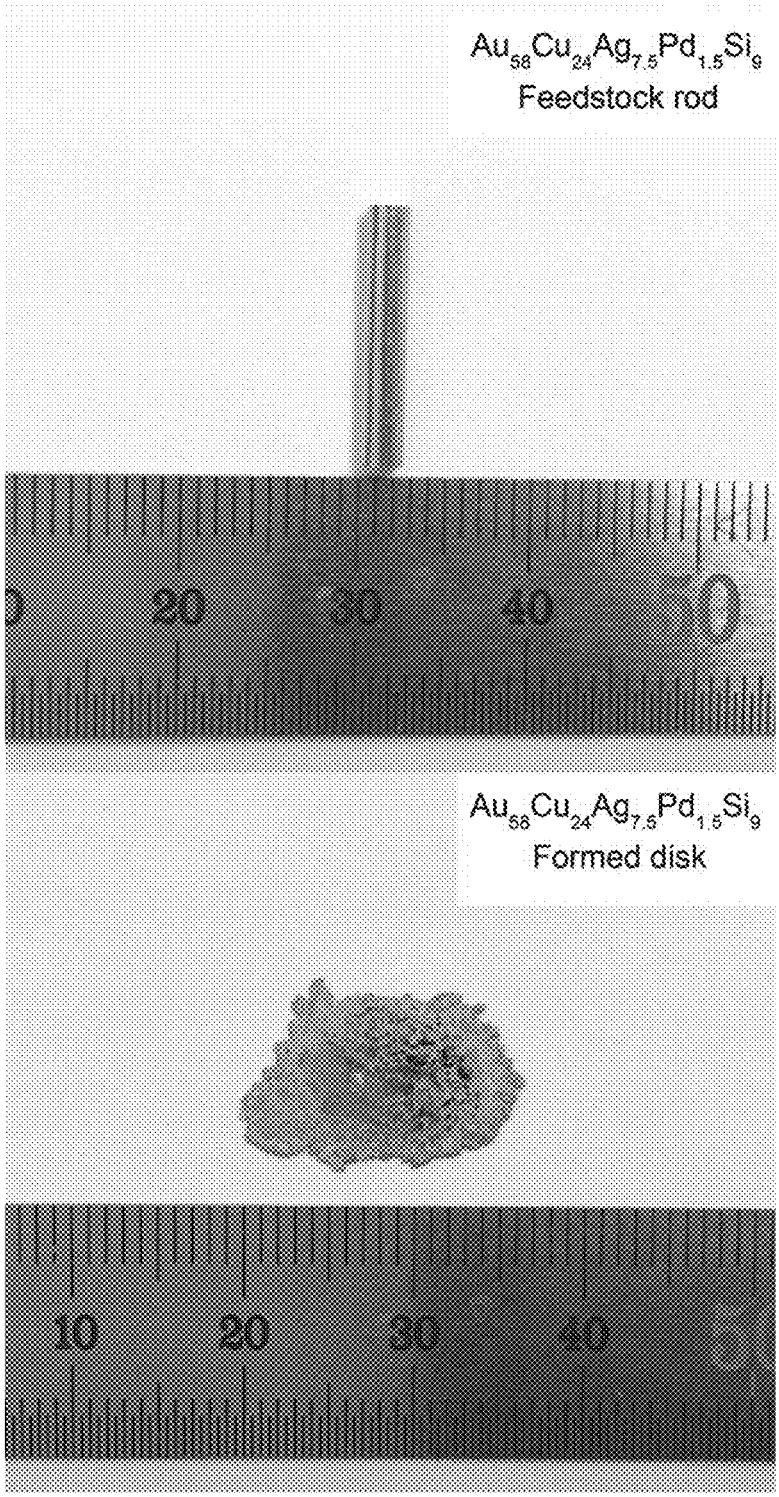
FIG. 21 presents a photograph of the feedstock rod used for thermoplastic shaping by the ohmic heating method, and the disc formed by thermoplastic shaping using the ohmic heating method.
Figure 22:
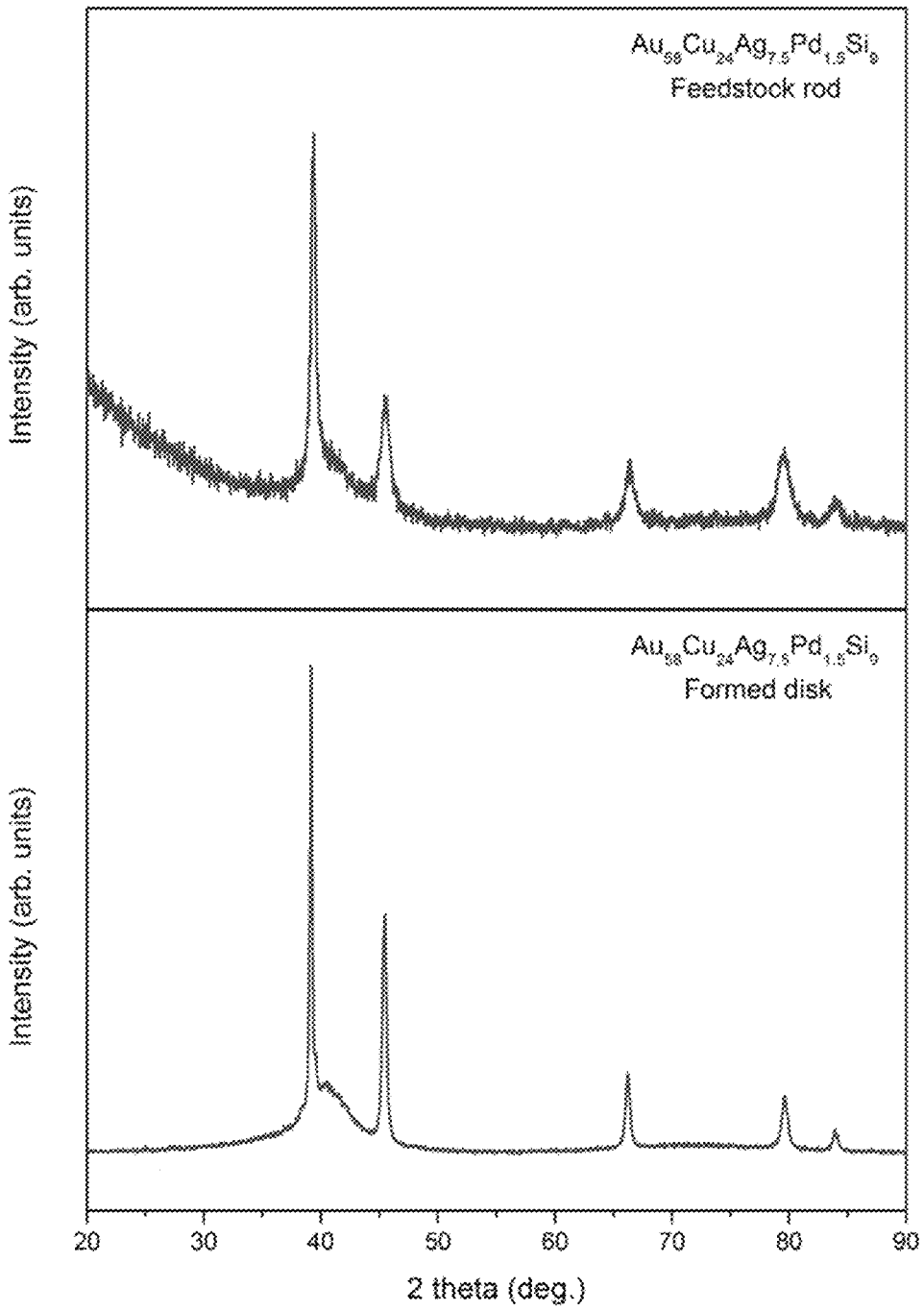
FIG. 22 presents x-ray diffractograms of the feedstock rod used for thermoplastic shaping by the ohmic heating method, and of the disc formed by thermoplastic shaping using the ohmic heating method.

In one example, a feedstock rod of gold metallic glass matrix composite having composition $Au_{58}Cu_{24}Ag_{7.5}Pd_{1.5}Si_9$ (Example 1) is used as feedstock rod in an ohmic heating setup, and is shaped thermoplastically into a disc using the ohmic heating method. The feedstock rod had diameter of 2.41 mm and length of 10.45 mm. FIG. 21 presents a photograph of the feedstock rod, and FIG. 22 presents an x-ray diffractogram of the feedstock rod revealing that the composite comprises a primary-Au crystalline phase and a metallic glass phase and is free of any other phase. The feedstock rod had a resistance of 0.56 mΩ (assuming an electrical resistivity of 24.5 mΩ-cm). The RC time constant of the ohmic heating process was 0.44 ms. A voltage of 40.81 v was applied to the capacitor, discharging an electrical energy of 660 J. The measured electrical energy delivered to the feedstock rod by the copper platen electrodes was 48.2 J, resulting in an energy density through the feedstock rod of 1012 J/cc. The efficiency of the ohmic heating process was therefore about 7%. The pressure applied on the feedstock rod by the copper platen plungers was 287.19 MPa. The formed disk has a roughly elliptic shape with the long axis being 14.75 mm and the short axis 9.27, and a thickness of 0.38 mm. FIG. 21 presents a photograph of the formed disk, and FIG. 22 presents an x-ray diffractogram of the formed disk revealing that the composite comprises a primary-Au crystalline phase and a metallic glass phase and is free of any other phase.

In another example, a feedstock rod of gold metallic glass matrix composite having composition $Au_{56}Cu_{24}Ag_{7.5}Zn_2Pd_{1.5}Si_9$ (Example 2) is used as feedstock rod in an ohmic heating setup, and is shaped thermoplastically into a disc using the ohmic heating method. The feedstock rod had diameter of 3.20 mm and length of 13.11 mm. The feedstock rod had a resistance of 0.40 mΩ (assuming an electrical resistivity of 24.5 μΩ-cm). The RC time constant of the ohmic heating process was 0.32 ms. A voltage of 79.27 v was applied to the capacitor, discharging an electrical energy of 2488 J. The measured electrical energy delivered to the feedstock rod by the copper platen electrodes was 179.5 J, resulting in an energy density through the feedstock rod of 1702 J/cc. The efficiency of the ohmic heating process was therefore about 7%. The pressure applied on the feedstock rod by the copper platen plungers was 130.31 MPa. The formed disk has a roughly circular shape with radius of 21.0 mm, and a thickness of 0.40 mm.

Therefore, in some embodiments, the energy density delivered to the gold metallic glass matrix composite feedstock during ohmic heating is at least 100 J/cc. In other embodiments, the energy density delivered to the gold metallic glass matrix composite feedstock during ohmic heating is at least 200 J/cc. In yet other embodiments, the energy density delivered to the gold metallic glass matrix composite feedstock during ohmic heating is at least 500 J/cc. In some embodiments, the pressure applied to shape the gold metallic glass matrix composite feedstock during ohmic heating is at least 20 MPa. In other embodiments, the pressure applied to shape the gold metallic glass matrix composite feedstock during ohmic heating is at least 50 MPa. In yet other embodiments, the pressure applied to shape the gold metallic glass matrix composite feedstock during ohmic heating is at least 100 MPa.

EXAMPLE XII

Other Miscellaneous Gold Metallic Glass Matrix Composite Alloys

Table 12 lists several miscellaneous gold metallic glass matrix composites according to embodiments of the disclosure. For each alloy, the Au weight percent and critical rod diameter corresponding to processing by the direct melt quench method is also presented in Table 12.

TABLE 12

Miscellaneous gold metallic glass matrix composite compositions according to embodiments of the disclosure, and corresponding Au weight percent and critical rod diameter

| Example | Composition | Au wt. % | Critical Rod Diameter [mm] |
|---|---|---|---|
| 5 | $Au_{59.04}Cu_{24}Ag_{7.63}Pd_{1.33}Si_8$ | 81.08 | 2 |
| 6 | $Au_{56.96}Cu_{24}Ag_{7.37}Pd_{1.67}Si_{10}$ | 80.15 | 2 |
| 7 | $Au_{55.5}Cu_{26}Ag_7Pd_{1.5}Si_{10}$ | 79.33 | 3 |
| 8 | $Au_{59.5}Cu_{24}Ag_7Pd_{1.5}Si_8$ | 81.48 | 2 |
| 9 | $Au_{55.5}Cu_{28}Ag_7Pd_{1.5}Si_8$ | 78.93 | 2 |
| 10 | $Au_{59.5}Cu_{24}Ag_{7.5}Pd_1Si_8$ | 81.47 | 1 |
| 11 | $Au_{50.9}Cu_{22.6}Ag_{12.5}Pd_2Si_{12}$ | 75.0 | 1 |
| 12 | $Au_{51.7}Cu_{19.3}Ag_{15}Pd_2Si_{12}$ | 75.0 | 3 |
| 13 | $Au_{52.1}Cu_{17.9}Ag_{16}Pd_2Si_{12}$ | 75.0 | 5 |
| 14 | $Au_{53.4}Cu_{18.1}Ag_{18}Pd_{1.5}Si_9$ | 75.0 | 2 |
| 15 | $Au_{54.8}Cu_{18.2}Ag_{20}Pd_1Si_6$ | 75.0.5 | 2 |
| 16 | $Au_{50.1}Cu_{20.9}Ag_{10}Zn_5Pd_2Si_{12}$ | 75.0 | 1 |
| 17 | $Au_{51.7}Cu_{22.8}Ag_{12.5}Zn_2Pd_2Si_9$ | 75.0 | 1 |
| 18 | $Au_{57}Cu_{24}Ag_{7.5}Zn_1Pd_{1.5}Si_9$ | 79.97 | 3 |
| 19 | $Au_{55}Cu_{24}Ag_{7.5}Zn_3Pd_{1.5}Si_9$ | 78.64 | 3 |
| 20 | $Au_{56.25}Cu_{24}Ag_7Zn_{2.25}Pd_{1.5}Si_9$ | 79.6 | 4 |

Description of Methods of Preparing the Ingots of the Sample Alloys

The particular method for producing the ingots of the example alloys involves inductive melting of the appropriate amounts of elemental constituents in a quartz tube under inert atmosphere. The purity levels of the constituent elements were as follows: Au 99.99%, Cu 99.995%, Ag 99.95%, Pd 99.95%, Zn 99.999%, and Si 99.9999%. In some embodiments, the melting crucible may be a ceramic such as alumina or zirconia, graphite, sintered crystalline silica, or a water-cooled hearth made of copper or silver.

Description of Methods of Preparing the Sample Metallic Glasses

The particular method for producing rods of the example gold metallic glass matrix composites and primary-Au phase and monolithic metallic glass alloys from the alloy ingots by direct melt quenching involves melting the alloy ingots in quartz tubes having an inner diameter of 2, 3, or 4 mm and 0.5-mm thick walls in a furnace at 950° C. under high purity argon and rapidly quenching in a room-temperature water bath. In some embodiments, the bath could be ice water or oil. In other embodiments, rods may be formed by direct melt quenching by injecting or pouring the molten alloy into a metal mold. In some embodiments, the mold can be made of copper, brass, or steel, among other materials.

The particular method for producing rods of gold metallic glass matrix composites from the alloy ingots by semi-solid processing involves melting the alloy ingots in quartz tube crucibles having an inner diameter of 3 mm and 0.5-mm thick walls in a furnace at 950° C. under high purity argon, cooling the melt to 650° C. to form a "semi-solid" phase, holding the semi-solid isothermally at 650° C. for approximately 300 s, and subsequently rapidly quenching the semi-solid in a room-temperature water bath. The temperature in the semi-solid region is monitored suing a pyrometer. In some embodiments, the step of cooling the melt to form the semi-solid and isothermally holding the semi-solid may be performed by quenching the high temperature melt in a liquid metal bath held at a temperature in the semi-solid region. In some embodiments, the liquid metal bath may be a liquid tin bath. In some embodiments, the melting crucible may be a ceramic such as alumina or zirconia, graphite, sintered crystalline silica, or a water-cooled hearth made of copper or silver. In some embodiments, quenching of the semi-solid may be performed by injecting or pouring the semi-solid into a metal mold. In some embodiments, the mold can be made of copper, brass, or steel, among other materials.

Test Methodology for Performing Differential Scanning Calorimetry

Differential scanning calorimetry was performed on sample gold metallic glass matrix composites and primary-Au phase and monolithic metallic glass alloys at a scan rate of 20 K/min to determine the glass-transition, crystallization, solidus, liquidus temperatures and enthalpy of crystallization.

Test Methodology for Measuring Hardness

The Vickers hardness (HV0.5) of sample metallic gold glass matrix composites having an average microstructural feature size of less than 10 μm, and primary-Au phase and monolithic metallic glass alloys was measured using a Vickers microhardness tester with an indenter having a width of 40 μm. Eight tests were performed where micro-indentions were inserted on a flat and polished cross section of a 2 or 3 mm rod for composites and 4 mm rods for the primary-Au phase and monolithic metallic glass alloys, all produced by the method of direct melt quenching. A load of 500 g and a duel time of 10 s were used.

Test Methodology for Measuring Color

The CIELAB color coordinates were measured using a Konica Minolta CM-700d spectrophotometer on 20 mm×20 mm plate coupons of sample gold metallic glass matrix composites and primary-Au phase and monolithic metallic glass alloys polished to a 1 μm diamond mirror finish. Measurements were performed at each of the four corners of the plate coupons and averaged.

Test Methodology for Performing Notch Toughness Tests

The notch toughness of the monolithic metallic glass was measured on 3-mm diameter rods. The rods were notched to a depth of approximately half the rod diameter. Four different root radii were produced, as follows: a root radius of 25 micrometers was achieved using a razor blade; a rood radius of 100 micrometers was achieved using a diamond saw blade; a root radius of 140 micrometers was achieved using a wire saw; a root radius of 420 micrometers was achieved using a silicon carbide saw blade. The notched specimens were placed on a 3-point bending fixture with span of 12.7 mm, and carefully aligned with the notched side facing downward. The critical fracture load was measured by applying a monotonically increasing load at constant crosshead speed of 0.001 mm/s using a screw-driven testing frame. Three tests were performed for the root radii of 25, 100, and 140 micrometers, and the variance between tests is included an error in the notch toughness values. One test was performed for the root radius of 420 micrometers. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Performing Bending Tests

Three-point bending tests with a support span of 8 mm were performed on 2-mm diameter rod samples to generate quantitative load-displacement information. Two rods were tested for each alloy. The load-displacement data were measured by applying a monotonically increasing load at constant crosshead speed of 0.001 mm/s using a screw-driven testing frame. The displacement and load data were provided by the cross-head displacement and load cell, respectively. The yield load is defined as the load at which the response departs from the linear load-displacement response.

Test Methodology for Performing Tensile Tests

Uniaxial tensile tests were performed on round tensile dogbone samples. The samples were pulled at a crosshead speed of 0.001 mm/s using a screw-driven testing frame. The strain was measured with an extensometer located within the gauge section for strains up to 10%, and was evaluated based on the crosshead displacement for strains exceeding 10%.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

The alloys and metallic glasses described herein can be valuable in the fabrication of electronic devices. An electronic device herein can refer to any electronic device known in the art. For example, it can be a telephone, such as a mobile phone, and a land-line phone, or any communication device, such as a smart phone, including, for example an iPhone®, and an electronic email sending/receiving device. It can be a part of a display, such as a digital display, a TV monitor, an electronic-book reader, a portable web-browser (e.g., iPad®), and a computer monitor. It can also be an entertainment device, including a portable DVD player, conventional DVD player, Blue-Ray disk player, video game console, music player, such as a portable music player (e.g., iPod®), etc. It can also be a part of a device that provides control, such as controlling the streaming of images, videos, sounds (e.g., Apple TV®), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A Au-based metallic glass matrix composite comprising Si in the range of atomic fraction of 1 to 16 percent, and consisting essentially of a primary-Au crystalline phase and a metallic glass phase.

2. The Au-based metallic glass matrix composite of claim 1, where a critical rod diameter is at least 1 mm.

3. The Au-based metallic glass matrix composite of claim 1, where an average microstructural feature size is less than 30 μm, wherein the microstructural feature is selected from the group consisting of: average dendrite trunk diameter, average dendrite arm diameter, average dendrite arm spacing, and average interdendritic spacing.

4. The Au-based metallic glass matrix composite of claim 1, where the Au-based metallic glass matrix composite has a color characterized by a CIELAB coordinate b* of at least 14.

5. The Au-based metallic glass matrix composite of claim 1, where the Au-based metallic glass matrix composite has a color characterized by a CIELAB coordinate L* in the range of 65 to 100, a CIELAB coordinate a* in the range of −5 to 15, and a CIELAB coordinate b* in the range of 0 to 40.

6. The Au-based metallic glass matrix composite of claim 1, where the Au-based metallic glass matrix composite has color characterized by CIELAB coordinates a*, b*, and L* where:

$$0.75\cdot(xa_g^*+(1-x)a_c^*)<a^*<1.25\cdot(xa_g^*+(1-x)a_c^*),$$

$$0.75\cdot(xb_g^*+(1-x)b_c^*)<b^*<1.25\cdot(xb_g^*+(1-x)b_c^*),$$

$$0.75\cdot(xL^*_g+(1-x)L^*_c)<L^*<1.25\cdot(xL^*_g+(1-x)L^*_c);$$

where $x=(e-e_c)/e_g$, where e is the nominal atomic concentration of Si in the Au-based metallic glass matrix composite, $e_c$ is the atomic concentration of Si in the primary-Au phase, and $e_g$ is the atomic concentration of Si in the metallic glass phase;

where $a_c^*$, $b_c^*$, and $L_c^*$ are the CIELAB coordinates characterizing the color of the primary-Au crystalline phase; and where $a_g^*$, $b_g^*$, and $L_g^*$ are the CIELAB coordinates characterizing the color of the metallic glass phase.

7. The Au-based metallic glass matrix composite of claim 1, where the average interdendritic spacing in the microstructure of the composite is equal to or less than 20 μm.

8. The Au-based metallic glass matrix composite of claim 1, where the average interdendritic spacing in the microstructure of the composite is equal to or less than the plastic zone radius of the metallic glass phase.

9. The Au-based metallic glass matrix composite of claim 1, wherein the Au-based metallic glass matrix composite has at least one mechanical property selected from the group consisting of: a hardness in the range of 125 to 350 HV; a tensile ductility higher than 0.5%; and a strain hardening exponent higher than 0.15.

10. The Au-based metallic glass matrix composite of claim 1, where the weight fraction of Au is at least 75 percent.

11. The Au-based metallic glass matrix composite of claim 1, where the atomic fraction of Si ranges from 5 to 13 percent, and wherein the molar fraction of the primary-Au crystalline phase in the Au-based metallic glass matrix composite is in the range of 10 to 90 percent.

12. The Au-based metallic glass matrix composite of claim 1, where the atomic concentration of Au in the primary-Au crystalline phase is higher than the nominal atomic concentration of Au in the composite, while the atomic concentration of Au in the metallic glass phase is lower than the nominal atomic concentration of Au in the composite.

13. The Au-based metallic glass matrix composite of claim 1, where the atomic concentration of Si in the primary-Au crystalline phase is lower than the nominal atomic concentration of Si in the composite, while the atomic concentration of Si in the metallic glass phase is higher than the nominal atomic concentration of Si in the composite.

14. The Au-based metallic glass matrix composite of claim 1, where the Au-based metallic glass matrix composite is free of at least one phase selected from the group consisting of: an intermetallic phase, a pure-Si phase, a eutectic phase, any crystalline phase other than the primary-Au crystalline phase, any phase in which the atomic concentration of Au is lower than the atomic concentration of Au in the metallic glass phase, and any phase in which the atomic concentration of Si is higher than the atomic concentration of Si in the metallic glass phase.

15. The Au-based metallic glass matrix composite of claim 1, wherein the Au-based metallic glass matrix composite has at least one compositional limitation selected from the group consisting of: the atomic fraction of Si is in the range of 5 to 13 percent;

the atomic fraction of Cu is up to 40 percent; the atomic fraction of Ag is up to 30 percent;

the atomic fraction of Pd is up to 7.5 percent; the atomic fraction of Zn is up to 7.5 percent;

the atomic fraction of Ge is up to 7.5 percent; the atomic fraction of Pt is up to 7.5 percent;

the atomic fraction of one or more of Ni, Co, Fe Al, Be, Y, La, Sn, Sb, Pb, P is up to 5 percent.

16. The Au-based metallic glass matrix composite of claim 1, wherein the Au-based metallic glass matrix composite has a composition represented by the following formula:

$$Au_{(100-a-b-c-d-e)}Cu_aAg_bPd_cZn_dSi_e \quad \text{EQ (1)}$$

where a, b, c, d, and e denote atomic percentages, and where:

a ranges from 5 to 35;

b ranges from 1 to 30;

c is up to 7.5;

d is up to 7.5; and e ranges from 1 to 16.

17. The Au-based metallic glass matrix composite of claim 16, wherein the partitioning coefficient for Au in the primary-Au phase is greater than 1, the partitioning coefficient for Si in the primary-Au phase is less than 0.2, the partitioning coefficient for Cu in the primary-Au phase is less than 1, the partitioning coefficient for Ag in the primary-Au phase is greater than 1, the partitioning coefficient for Pd in the primary-Au phase is less than 0.2, and the partitioning coefficient for Zn in the primary-Au phase is greater than 1.

18. The Au-based metallic glass matrix composite of claim 1, wherein the Au-based metallic glass matrix composite comprises Au, Cu, Ag, Pd, and Si:

where the atomic concentrations of Au, Cu, Ag, Pd, and Si depend on a parameter x, where x is selected from the range of $0<x<1$;

where the concentration of Au in atomic percent is defined by equation $a_1+a_2\cdot x$, where $60<a_1<70$ and $-16<a_2<-14$;

where the concentration of Cu in atomic percent is defined by equation $b_1+b_2\cdot x$, where $20<b_1<25$ and $2.9<b_2<3.3$;

where the concentration of Ag in atomic percent is defined by equation $c_1+c_2\cdot x$, where $11<c_1<14$ and $-10<c_2<-9$;

where the concentration of Pd in atomic percent is defined by equation $d\cdot x$, where $2<d<4$; and where the concentration of Si in atomic percent is defined by equation $e\cdot x$, where $17<e<20$.

* * * * *